US005139931A

United States Patent [19]

Seto et al.

[11] Patent Number: 5,139,931

[45] Date of Patent: Aug. 18, 1992

[54] SILVER HALIDE COLOR PHOTOGRAPHIC MATERIAL COMPRISING COLOR IMAGE STABILIZERS

[75] Inventors: Nobuo Seto; Masakazu Morigaki, both of Kanagawa, Japan

[73] Assignee: Fuji Photo Film Co., Ltd., Kanagawa, Japan

[21] Appl. No.: 540,970

[22] Filed: Jun. 20, 1990

[30] Foreign Application Priority Data

Jun. 22, 1989 [JP] Japan ..... 1-160150

[51] Int. Cl.[5] ..... G03C 1/34; G03C 7/38

[52] U.S. Cl. ..... 430/551; 430/548; 430/558; 430/610

[58] Field of Search ..... 430/558, 551, 610

[56] References Cited

U.S. PATENT DOCUMENTS

| | | | |
|---|---|---|---|
| 4,588,679 | 5/1986 | Furutachi | 430/551 |
| 4,735,893 | 4/1988 | Morigaki et al. | 430/551 |
| 4,857,444 | 8/1989 | Hirose et al. | 430/551 |
| 4,980,275 | 12/1990 | Goddard | 430/551 |

FOREIGN PATENT DOCUMENTS

| | | | |
|---|---|---|---|
| 10309957 | 9/1988 | European Pat. Off. . | |
| 20337784 | 10/1989 | European Pat. Off. . | |
| 7332728 | 10/1973 | Japan | 430/610 |
| 62-186263 | 2/1986 | Japan . | |

*Primary Examiner*—Lee C. Wright

*Attorney, Agent, or Firm*—Sughrue, Mion, Zinn, Macpeak & Seas

[57] ABSTRACT

A silver halide color photographic material is disclosed having at least one coupler of the following formula (I), at least one compound of the following formula (II), and at least one compound of the following formula (III) in the same layer:

(I)

(II)

(III)

wherein the substituent groups are as defined in the specification.

The material resists fogging and forms a color image having excellent light-fastness.

17 Claims, No Drawings

SILVER HALIDE COLOR PHOTOGRAPHIC MATERIAL COMPRISING COLOR IMAGE STABILIZERS

FIELD OF THE INVENTION

The present invention relates to silver halide color photographic materials and, more precisely, to those containing at least one pyrazoloazole magenta coupler. The color image formed from the coupler in the material is fast to light and is especially resistant to fading or discoloration by light.

BACKGROUND OF THE INVENTION

It is well known that an aromatic primary amine color developing agent as oxidized with an oxidizing agent of an exposed silver halide reacts with a coupler to give indophenol, indaniline, indamine, azomethine, phenoxazine, phenazine or similar dyes to thereby form a color image.

For forming magenta color images, 5-pyrazolone, cyanoacetophenone, indazolone, pyrazolobenzimidazole or pyrazolotriazole couplers are employed.

Almost all the magenta couplers which have hitherto been studied and used in practice are 5-pyrazolone compounds. However, it has been known that the dyes derived from 5-pyrazolone couplers have some unfavorable absorption in the vicinity of 430 nm to cause color contamination.

In order to overcome the problem or to provide couplers capable of forming magenta color images which have little absorption in the yellow color range, British Patent 1,047,612 has proposed pyrazolobenzimidazole skeletons, and U.S. Pat. No. 3,725,067 pyrazolo[5,1-c]-1,2,4-triazole skeletons.

The present inventors have developed magenta couplers capable of forming color images with little yellow absorption and having a good color forming capacity, which are pyrazoloazole magenta couplers of imidazo[1,2-b]pyrazoles, pyrazolo[1,5-b][1,2-4]triazoles, pyrazolo[1,5-d]tetrazoles, pyrazolo[1,5-d]benzimidazoles or pyrazolopyrazoles.

However, it has been found that the azomethine dyes formed from the pyrazoloazole couplers have a relatively low fastness to light and the poor light-fastness of the dyes could not be improved sufficiently by conventional color image stabilizers (for example, alkyl-substituted hydroquinones) which have heretofore been employed generally.

In order to overcome the problem, therefore, addition to various compounds has been tried so as to improve the light-fastness of the dyes. For example, JP-A-59-125732, JP-A-60-262159, JP-A-61-282245, JP-A-62-244045, JP-A-62-244046, JP-A-62-273531, JP-A-61-158330, JP-A-63-95439, JP-A-63-95448, JP-A-63-95450 and JP-A-63-284548 have proposed addition of alkoxybenzene derivatives. (The term "JP-A" as used herein means an "unexamined published Japanese patent application".) The compounds disclosed in these Japanese patent applications have an excellent light-fastness improving effect on the dyes derived from the couplers only in the range of high color density (hereinafter referred to as the "high density range").

In general, the dyes to be formed from pyrazoloazole couplers have an extremely poor light-fastness, especially in the range of low color density (hereinafter referred to as the "low density range"), which is unfavorable in view of the color balance with other color dyes.

Since addition of the above-mentioned dialkoxybenzene derivatives is insufficient to improve the light-fastness in the low density range, a technique for solving this problem is strongly desired.

JP-B-48-32728 (the term "JP-B" as used herein means an "examined published Japanese patent application") and JP-A-62-186263 and EP-A-309957 have proposed addition of phosphite esters to color photographic materials.

The compounds illustrated in the former two patent applications are effective for inhibiting yellow stains derived from couplers under heat or wet heat, but they often worsen the photographic characteristics of photographic materials by, for example, increasing fog or causing fluctuation of the sensitivity when the materials are color-developed. In addition, when the storage period from the manufacture of photographic materials to the use thereof is long, these effects become extremely noticeable. JP-A-62-186263 has proposed employment of metal complexes optionally along with alkoxybenzene derivatives. However, while addition of metal complexes improves the light-fastness, it increases the appearance of unfavorable yellow stains. Where dialkoxy benzene derivatives are added along with metal complexes, the light-fastness is somewhat improved, but the generation of unfavorable yellow stains is practically unavoidable. Therefore, addition of dialkoxybenzene derivatives is not practical. EP-A-309957 has proposed addition of tri-valent phosphorus compounds having a particular structure, which could improve the drawback of causing fog and sensitivity fluctuation but could not satisfactorily improve the color-fastness.

Given this situation, a technique for improving the color-fastness of the color dyes formed from couplers without causing any undesirable influence on the photographic properties of photographic materials and, in particular, of inhibiting fading of the color dyes in the low density range, has been desired.

SUMMARY OF THE INVENTION

Accordingly, one object of the present invention is to provide color photographic materials which contain at least one pyrazoloazole coupler having an excellent color forming property and an excellent color-reproducibility and which form color images having an excellent light-fastness.

Another object of the present invention is to provide color photographic materials which form color images having an excellent light-fastness without substantial fluctuation of the photographic characteristics of the material during storage thereof before use.

These objects have been attained by a silver halide color photographic material which has at least one coupler of the following formula (I), at least one compound of the following formula (II), and at least one compound of the following formula (III) in the same layer:

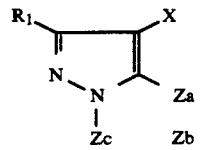

(I)

where $R_1$ represents a hydrogen atom or a substituent;

X represents a hydrogen atom or a group which may be released by a coupling reaction with the oxidation product of an aromatic primary amine developing agent;

Za, Zb and Zc each represents a methine group, a substituted methine group, =N— or —NH—;

either the ZaZb bond or the Zb-Zc bond is a double bond and the other is a single bond;

when the Zb-Zc bond is a carbon-carbon double bond, it may form part of an aromatic ring;

the coupler may form a dimer or a higher polymer at the position of $R_1$ or X; and when Za, Zb or Zc is a substituted methine group, the coupler may also form a dimer or a higher polymer at the position of the substituted methine group.

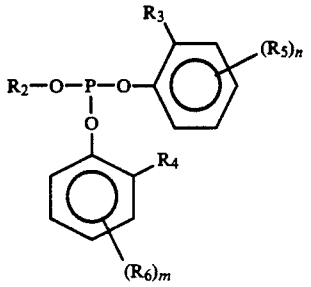

(II)

where $R_2$ represents an alkyl group, an alkenyl group, a cycloalkyl group or

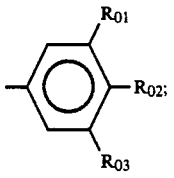

$R_3$ and $R_4$ each represents an alkyl group or represents a linking group each other:

$R_{01}$ $R_{02}$ and $R_{03}$ each represents a hydrogen atom or a substituent;

$R_5$ and $R_6$ each represents a substituent;

$R_3$ and $R_4$ may be bonded to each other; and n and m each represents an integer of from 0 to 4.

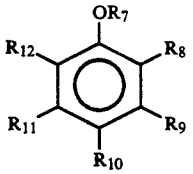

(III)

where $R_7$ represents an alkyl group, an alkenyl group, an aryl group, a heterocyclic group or

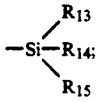

$R_{13}$, $R_{14}$ and $R_{15}$ may be same or different and each represents an alkyl group, an alkenyl group, an aryl group, an alkoxy group, an alkenoxy group or an aryloxy group;

$R_8$, $R_9$, $R_{10}$, $R_{11}$ and $R_{12}$ may be same or different and each represents a hydrogen atom, an alkyl group, an alkenyl group, an aryl group, a substituted amino group, an alkylthio group, an arylthio group, a halogen atom,

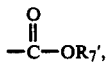

or —O—$R_7'$ has the same meaning as $R_7$; $R_7$ and $R_8$ may be bonded to each other to form a 5-membered or 6-membered ring or a spiro ring; and $R_8$ and $R_9$, or $R_9$ and $R_{10}$ may be bonded to each other to form a 5-membered or 6-membered ring or a spiro ring.

DETAILED DESCRIPTION OF THE INVENTION

Couplers of the formula (I) are explained in detail below.

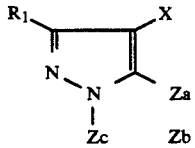

(I)

where $R_1$ represents a hydrogen atom or a substituent;

X represents a hydrogen atom or a group which may be released by a coupling reaction with the oxidation product of an aromatic primary amine developing agent;

Za, Zb and Zc each represents a methine group, a substituted methine group, =N— or —NH—;

either the Za-Zb bond or the Zb-Zc bond is a double bond and the other is a single bond;

when the Zb-Zc bond is a carbon-carbon double bond, it may form part of an aromatic ring;

the coupler may form a dimer or a higher polymer at the position of $R_1$ or X; and when Za, Zb or Zc is a substituted methine group, the coupler may also form a dimer or a higher polymer at the position of the substituted methine group.

Where the formula (I) forms a dimer or a higher polymer, the dimer or higher polymer contains two or more groups represented by the formula (I) in one molecule. Bis forms or polymer couplers are within the scope of the invention Precisely, the polymer couplers as referred to herein may be either homopolymers comprising only monomers having a moiety of the formula (I) (preferably, those having a vinyl group, which are referred to as vinyl monomers hereinafter) or copolymers comprising monomers having a moiety of the formula (I) and other non-coloring ethylenic monomers which do not couple with the oxidation product of an aromatic primary amine developing agent.

Of the pyrazoloazole magenta couplers of the formula (I), those of the following formulae (I-1), (I-2), (I-3), (I-4), (I-5), (I-6) and (I-7) are preferred.

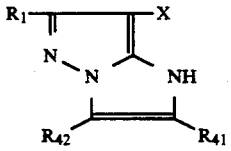

(I-1)

-continued

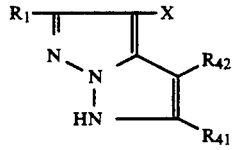
(I-2)

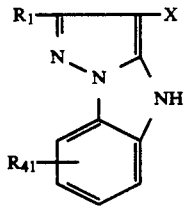
(I-3)

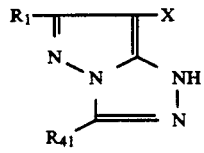
(I-4)

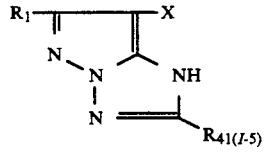

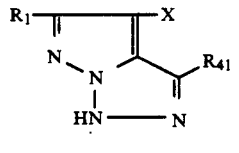
(I-6)

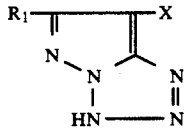
(I-7)

Among the couplers of the formulae (I-1) through (I-7), those of the formulae (I-1), (I-4) and (I-5) are preferred in view of the objects of the present invention, and those of the formulae (I-4) and (I-5) are more preferred.

In the formulae (I-1) through (I-7), $R_1$, $R_{41}$ and $R_{42}$ may be same or different and each represents a hydrogen atom, a halogen atom, an alkyl group, an aryl group, a heterocyclic group, a cyano group, an alkoxy group, an aryloxy group, a heterocyclic-oxy group, an acyloxy group, carbamoyloxy group, a silyloxy group, a sulfonyloxy group, an acylamino group, an anilino group, an ureido group, an imido group, a sulfamoylamino group, a carbamoylamino group, an alkylthio group, an arylthio group, a heterocyclic-thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group or an aryloxycarbonyl group; X represents a hydrogen atom, a halogen atom, a carboxyl group, or a group which is bonded to the carbon atom of the coupling position via an oxygen atom, a nitrogen atom or a sulfur atom and which is released by coupling. $R_1$, $R_{41}$, $R_{42}$ or X may be a divalent group to form a bis form or a higher polymer.

The couplers may also be in the form of polymer couplers having the coupler residue of any one of the formulae (I-1) through (I-7) in the main chain or side chain. In particular polymers derived from vinyl monomers having the moiety of any one of the formulae (I-1) to (I-7) are preferred. In this case, $R_1$, $R_{41}$, $R_{42}$ or X represents a Vinyl group or a linking group.

More precisely, $R_1$, $R_{41}$, and $R_{42}$ each represents a hydrogen atom, a halogen atom (e.g., chlorine, bromine), an alkyl group (e.g., methyl, propyl, isopropyl, t-butyl, trifluoromethyl, tridecyl, 2-[alpha-{3-(2-octyloxy 5-tert-octylbenzenesulfonamido)phenoxy}tetradecanamido]ethyl, 3-(2,4-di-t-amylphenoxy)propyl, allyl, 2-dodecyloxyethyl, 1-(2-octyloxy-5-tert-octylbenzenesulfonamido)-2-propyl, 1-ethyl-1-{4-(2-butoxy-5-tert-octylbenzenesulfonamido)phenyl]methyl, 3-phenoxypropyl, 2-hexylsulfonylethyl, cyclopentyl, benzyl), an aryl group (e.g., phenyl, 4-t-butylphenyl, 2,4-di-t-amylphenyl, 4-tetradecanamidophenyl), a heterocyclic group (e.g., 2-furyl, 2-thienyl, 2-pyrimidinyl, 2-benzothiazolyl), a cyano group, an alkoxy group (e.g., methoxy, ethoxy, 2-methoxyethoxy, 2-dodecyloxyethoxy, 2-methanesulfonylethoxy), an aryloxy group (e.g., phenoxy, 2-methylphenoxy, 4-t-butylphenoxy), a heterocyclic-oxy group (e.g., 2-benzimidazolyloxy), an acyloxy group (e.g., acetoxy, hexadecanoyloxy), a carbamoyloxy group (e.g., N-phenylcarbamoyloxy, N-ethylcarbamoyloxy), a silyloxy group (e.g., trimethylsilyloxy), a sulfonyloxy group (e.g., dodecylsulfonyloxy), an acylamino group (e.g., acetamido, benzamido, tetradecanamido, alpha-(2,4-di-t-amylphenoxy)butylamido, gamma-(3-t-butyl-4-hydroxyphenoxy)-butylamido, alpha-{4-(4-hydroxyphenylsulfonyl)-phenoxy}decanamido), an anilino group (e.g., phenylamino, 2-chloroanilino, 2-chloro-5-tetradecanamidoanilino, 2-chloro-5-dodecyloxycarbonylanilino, N-acetylanilino, 2-chloro-5-{alpha-(3-t-butyl-4-hydroxyphenoxy)dodecanamido.}anilino), a ureido group (e.g., phenylureido, methylureido, N,N-dibutylureido), an imido group (e.g., N-succinimido, 3-benzylhydantoinyl, 4-(2-ethylhexanoylamino)phthalimido), a sulfamoylamino group (e.g., N,N-dipropylsulfamoylamino, N-methyl-decylsulfamoylamino), an alkylthio group (e.g., methylthio, octylthio, tetradecylthio, 2-phenoxyethylthio, 3-phenoxypropylthio, 3-(4-t-butylphenoxy)propylthio), an arylthio group (e.g., phenylthio, 2-butoxy-5-t-octylphenylthio, 3-pentadecylphenylthio, 2-carboxyphenylthio, 4-tetradecanamidophenylthio), a heterocyclic thio group (e.g., 2-benzothiazolylthio), an alkoxycarbonylamino group (e.g., methoxycarbonylamino, tetradecyloxycarbonylamino), an aryloxycarbonylamino group (e.g., phenoxycarbonylamino, 2,4-di-tert-butylphenoxycarbonylamino), a sulfonamido group (e.g., methanesulfonamido, hexadecanesulfonamido, benzenesulfonamido, p-toluenesulfonamido, octadecanesulfonamido, 2-methyloxy-5-t-butylbenzenesulfonamido), a carbamoyl group (e.g., N-ethylcarbamoyl, N,N-dibutylcarbamoyl, N-(2-dodecyloxyethyl)carbamoyl, N-methyl-N-dodecylcarbamoyl, N-{3-(2,4-di-tert-amylphenoxy)propyl}carbamoyl), an acyl group (e.g., acetyl, (2,4-di-tert-amylphenoxy)acetyl, benzoyl), a sulfamoyl group (e.g., N-ethylsulfamoyl, N,N-dipropylsulfamoyl, N-(2-dodecyloxyethyl)sulfamoyl, N-ethyl-N-dodecylsulfamoyl, N,N-diethylsulfamoyl), a sulfonyl group (e.g., methanesulfonyl, octanesulfonyl, benzenesulfonyl, toluenesulfonly), a sulfinyl group (e.g. octane sulfinyl, sulfinyl, dodecylsulfinyl, phenylsulfinyl), an alkoxycarbonyl group (e.g., methoxycarbonyl, butyloxycarbonyl, dodecyloxycarbonyl, octadecyloxycarbonyl), or an aryloxycarbonyl group (e.g., phenyloxycarbonyl, 3-pentadecyloxycarbonyl); and X represents a hydrogen atom, a halogen atom (e.g., chlorine, bromine, iodine), a carboxyl group, a group bonding to the coupler via an oxygen atom (e.g., acetoxy, propanoyloxy, benzoyloxy, 2,4-dichlorobenzoyloxy, ethoxyoxaloyloxy, pyruvinyloxy, cinnamoyloxy, phenoxy, 4 cyanophenoxy, 4-methanesulfonamidophenoxy, 4-methanesulfonylphenoxy, alphanaphthoxy, 3-pentadecylphenoxy, benzyloxycarbonyloxy, ethoxy, 2-cyanoethoxy, benzyloxy, 2-phenethyloxy, 2-phenoxyethoxy, 5-phenyltetrazolyloxy, 2-benzothiazolyloxy), a group bonding to the coupler via a nitrogen atom (e.g., benzenesulfonamido, N-ethyltoluenesulfonamido, heptafluorobutanamido, 2,3,4,5,6-pentafluorobenzamido, octanesulfonamido, p-cyanophenylureido, N,N-diethylsulfamoylamino, 1-piperidyl, 5,5 diethyl-2,4-dioxo-3-oxazolidinyl, 1-benzyl-ethoxy-3-hydantoinyl, 2N-1,1-dioxo-3(2H)-oxo-1,2-benzoisothiazolyl, 2-oxo-1,2-dihydro-1-pyridinyl, imidazolyl, pyrazolyl, 3,5-diethyl-1,2,4-triazol-1-yl, 5- or 6-bromo-benzotriazol-1-yl, 5-methyl-1,2,3,4-triazol-1-yl, benzimidazolyl, 3-benzyl-1-hydantoinyl, 1-benzyl-5-hexadecyloxy-3-hydantoinyl, 5-methyl-1-tetrazolyl), an arylazo group (e.g., 4-methoxyphenylazo, 4-pyvaloylaminophenylazo, 2-naphthylazo, 3-methyl-4-hydroxyphenylazo), or a group bonding to the coupler via a sulfur atom (e.g., phenylthio, 2-carboxyphenylthio, 2-methoxy-5-t-octylphenylthio, 4-methanesulfonylphenylthio, 4-octanesulfonamidophenylthio, 2-butoxyphenylthio, 2-(2-hexanesulfonylethyl)-5-tert-octylphenylthio, benzylthio, 2-cyanoethylthio, 1-ethoxycarbonyltridecylthio, 5-phenyl-2,3,4,5-tetrazolylthio, 2-benzothiazolylthio, 2-dodecylthio-5-thiophenylthio, 2-phenyl-3-dodecyl-1,2,4-triazole-5-thio).

In the couplers of the formulae (I-1) and (I-2), $R_{41}$ and $R_{42}$ may be bonded to each other to form a 5 membered to 7-membered ring.

Where $R_1$, $R_{41}$, $R_{42}$ or X in the formulae is a divalent group to form a bis form, it is preferred that $R_1$, $R_{41}$ and $R_{42}$ each represents a substituted or unsubstituted alkylene group (e.g., methylene, ethylene, 1,10-decylene, $—CH_2CH_2—O—CH_2CH_2—$), a substituted or unsubstituted phenylene (e.g., 1,4-phenylene, 1,3-phenylene,

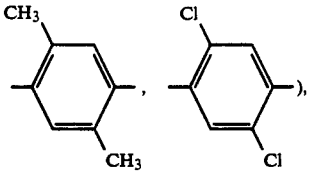

—NHCO—$R_{43}$—CONH— (where $R_{43}$ represents a substituted or unsubstituted alkylene or phenylene group, for example, $—NHCOCH_2CH_2CONH—$,

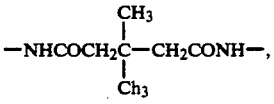

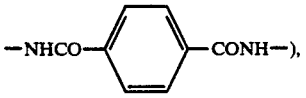

or —S—$R_{44}$—S— (where $R_{44}$ represents a substituted or unsubstituted alkylene, for example, $—S—CH_2CH_2—S—$,

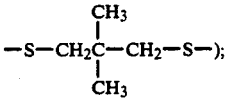

and X represents a divalent group corresponding to the above-mentioned mono-valent group.

Where the group derived from the formulae (I-1), (I-2), (I-3), (I-4), (I-5), (I-6) and (I-7) is a vinyl monomer capable of forming dimer or polymer couplers, the linking group to be represented by $R_1$, $R_{41}$, $R_{42}$ or X may be composed of one or more groups selected from an alkylene group (e.g., methylene, ethylene, 1,10-decylene, $—CH_2CH_2OCH_2CH_2$ ), a phenylene group (e.g., 1,4-phenylene, 1,3-phenylene,

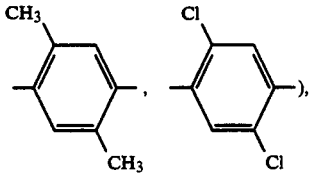

—NHCO, —CONH—, —O—, —OCO—, and an aralkylene group

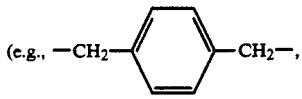

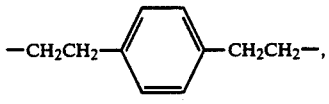

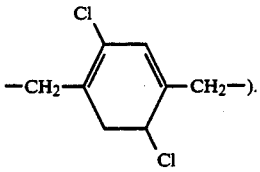

The following are preferred linking groups.

—NHCO—; $—CH_2CH_2—$;

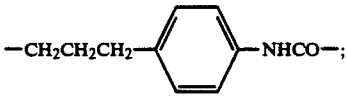

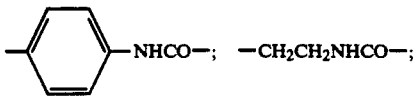

$—CH_2CH_2—O—\underset{\underset{O}{\|}}{C}—$; $—CONH—CH_2CH_2NHCO—$;

$—CH_2CH_2O—CH_2CH_2—NHCO—$;

-continued

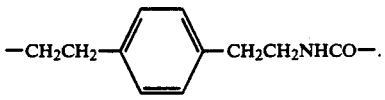

The vinyl group in the vinyl monomers may have any substituent(s) other than the group derived from the formulae (I-1), (I-2), (I-3), (I-4), (I-5), (I-6) and (I-7). Examples of preferred substituents are a hydrogen atom, a chlorine atom and a lower alkyl group having from 1 to 4 carbon atoms (e.g., methyl, ethyl).

Monomers containing the group derived from the formulae (I-1), (I-2), (I-3), (I-4), (I-5),, (I-6) and (I-7) may form copolymers with non-coloring ethylenic monomers which do not couple with the oxidation product of an aromatic primary amine developing agent.

Examples of non-coloring ethylenic monomers which do not couple with the oxidation product of an aromatic primary amine developing agent include acrylic acid, alpha-chloroacrylic acid, alpha-alkylacrylic acids (e.g., methacrylic acid) as well as ester or amide derivatives derived from the acrylic acids (e.g., acrylamide, n-butylacrylamide, t-butylacrylamide, diacetoneacrylamide, methacrylamide, methyl acrylate, ethyl acrylate, n-propyl acrylate, n-butyl acrylate, t-butyl acrylate, iso-butyl acrylate, 2-ethylhexyl acrylate, n-octylacrylate, lauryl acrylate, methyl methacrylate, ethyl methacrylate, n-butyl methacrylate and beta-hydroxy methacrylate), methylene-dibisacrylamide, vinyl esters (e.g., vinyl acetate, vinyl propionate and vinyl laurate), acrylonitrile, methacrylonitrile, aromatic vinyl compounds (e.g., styrene and derivatives thereof, vinyl toluene, divinylbenzene, vinylacetophenone and sulfostyrene), itaconic acid, citraconic acid, crotonic acid, vinylidene chloride, vinylalkyl ethers (e.g., vinylethyl ether), maleic acid, maleic anhydride, maleates, N-vinyl-2-pyrrolidone, N-vinylpyridine and 2- and 4-vinylpyridine. Two or more of these non-coloring ethylenic unsaturated monomers may be used together. For example, there may be mentioned combinations of n-butyl acrylate and methyl acrylate; styrene and methacrylic acid; methacrylic acid and acylamide; and methyl acrylate and diacetoneacrylamide.

As is well known in the field of polymer color couplers, non-coloring ethylenic unsaturated monomers to be copolymerized with solidwater-insoluble monomer couplers are selected s that the physical properties and/or chemical properties of the copolymers to be formed, for example, the solubility, the compatibility with a binder (e.g., gelatin) in photographic colloid compositions, the flexibility and the heat stability thereof can be favorably influenced by the non-coloring ethylenic unsaturated comonomers.

The polymer couplers to be used in the present invention are especially preferably in the form of a polymer coupler latex.

Specific examples of pyrazoloazole magenta couplers of the formula (I) to be used in the present invention and methods of preparing the same are described in, for example, JP-A-59-162485, JP-A-60-9, JP-A-59-171956, JP-A-60-33552, JP-A-60-172982, and U.S. Pat. No. 3,061,432.

Preferred examples of magenta couplers to be used in the present invention are shown below, which, however, are not intended to restrict the scope of the present invention.

M-1

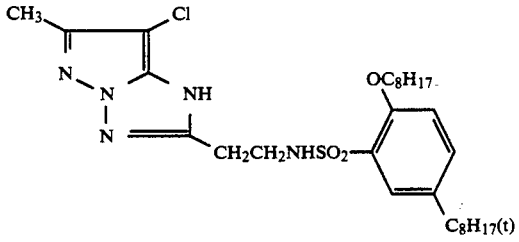

M-2

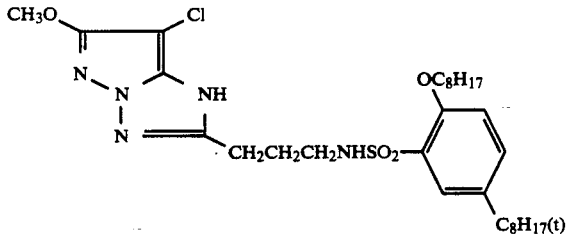

M-3

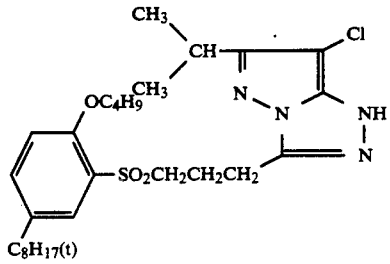

-continued
M-4
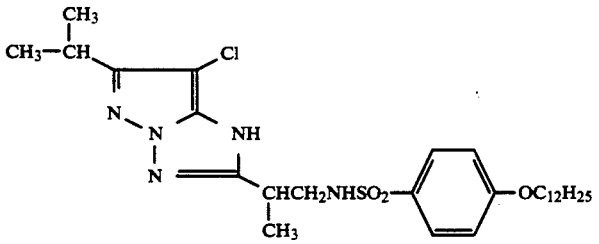
M-5
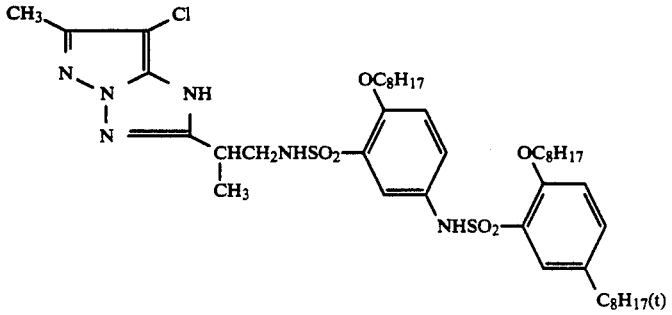
M-6
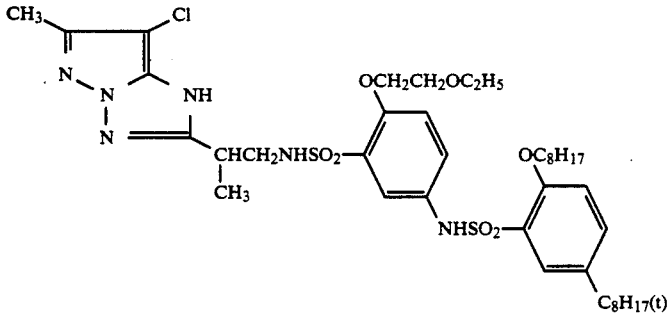
M-7
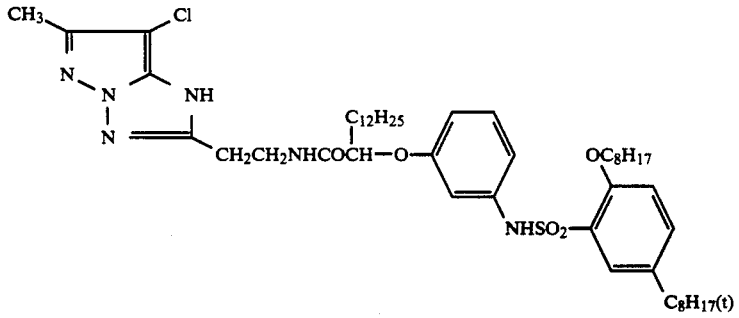
M-8
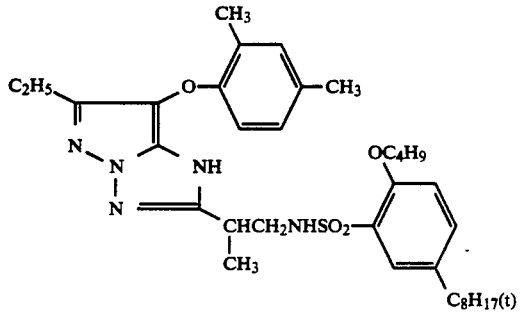

-continued
M-9
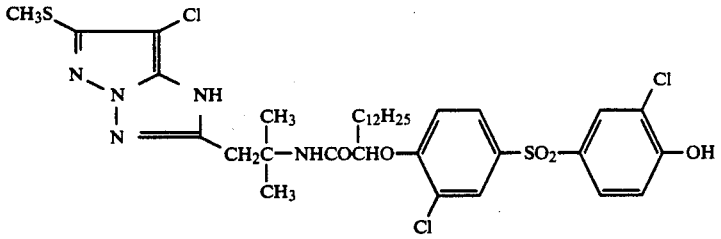
M-10
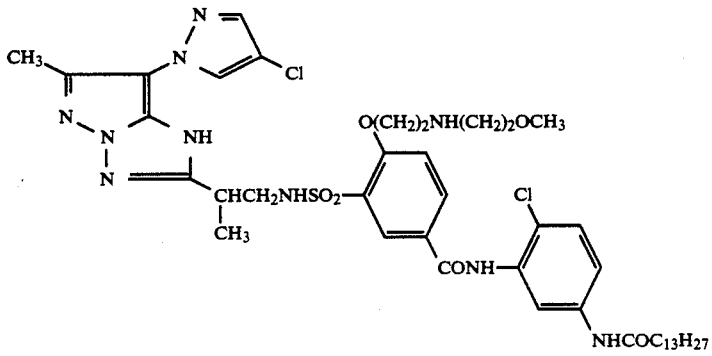
M-11
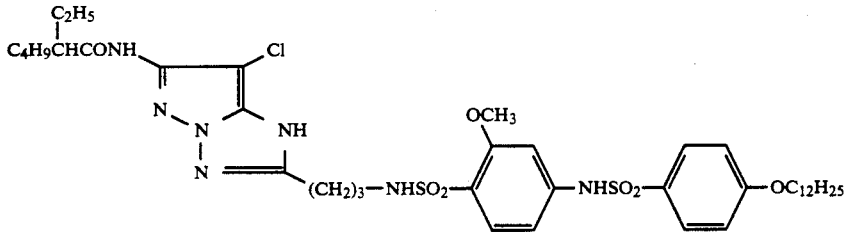
M-12
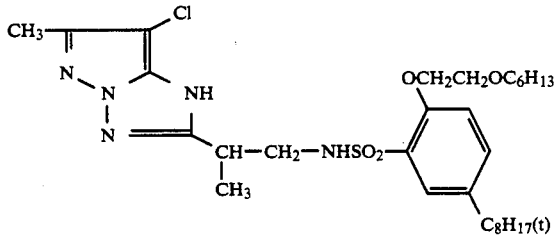
M-13
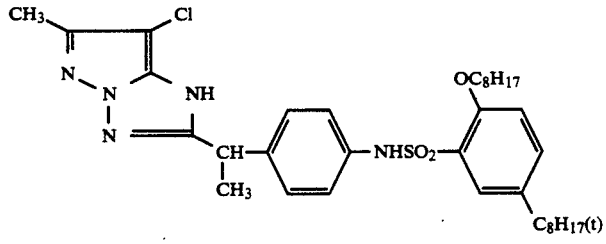
M-14
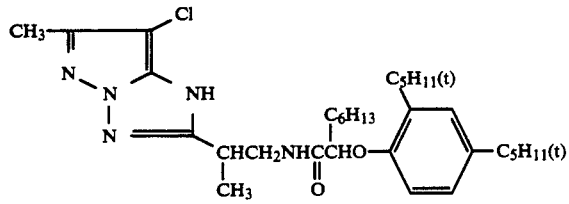

-continued
M-15
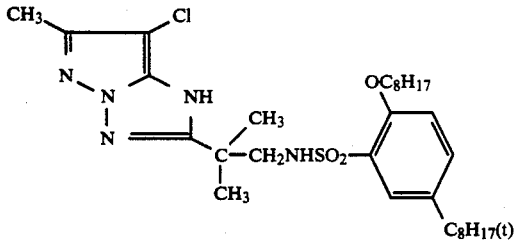
M-16
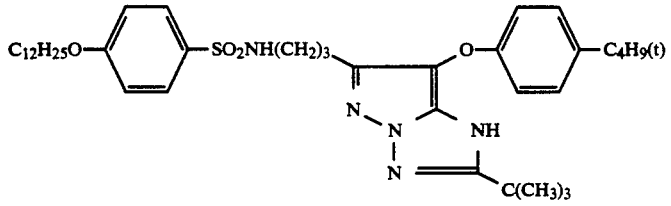
M-17
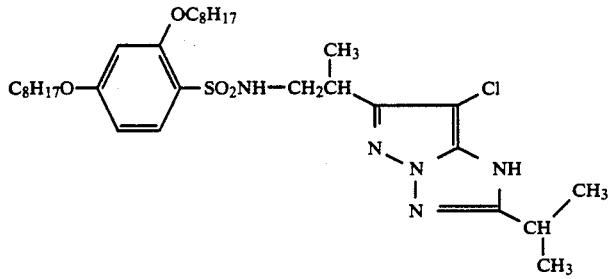
M-18
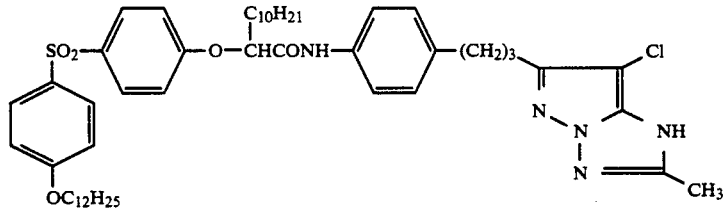
M-19
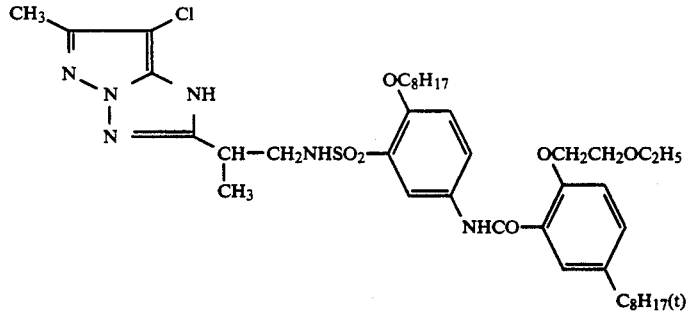
M-20
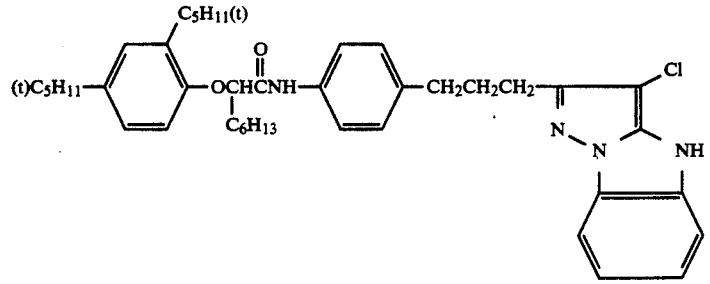

-continued
M-21
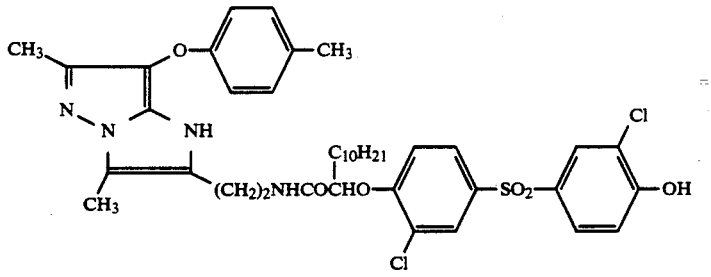
M-22
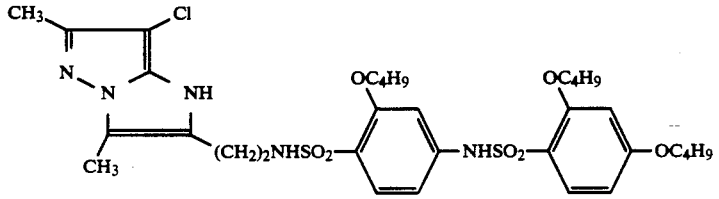
M-23
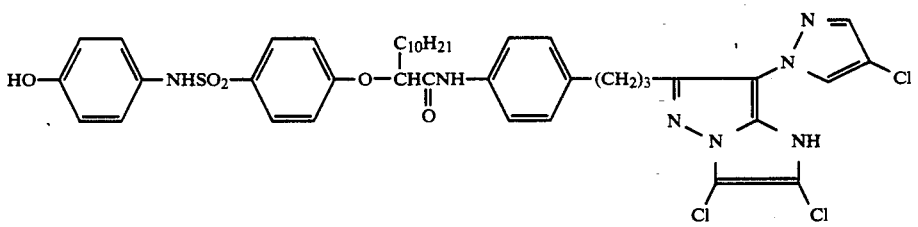
M-24
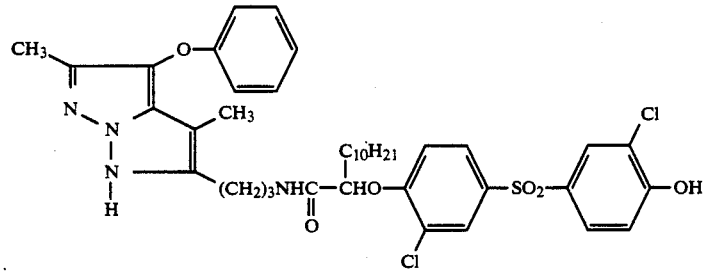
M-25
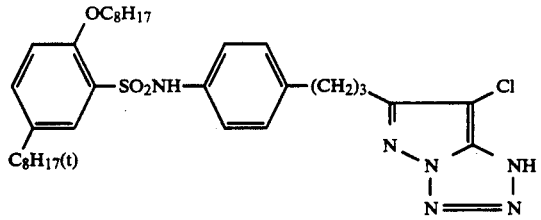
M-26
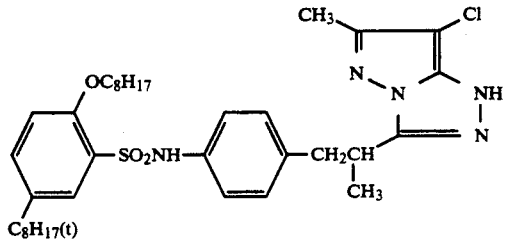

-continued
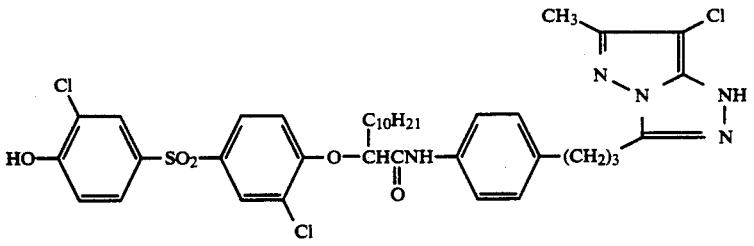
M-27
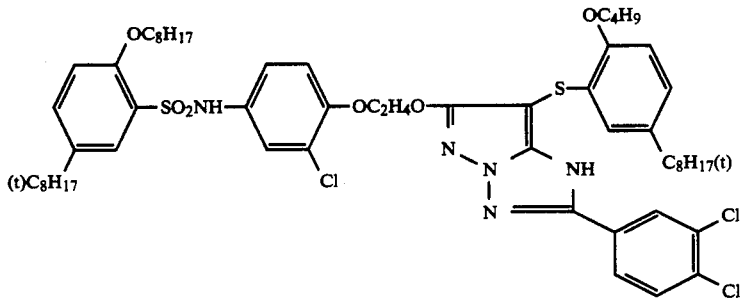
M-28
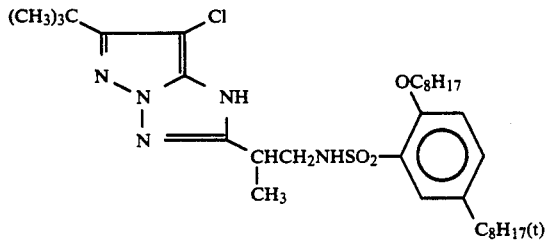
M-29
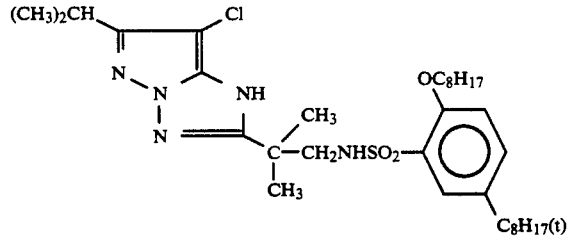
M-30
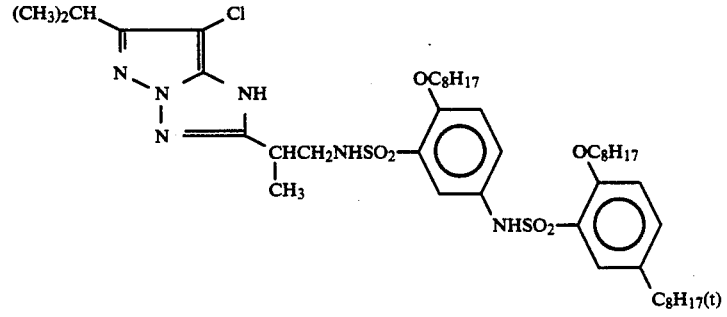
M-31

-continued
M-32
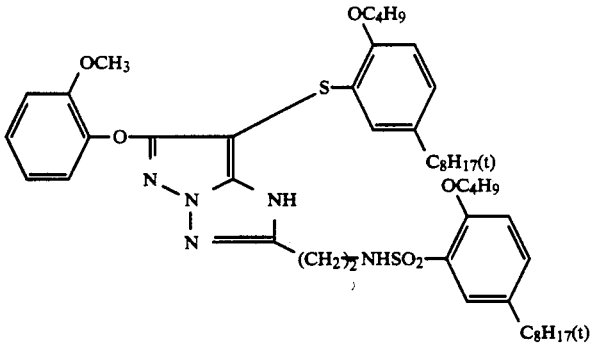
M-33
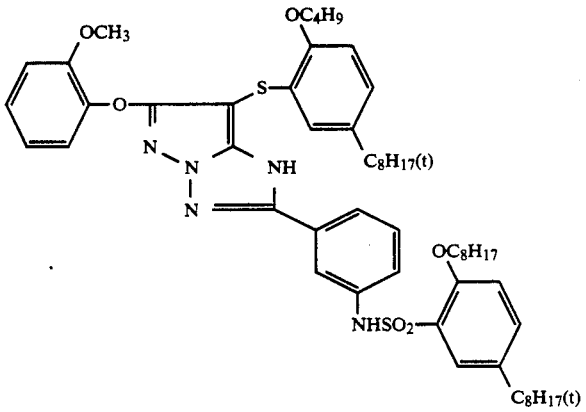
M-34
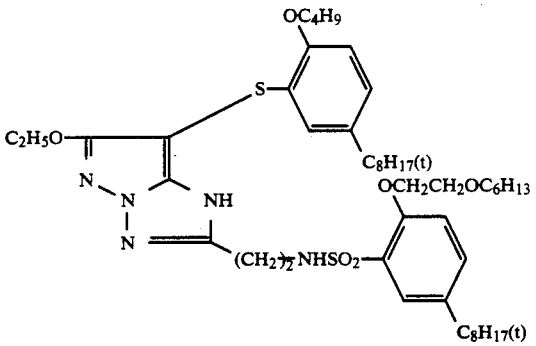
M-35
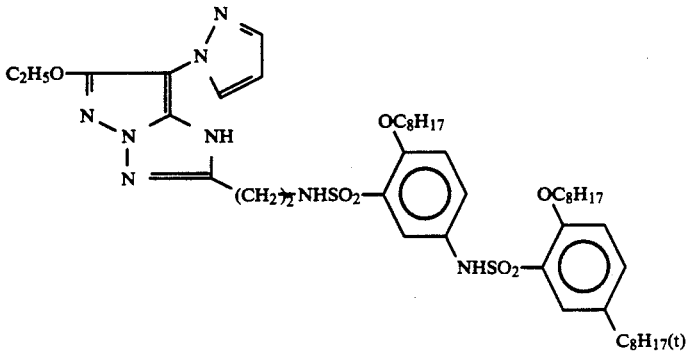

-continued
M-36
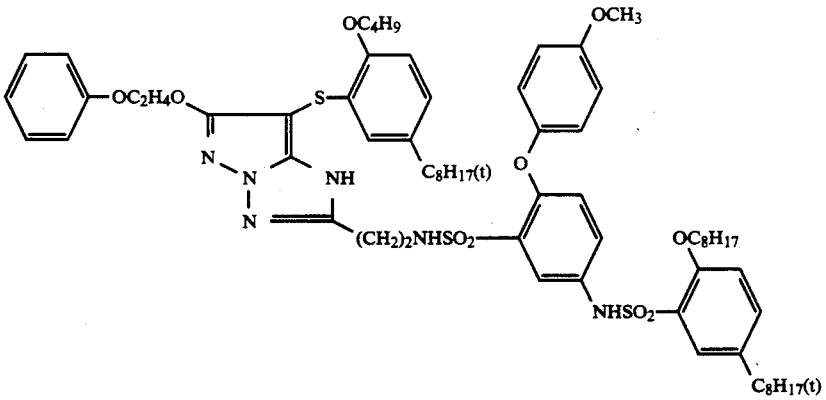
M-37
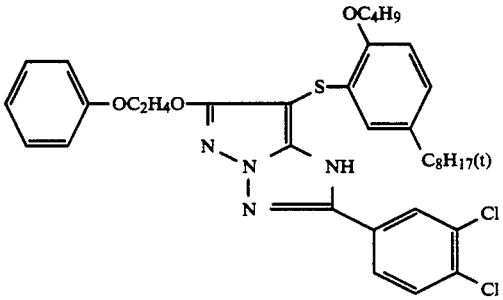
M-38
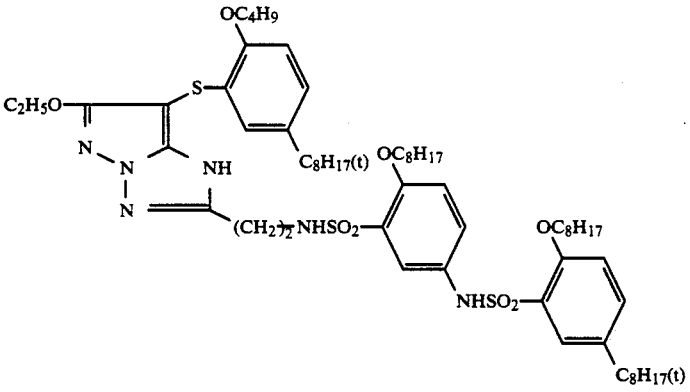
M-39
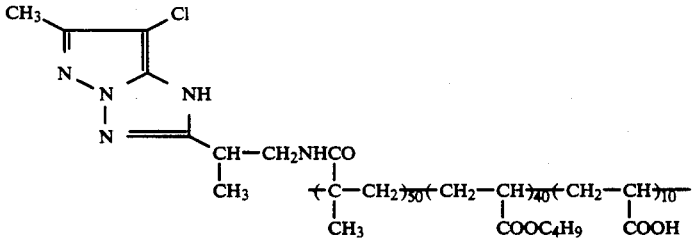
(The numbers of 50, 40 and 10 represent a molar ratio of each repeating unit)
M-40
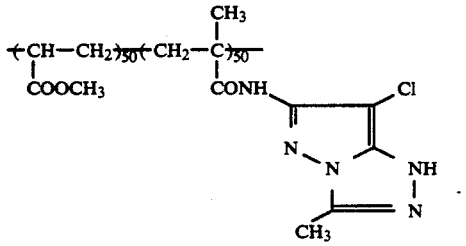
(The numbers of 50 and 50 represent a molar ratio of each repeating unit)

-continued

M-41

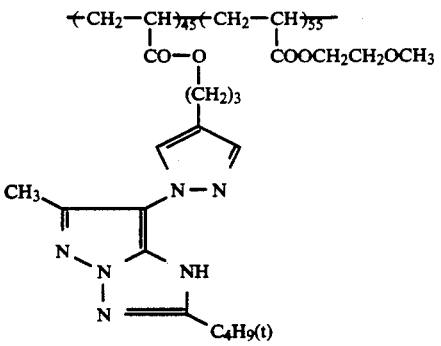

(The numbers of 45 and 55 represent a molar ratio of each repeating unit)

In accordance with the present invention, the coupler of the formula (I) of the present invention is added to the emulsion layer of the photographic material, in an amount of from $1\times10^{-3}$ mol to 1 mol, preferably from $5\times10^{-2}$ mol to $5\times10^{-3}$ mol, per mol of the silver halide in the same layer. Two or more kinds of the couplers of the formula (I) of the invention can be added to the same emulsion layer.

Compounds of the formula (II) will now be described in detail. In the formula (II), $R_2$ represents an alkyl group (e.g., methyl, n-butyl, t-octyl, n-hexyloxyethyl, benzyl), an alkenyl group (e.g., vinyl, allyl), a cycloalkyl group (e.g., cyclohexyl, cyclopentyl), or

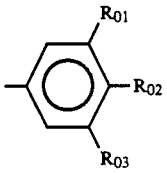

(where $R_{01}$, $R_{02}$ and $R_{03}$ each represents a hydrogen atom or a substituent). $R_3$ and $R_4$ each represents an alkyl group (e.g., methyl, ethyl, i-butyl, t-butyl, sec-butyl) or $R_3$ and $R_4$ form a link which is a direct bond, an oxygen atom, a sulfur atom, an alkylene group (e.g., methylene, ethylene) or an alkylidene group (e.g., ethylidene). $R_5$ and $R_6$ each represents a substituent. Substituents represented by $R_5$, $R_6$, $R_{01}$, $R_{02}$ and $R_{03}$ include, for example, a halogen atom (e.g., chlorine, bromine), an alkyl group (e.g., methyl, n-butyl, t-butyl, i-butyl, sec-butyl), an alkenyl group (e.g., vinyl, allyl), an aryl group (e.g., phenyl, naphthyl), an alkoxycarbonyl group (e.g., ethoxyethoxycarbonyl, ethoxycarbonyl, octyloxycarbonyl), an aryloxycarbonyl group (e.g., phenoxycarbonyl, 4-methoxyphenoxycarbonyl), a carbamoyl group (e.g., dimethylcarbamoyl, phenylcarbamoyl), an alkoxy group (e.g., methoxy, butoxy, dodecyloxy), an aryloxy group (e.g., phenoxy, 4-methoxyphenoxy), a sulfonyl group (e.g., methanesulfonyl, octanesulfonyl), a sulfonamido group (e.g., butanesulfonamido, benzenesulfonamido, dimethylsulfamido), a sulfamoyl group (e.g., dimethylsulfamoyl, phenylsulfamoyl), and an acylamino group (e.g., acetylamino, propionylamino, benzamino, diethylcarbamoylamino). n represents an integer of from 0 to 4.

Among the compounds of the formula (II), those in which the alkyl group of $R_2$ is substituted or is branched are preferred. n and m each is preferably 1 or 2, $R_5$ and $R_6$ each is preferably an alkyl group or an alkoxycarbonyl group, and more preferably an alkyl group. More preferably, $R_3$ and $R_4$ each are a tert-alkyl group or $R_3$ and $R_4$ form a link which is a direct bond, an oxygen atom, a sulfur atom, an alkylene group or alkylidene group.

Specific examples of the compounds of the formula (II) for use in the present invention are shown below, which, however, are not intended to restrict the scope of the present invention.

P-1

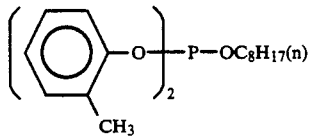

P-2

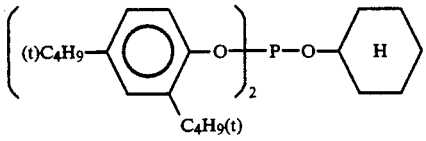

P-3

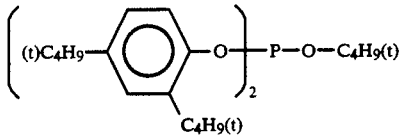

P-4

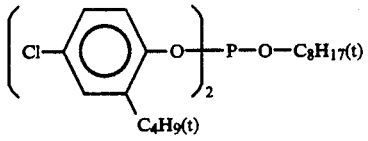

P-5

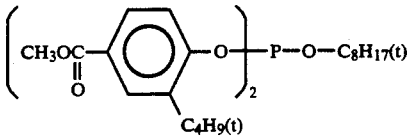

P-6

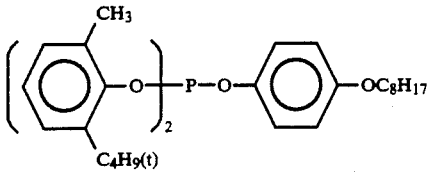

-continued
P-7
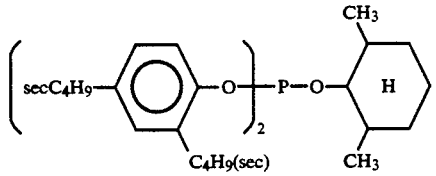
P-8
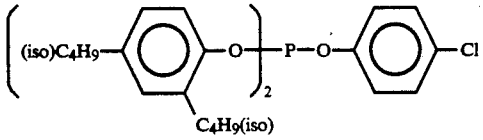
P-9
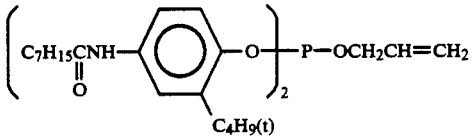
P-10
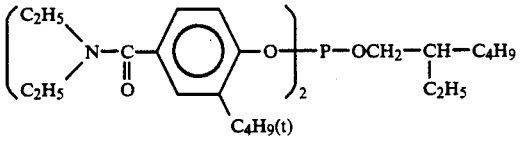
P-11
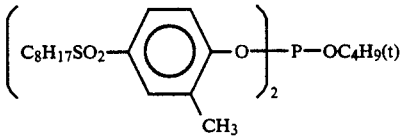
P-12
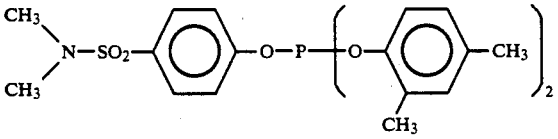
P-13
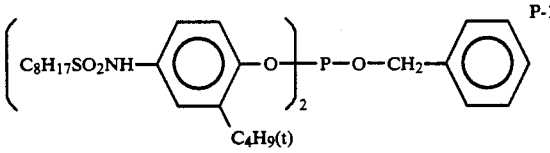
P-14
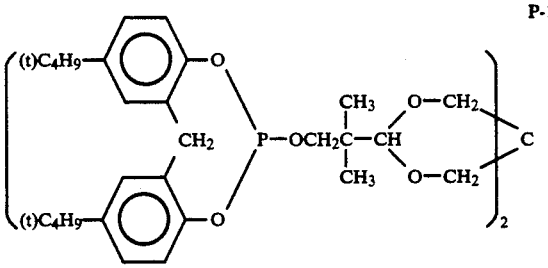
P-15
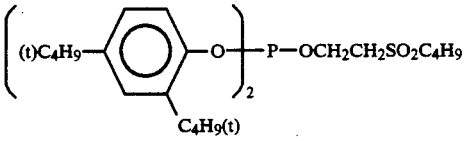
-continued
P-16
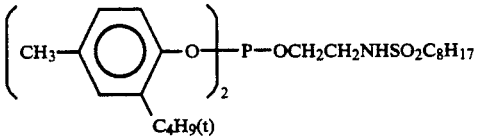
P-17
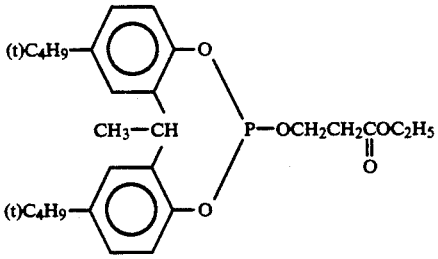
P-18
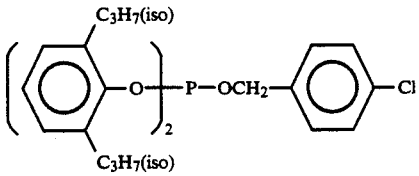
P-19
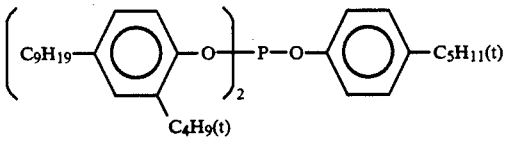
P-20
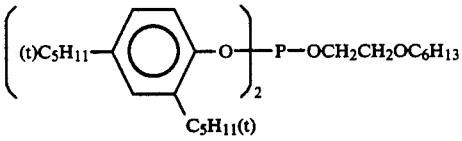
P-21
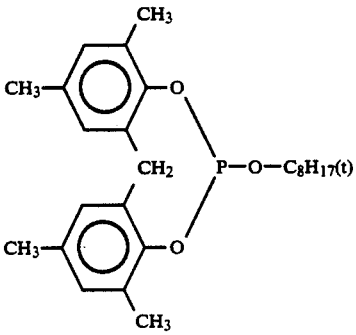

-continued

P-22

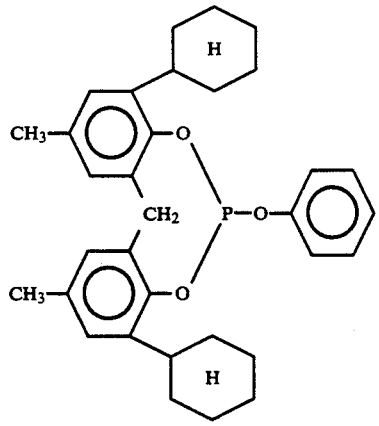

P-23

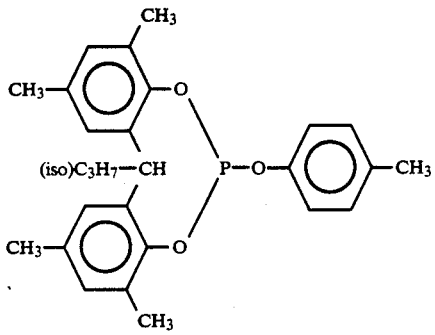

P-24

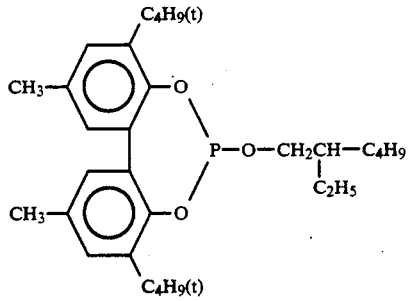

P-25

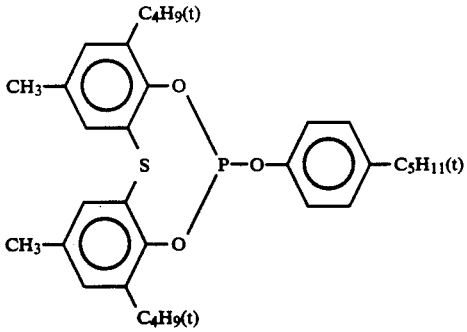

The compounds of the formula (II) for use in the present invention can be produced in accordance with the methods described in *J. Am. Chem. Soc.*, Vol. 75, pages 3145 to 3148 (1953), *Journal of the Organic Synthetic Chemical Society*, Vol. 28, pages 206 to 222 (1970), or EP-A-309957.

The amount of the compound of the formula (II) to be added to the emulsion layer of the photographic material of the present invention is from 5 to 300 mol%, preferably from 10 to 100 mol%, of the coupler of the formula (I), although the amount to be added depends upon the choice of the coupler.

Now, compounds of the formula (III) which are also employed in the present invention will be described in detail. In the formula (III), $R_7$ represents an alkyl group (e.g., methyl, n-butyl, n-octyl, n-hexadecyl, ethoxyethyl, 3-phenoxypropyl, benzyl), an alkenyl group (e.g., vinyl, allyl), an aryl group (e.g., phenyl, naphthyl), a heterocyclic group (e.g., pyridyl, tetrahydropyranyl) or

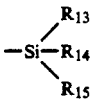

wherein $R_{13}$, $R_{14}$ and $R_{15}$ may be the same or different and each represents an alkyl group, an alkenyl group, an aryl group, an alkoxy group, an alkenoxy group or an aryloxy group (e.g., trimethylsilyl, t-butyldimethylsilyl). $R_8$, $R_9$, $R_{10}$, $R_{11}$ and $R_{12}$ may be same or different and each represents a hydrogen atom, an alkyl group (e.g., methyl, n-butyl, n-octyl, sec-dodecyl, t-butyl, t-amyl, t-hexyl, t-octyl, t-octadecyl, alpha, alpha-dimethylbenzyl, 1,1-dimethyl-4-hexyloxycarbonylbutyl), an alkenyl group (e.g., vinyl, allyl), an aryl group (e.g., phenyl, naphthyl, p-methoxyphenyl, 2,4-t-butylphenyl), a substituted amino group (e.g., acetylamino, propyonylamino, benzamino, N-methylamino, N,N-dimethylamino, N,N-dihexylamino, piperidino, N-cyclohexylamino, 1-piperazinyl, N-(t-butyl)amino), an alkylthio group (e.g., methylthio, butylthio, sec-butylthio, t-butylthio, dodecylthio), an arylthio group (e.g., phenylthio, naphthylthio), a halogen atom (e.g.,

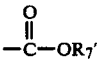

chlorine, bromine), (e.g., octyloxycarbonyl, 2,4-di-t-butylphenoxycarbonyl) or —O—$R_7'$. $R_7'$ has the same meaning as $R_7$. $R_7$ and $R_8$ may be bonded to each other to form a 5-membered or 6-membered ring or a spiro ring. $R_8$ and $R_9$, or $R_9$ and $R_{10}$ may be bonded to each other to form a 5-membered or 6-membered ring or a spiro ring. Examples of the rings include a chroman ring, a coumaran ring, a spirochroman ring and a spiroindane ring.

In view of the effect of the present invention, at least one substituent represented by any one of $R_8$ through $R_{12}$ is preferably bonded to the benzene ring via a hetero atom (especially preferably, an oxygen atom or a nitrogen atom).

Of the compounds of the formula (III), those of the following formulae (III-1) through (III-8) are more preferred in view of the effect of the present invention.

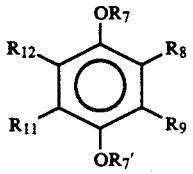

(III-1)

-continued (III-2)

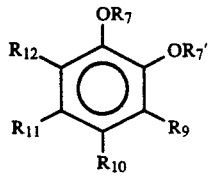

(III-3)

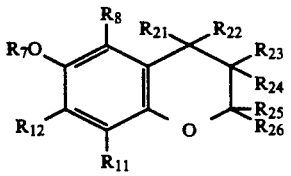

(III-4)

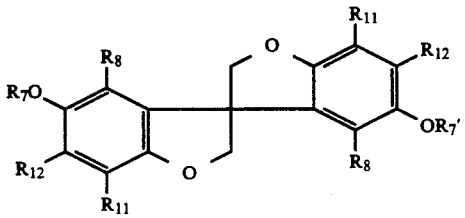

(III-5)

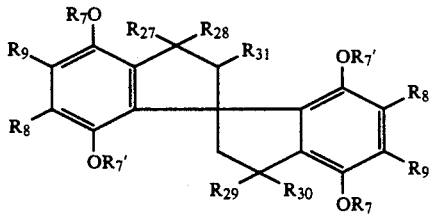

(III-6)

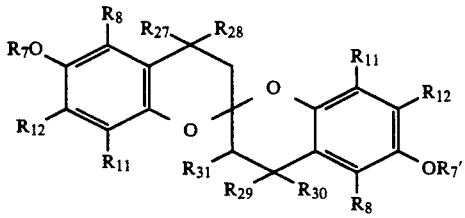

-continued (III-7)

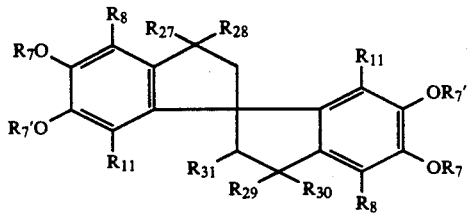

(III-8)

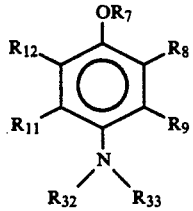

In the formulae (III-1) through (III-8), $R_7$, $R_7'$, $R_8$, $R_9$, $R_{10}$, $R_{11}$ and $R_{12}$ having the same meanings as in the formula (III). $R_{21}$ through $R_{33}$ may be the same or different and each represents a hydrogen atom, an alkyl group (e.g., methyl, ethyl, isopropyl, dodecyl) or an aryl group (e.g., phenyl, p-methoxyphenyl).

$R_{32}$ and $R_{33}$ may be the same or different and each represents a hydrogen atom, an alkyl group (e.g., methyl, ethyl, dodecyl), an aryl group (e.g., phenyl, 4-chlorophenyl}, an acyl group (e.g., acetyl, benzoyl, dodecanoyl), an oxycarbonyl group (e.g., methoxycarbonyl, 4-dodecyloxyphenoxycarbonyl), or a sulfonyl group (e.g., methanesulfonyl, octanesulfonyl, benzenesulfonyl). However, $R_{32}$ and $R_{33}$ must not be hydrogen atoms at the same time. $R_{32}$ and $R_{33}$ may be bonded to each other to form a 5- to 7-membered ring (e.g., morpholine ring, piperidine ring).

Of the compounds of the formulae (III-1) through (III-8), those in which $R_7$ and $R_7'$ each are an alkyl group or an aryl group are preferred. Most preferably, $R_7$ and $R_7'$ are both alkyl groups. $R_8$ to $R_{12}$ in the formulae each are preferably a hydrogen atom, an alkyl group or an aryl group.

Among the compounds of the formulae (III-1) through (III-8), those of the formulae [III-1), (III-5). (III-6) and (III-7) are preferred; and those of the formula (III 7) are most preferred.

Specific examples of the compounds of the formula (III) for use in the present invention are shown below, which, however, are not intended to restrict the scope of the present invention.

A-1

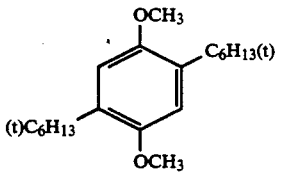

A-2

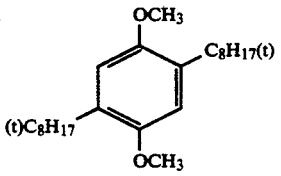

A-3

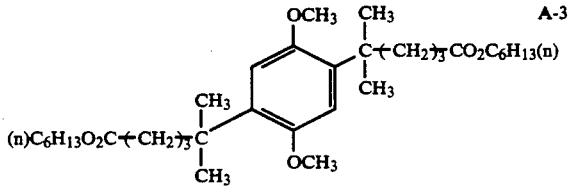

A-4

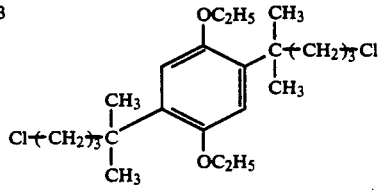

-continued
A-5
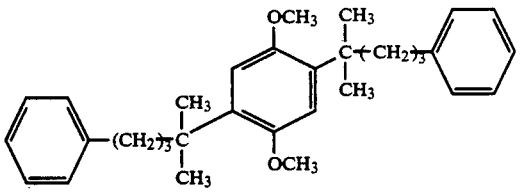
A-6
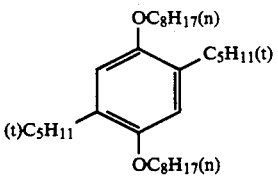
A-7
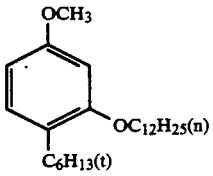
A-8
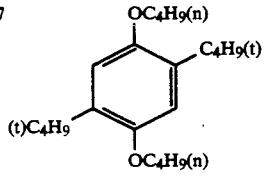
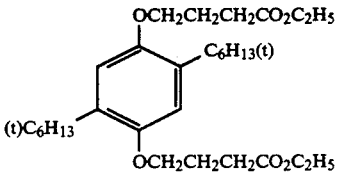
A-9
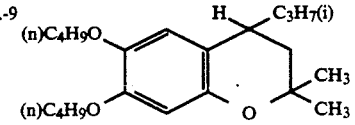
A-10
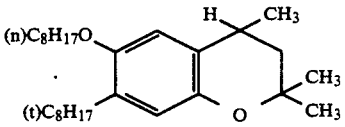
A-11
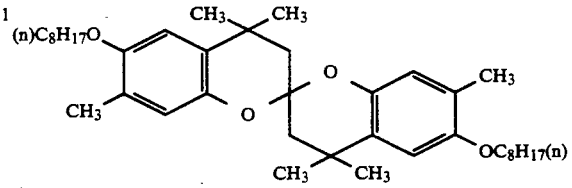
A-12
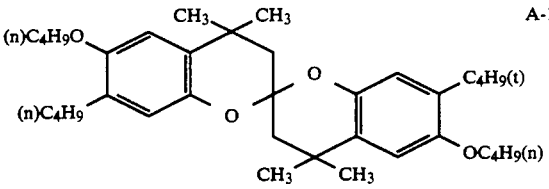
A-13
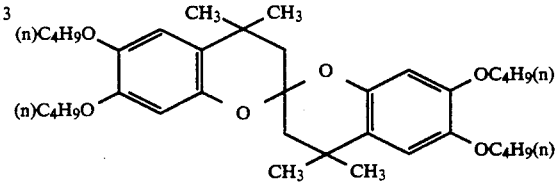
A-14
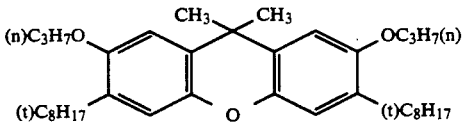
A-15
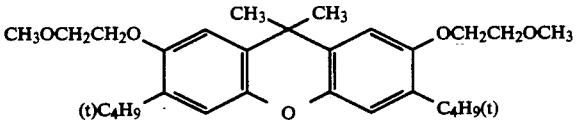
A-16
A-17
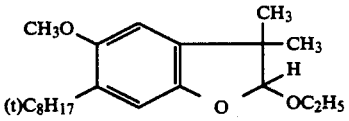
A-18
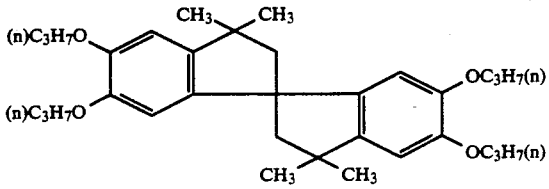

-continued
A-19
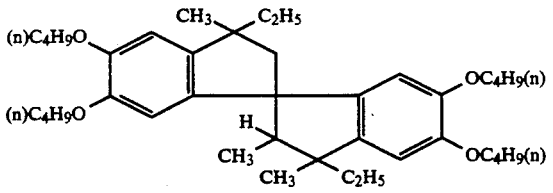
A-20
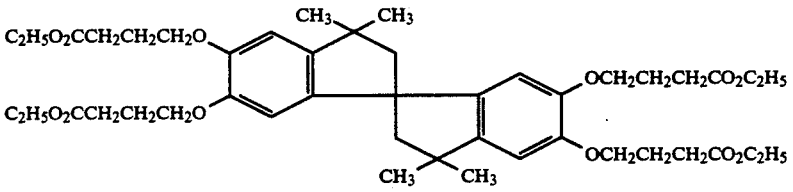
A-21
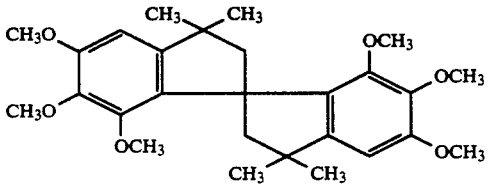
A-22
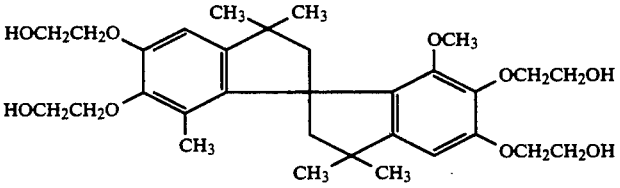
A-23
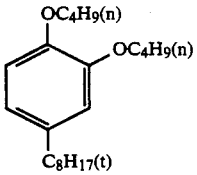
A-24
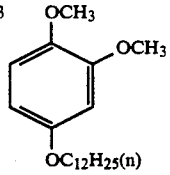
A-25
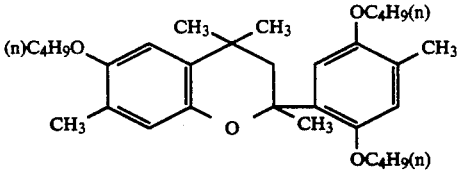
A-26
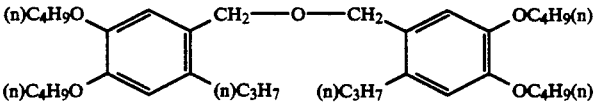
A-27
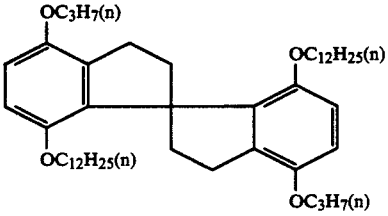
A-28
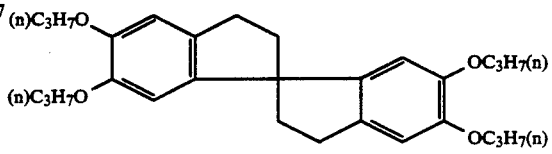

-continued
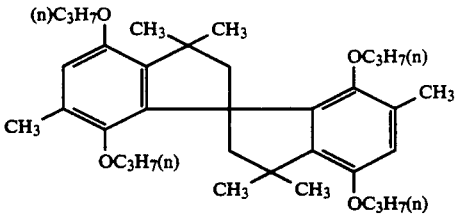
A-29
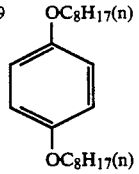
A-30
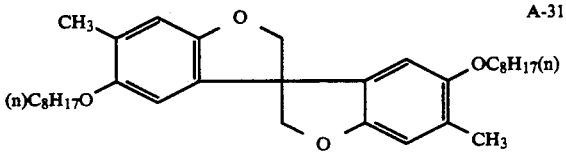
A-31
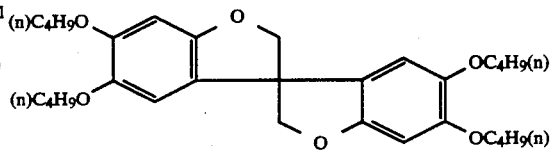
A-32
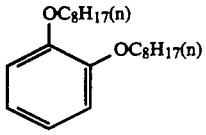
A-33
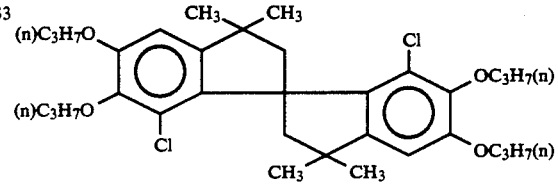
A-34
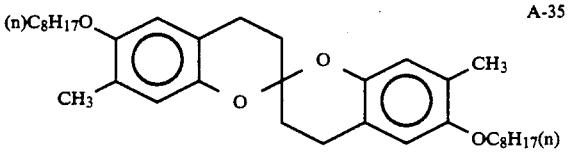
A-35
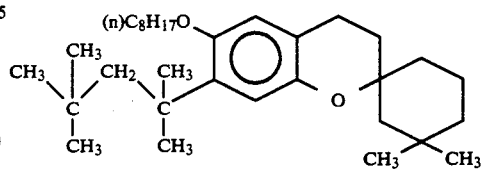
A-36
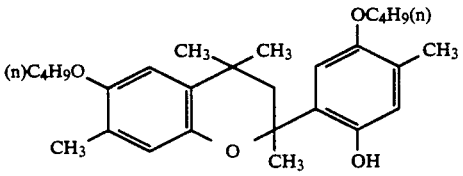
A-37
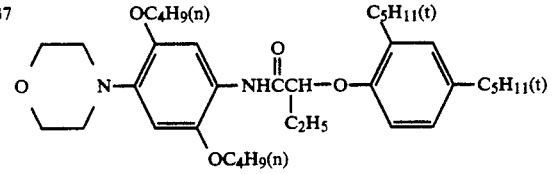
A-38
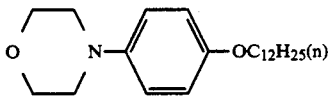
A-39
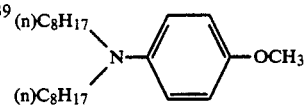
A-40
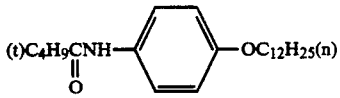
A-41
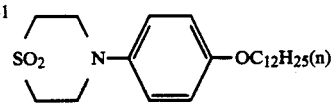
A-42
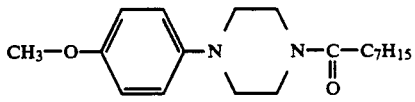
A-43
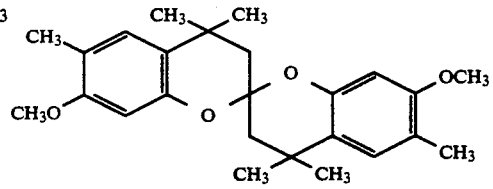
A-44
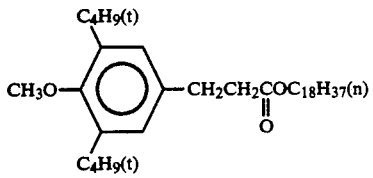
A-45
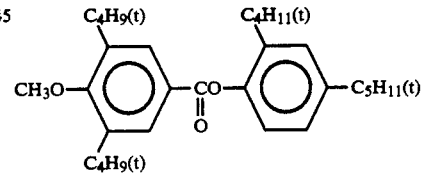
A-46

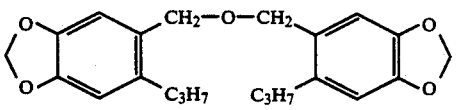

-continued

A-47

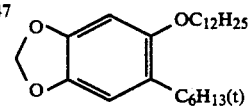

A-48

The compounds of the formula (III) to be used in the present invention are produced by or in accordance with the methods described in JP B-45-14034, JP-B-56-24257 and JP-B-59-52421, and JP-A-55-89835, JP-A-56-159644, JP-A-62-244045, JP-A-62-244046, JP-A-62-273531, JP-A-63-220142, JP A-63-95439, JP-A-63-95448, and JP-A-63-95450, and European Patent 0,239,972.

The amount of the compound of the formula (III) to be added to the emulsion layer of the photographic material of the present invention is from 5 to 400 mol%, preferably from 5 to 200 mol%, of the coupler contained in the layer.

Although the coupler of the formula (I) and the compounds of the formulae (II) and (III) may be dispersed in a hydrophilic colloid layer without using any of the high boiling point organic solvents which will be described below, use of high boiling point organic solvents is recommended in view of the effect of the present invention. In this case, a known method, for example, as described in U.S. Pat. No. 2,322,027, is generally employed for the purpose of introducing the coupler and the compounds into the silver halide emulsion layer of the photographic material of the present invention.

The silver halide color photographic material of the present invention, which contains the coupler of the formula (I) and the compounds of the formulae (II) and (III), is hardly subject to fogging and shows an excellent and improved light-fastness. In particular, the light-fastness of the magenta image in the low density range formed in the material is greatly improved, and this effect could not be anticipated from the prior art technique. By the combination of a coupler of the formula (I) and the compounds of the formulae (II) and (III), the objects of the present invention can be attained.

In addition to the combination of the coupler of the formula (I) and the compounds of the formulae (II) and (III), compounds of the following formulae (V) and (VI) are preferably added to the photographic material of the present invention, whereby the storage stability of the resulting material is further improved. Accordingly, addition of these compounds of the formulae (V) and (VI) to the combination of the formulae (I), (II) and (III) is preferred.

Additionally, the compounds of the formulae (V) and (VI) may also be employed together with the yellow couplers or cyan couplers which will be described below.

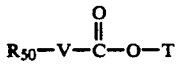

(V)

$$T-SO_2M \qquad (VI)$$

In these formulae, $R_{50}$ represents an alkyl group, an alkenyl group, an aryl group or a heterocyclic group; V represents —O— or a single chemical bond; T represents an aryl group or a heterocyclic group; and M represents a hydrogen atom, or an atomic group capable of forming an organic or inorganic salt.

Compounds of the formulae (V) and (VI) are explained in more detail below. $R_{50}$ in the formula (V) represents an alkyl group (e.g., methyl, ethyl, 2-ethylhexyl, hexadecyl, 2,4-di-t-phenoxyethyl), an alkenyl group (e.g., vinyl, allyl), an aryl group (e.g., phenyl, p-methoxyphenyl), or a heterocyclic group (e.g., 3-pyridyl, 4-pyridyl). Preferably, $R_{60}$ is an alkyl group. T represents an aryl group (e.g., phenyl, 2,6-dichlorophenyl, 2,6-dichloro-4-ethoxycarbonylphenyl, 3,5-di-2-ethylhexylcarbamoylphenyl), or a heterocyclic group (e.g., 2-pyridyl, 3-(1-phenyl-2-pyrazolyl), 3-(1-phenyl-4-dimethyl-2-pyrazolyl). Preferably, T is an aryl group. M represents a hydrogen atom, or an atomic group capable of forming an inorganic salt (e.g., lithium salt, sodium salt, potassium salt) or an organic salt (e.g., tetraethylamine salt, ammonium salt). Preferably, M is an atomic group capable of forming an inorganic salt.

Specific examples of the compounds of the formulae (V) and (VI) which may be employed in the present invention are shown below, but these are not intended to restrict the scope of the present invention.

(V-1)

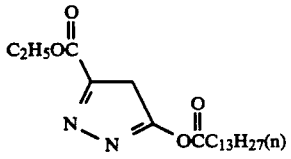

(V-2)

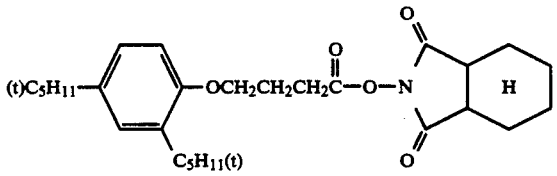

(V-3)

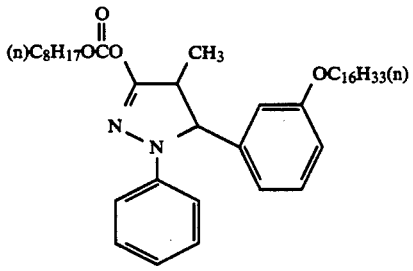

(V-4)

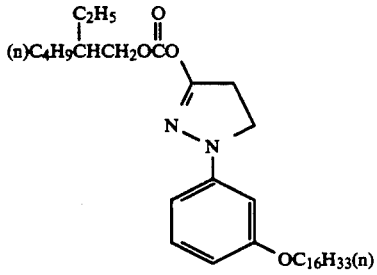

-continued
(V-5)
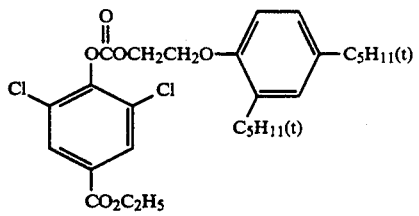
(V-6)
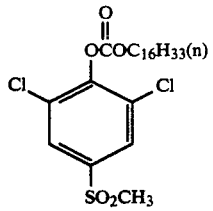
(V-7)
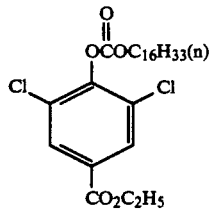
(V-8)
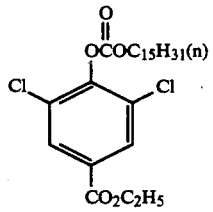
(V-9)
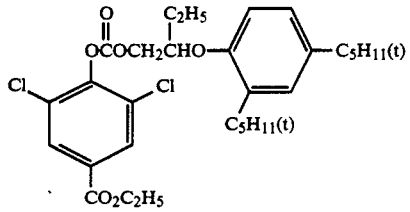
(V-10)
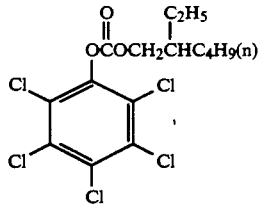
(V-11)
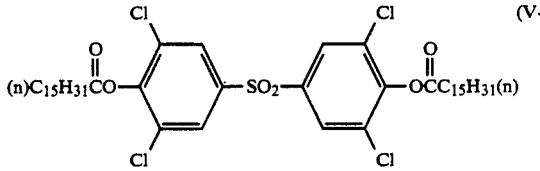
(V-12)
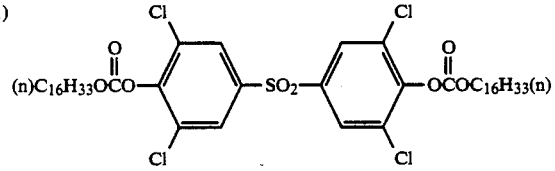
(V-13)
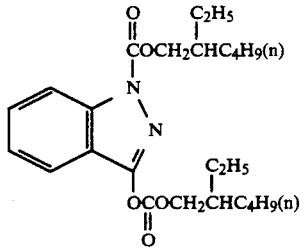
(VI-1)
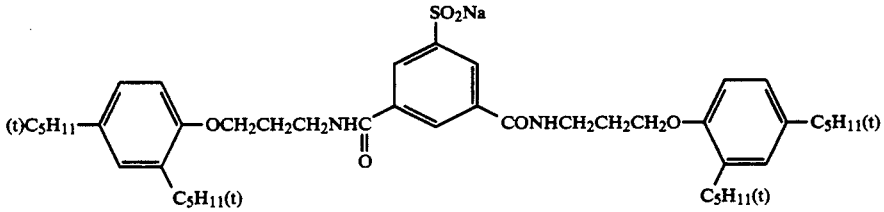
(VI-2)
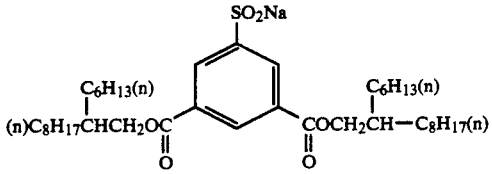

-continued
(VI-3)
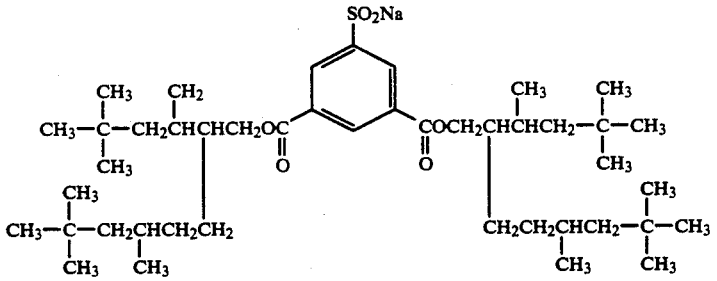
(VI-4)
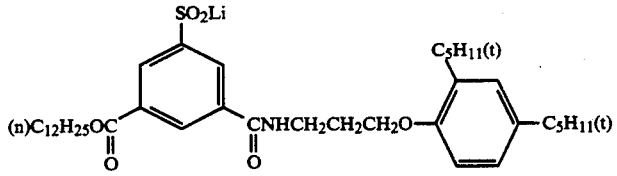
(VI-5)
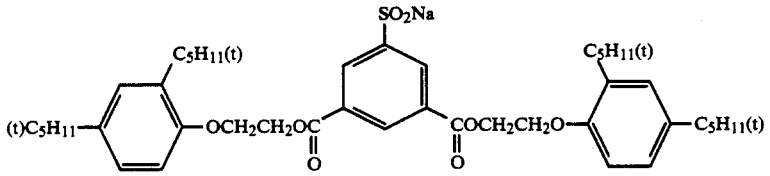
(VI-6)
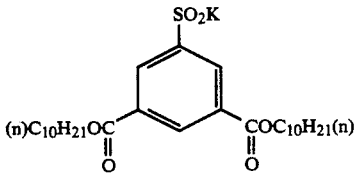
(VI-7)
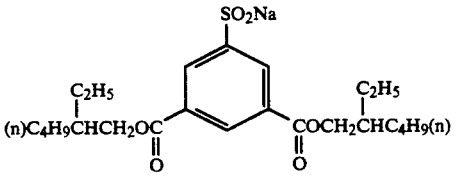
(VI-8)
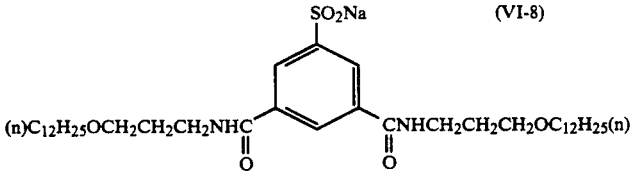
(VI-9)
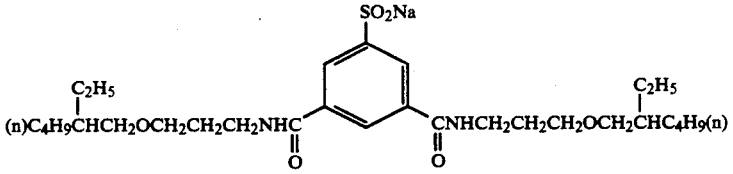
(VI-10)
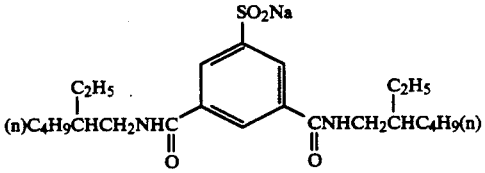
(VI-11)
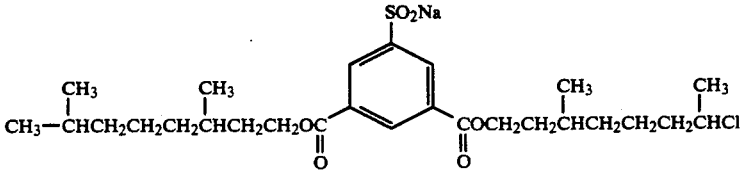

-continued (VI-12)

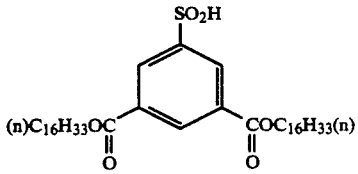

(VI-13)

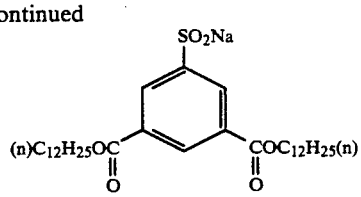

(VI-14)

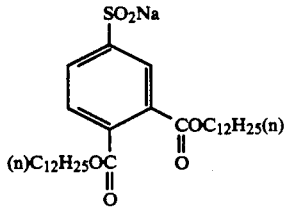

(VI-15)

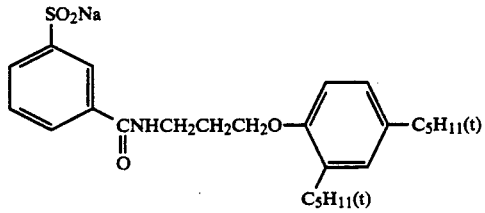

(VI-16)

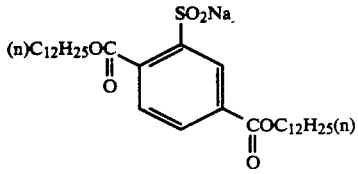

(VI-17)

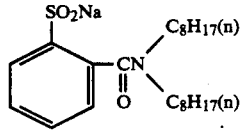

(VI-18)

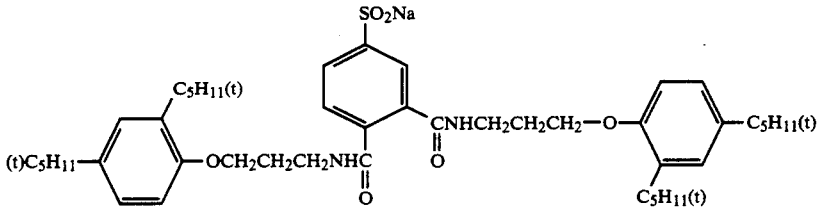

(VI-19)

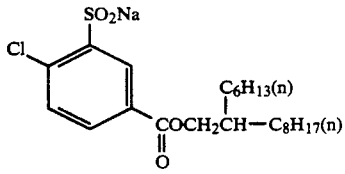

(VI-20)

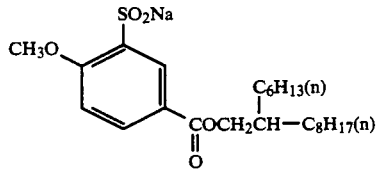

(VI-21)

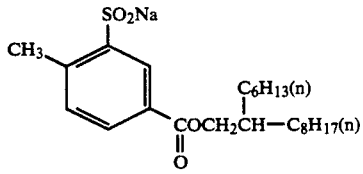

(VI-22)

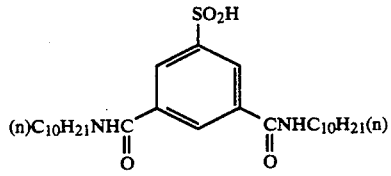

Compounds of the formulae (V) and (VI) can be produced by or in accordance with the methods described in, for example, JP-A-62-283338, JP-A-63-115866, JP-A-3-115855 and European Patent 255,722.

The compounds of the formulae (V) and (VI) may be employed singly or in combination. The amount of the compound(s) to be added is from 1 to 200 mol%, preferably from 5 to 50 mol%, of the coupler.

The color photographic material of the present invention is prepared by coating at least one blue-sensitive silver halide emulsion layer, at least one green-sensitive silver halide emulsion layer and at least one red-sensitive silver halide emulsion layer on a support. An ordinary color photographic paper generally has the light-sensitive emulsion layers coated on the support in the order as mentioned above. However, the layers may be coated on the support in any order other than that mentioned above. Additionally, an infrared-sensitive silver halide emulsion layer may be employed in place of at least one of the above-mentioned emulsion layers. Each of these light-sensitive emulsion layers contains a silver halide emulsion having a sensitivity in the determined wavelength range and a so-called color coupler capable of forming a dye which is complementary to the color of the sensitive light, or that is, yellow to blue, magenta to green, and cyan to red, whereby the respective layers may reproduce the intended colors by subtractive color photography. However, the combination of the light-sensitive layer and the coloring hue of the coupler therein is not limited to only the above-mentioned constitutions.

The silver halide emulsion for use in the present invention preferably comprises silver chlorobromide or silver chloride which is substantially free from silver iodide. The silver halide which is substantially free from silver iodide as referred to herein means that the silver iodide content in the halide is 1 mol% or less, preferably 0.2 mol% or less. The halogen composition of the silver halide grains in the emulsion may differ from grain to grain or may be the same in all grains. Employment of an emulsion where the halogen composition is same in the silver halide grains therein promotes uniformity of the properties of the respective grains in the emulsion. Regarding the halogen composition distribution in the inside of the respective silver halide emulsion grains, so-called uniform structural grains where the halogen composition is same in every portion of the silver halide grains, or so-called laminate structural grains where the halogen compositions differ from each other between the core of the inside of the silver halide grain and the shell surrounding the core (the shell being composed of one layer or plural layers), or composite structural grains which have different non-layered halogen composition portions in the inside or surface of the grain (where such different non-layered halogen composition portions are on the surface of the grain, the different composition portions are conjugated on the edges, corners or faces thereof) may properly be selected for use in the present invention. The latter two grains (i.e., laminate grains and composite grains) are preferred over uniform structural grains for the purpose of obtaining a higher sensitivity and also in view of their higher pressure-resistance. Where the silver halide grains for use in the present invention have any one of the above-mentioned structures, the boundary between the portions each having a different halogen composition may be either a definite boundary or an indefinite boundary to form a mixed crystal because of the difference in the halogen compositions. Additionally, the boundary therebetween may have a positive continuous structure variation in the halogen compositions.

The halogen composition of the silver chlorobromide emulsion of the present invention may have any desired ratio of silver bromide to silver chloride. The ratio may be varied widely in accordance with the objects of the invention, but the proportion of silver chloride in the emulsion is preferably 2% or more.

A so-called high silver chloride emulsion having a high silver chloride content which is especially suitable for high-speed processing is preferably used in the photographic material. The silver chloride content in the high silver chloride emulsion is preferably 9 mol% or more, especially preferably 95 mol% or more.

In the high silver chloride emulsion as mentioned above, the grains preferably have a silver bromide-localized phase structure where a silver bromide-localized phase is in the inside and/or on the surface of the silver halide grain in the form of a layer or non-layer as mentioned above. The halogen composition in the localized phase preferably has at least 10 mol% silver bromide content, more preferably more than 20 mol% thereof. The localized phase may be in the inside of the grain or on th edges, corners or faces of the surface of the grain. As one preferred embodiment, the phase may grow on the corners of the grain as epitaxial growth.

On the other hand, for the purpose of suppressing the effect of decreased sensitivity which occures when the photographic material has been subjected to pressure, the high silver chloride grains having a silver chloride content of 90 mol% or more preferably have a uniform structure having a narrow halogen composition distribution therein.

For the purpose of reducing the amount of developer replenisher to be used for processing the photographic material, further elevation of the silver chloride content in the silver halide emulsion is effective. In such case, an emulsion comprising almost pure silver chloride grains having a silver chloride content of from 98 mol% to 100 mol% may preferably be employed.

The mean grain size of the silver halide grains contained in the silver halide emulsion for use in the present invention is preferably from 0.1 micron to 2 microns. (The grain size corresponds to the diameter of a circle having the same projection area of the grain, and the mean grain size corresponds to the number average value of the respective grain sizes).

Regarding the grain size distribution, a so-called monodispersed emulsion is preferred, which has a fluctuation coefficient (obtained by dividing the standard deviation of the grain size distribution by the mean grain size) of 20% or less, preferably 15% or less. In the photographic material of the present invention, it is also preferred that different monodispersed emulsions be blended and incorporated into one layer or incorporated into different layers to be laminated, for the purpose of obtaining a broad photographic latitude.

The silver halide grains in the photographic emulsion may be those having a regular crystalline form such as cubic, octahedral or tetradecahedral crystalline form, or those having an irregular crystalline form such as spherical or tabular crystalline form, or those having a composite form of such various crystal forms. Additionally, the emulsion may contain various grains having different crystalline forms. In the present invention, it is preferred that the content of the above-mentioned regular crystalline grains in the emulsion be 50 wt% or more, more preferably 70 wt% or more, and especially preferably 90 wt% or more.

Additionally, an emulsion containing tabular grains having a mean aspect ratio (ratio of circle-corresponding diameter to thickness) of 5 or more, preferably 8 or more, in a proportion of more than 50% of the total grains as the projected area is also preferably employed in the present invention.

The silver chlorobromide emulsion for use in the present invention can be prepared by the methods described in P. Glafkides, *Chimie et Phisigue Photographique* (published by Paul Montel Co. in 1967), G. F. Duffin, *Photographic Emulsion Chemistry* (published by Focal Press Co. in 1966) and V. L. Zelikman et al, *Making and Coating Photographic Emulsions* (published by Focal Press Co. in 1964). Precisely, it may be prepared by any of the acid method, the neutral method, or the ammonia method. Where it is prepared in a system in which a soluble silver salt and soluble halides are reacted, any of the single jet method, the double jet method, and combinations thereof may be employed. A so-called in an atmosphere of excess silver ions may also be employed. As one system of the double jet method, the so-called controlled double jet method where the pAg value in the liquid phase where the silver halide grains are formed is held constant may also be employed. According to this method, silver halide grains having regular crystalline forms and nearly uniform grain sizes can be obtained.

Various polyvalent metal ion impurities may be introduced into the silver halide emulsion for use in the present invention, in the step of forming the grains or during physical ripening thereof. Examples of the compounds usable for this purpose include salts of cadmium, zinc, lead, copper or thallium, as well as salts or complex salts of elements of Group VIII, such as iron, ruthenium, rhodium, palladium, osmium, iridium or platinum. In particular, the elements of Group VIIII are preferably employed. The amount of the compound to be added to the emulsion may vary widely in accordance with the objects of the invention, and it is preferably from $10^{-9}$ to $10^{-2}$ mol per mol of the silver halide in the emulsion.

The silver halide emulsion for use in the present invention is generally chemically sensitized or color sensitized.

For chemical sensitization of the emulsion, sulfur sensitization (typically by addition of an unstable sulfur compound to the emulsion), noble metal sensitization such as gold sensitization, and reduction sensitization can be employed singly or in combination. The compounds preferably usable in such chemical sensitization are described in JP-A-62-215272, from page 18, right-lower column to page 22, right-upper column.

Color sensitization (spectral sensitization) is effected for the purpose of imparting color sensitivity in the desired light wavelength range to the emulsions of the respective layers of the photographic material of the present invention. In accordance with the present invention, such color sensitization is preferably effected by adding a dye (color-sensitizing dye) which absorbs the light with a wavelength range corresponding to the intended spectral sensitivity (color sensitivity) to the photographic emulsion. As examples of color-sensitizing dyes usable for this purpose, reference may be had to the compounds described in F. M. Harmer, *Heterocyclic Compounds—Cyanine Dyes and Related Compounds* (published by John & Sons Co. of New York, London, in 1964). Specific examples of such compounds are described in the above-mentioned JP-A-62-215272, from page 22, right-upper column to page 38, and these are preferably employed in the present invention.

The silver halide emulsion for use in the present invention can contain various compounds or precursors thereof for the purpose of preventing fogging during manufacture, storage, or processing of the photographic materials, or for the purpose of the stabilizing the photographic properies of the materials. Specific examples of the compounds which are preferably used for these purposes are described in the above-mentioned JP-A-62-215272, pages 39 to 72.

The emulsion for use in the present invention may be either a so-called surface latent image type emulsion which forms a latent image essentially on the surfaces of the grains of a so-called internal latent image type emulsion which forms the image essentially in the insides of the grains.

The color photographic material of the present invention generally contains one or more yellow couplers, one or more magenta couplers, and one or more cyan couplers which may couple with the oxidation product of an aromatic amine color-developing agent to form yellow, magenta and cyan colors, respectively.

Cyan couplers, magenta couplers and yellow couplers which are preferably used in the color photographic material of the present invention are those represented by the following general formulae (C-I) (C-II), (M-I) and (Y).

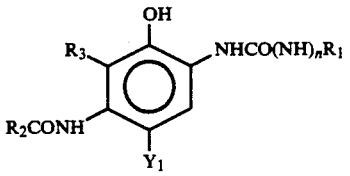

(C-I)

-continued

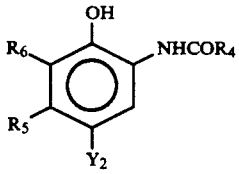

(C-II)

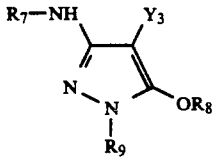

(M-I)

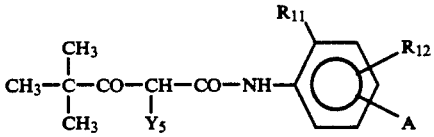

(Y)

In the formulae (C-I) and (C-II), $R_1$, $R_2$ and $R_4$ each represents a substituted or unsubstituted aliphatic, aromatic or heterocyclic group; $R_3$, $R_5$ and $R_6$ each represents a hydrogen atom, a halogen atom, an aliphatic group, an aromatic group or an acylamino group; $R_3$ and $R_2$ may together form a non-metallic atomic group to form a nitrogen-containing 5-membered or 6-membered ring; $Y_1$ and Yeach represents a hydrogen atom or a group released by a coupling reaction with an oxidation product of a developing agent; and a represents 0 or 1.

In the formula (C-II), $R_3$ is preferably an aliphatic group, for example, methyl, ethyl, propyl, butyl, pentadecyl, tert-butyl, cyclohexyl, cyclohexylmethyl, phenylthiomethyl, dodecyloxyphenylthiomethyl, butanamidomethyl or methoxymethyl.

Preferred examples of cyan couplers represented by the above-mentioned formula (C-I) or (C-III) are shown below.

In the formula (C-I), $R_1$ is preferably an aryl group or a heterocyclic group, and it is more preferably an aryl group substituted by one or more substituents selected from a halogen atom, an alkyl group, an alkoxy group, an aryloxy group, an acylamino group, an acyl group, a carbamoyl group, a sulfonamido group, a sulfamoyl group, a sulfonyl group, a sulfamido group, an oxycarbonyl group and a cyano group.

In the formula (C-I) where $R_3$ and $R_2$ do not form a ring, $R_2$ is preferably a substituted or unsubstituted alkyl group or aryl group and it is especially preferably a substituted aryloxy-substituted alkyl group; and $R_3$ is preferably a hydrogen atom.

In the formula (C-II), $R_4$ is a preferably a substituted or unsubstituted alkyl group or aryl group and it is more preferably a substituted aryloxy-substituted alkyl group.

In the formula (C-II), $R_5$ is preferably an alkyl group having from 2 to 15 carbon atoms, or a methyl group substituted by one or more substituents each having one or more carbon atoms. The substituent(s) on the methyl group are preferably selected from an arylthio group, an alkylthio group, an acylamino group, an aryloxy group and an alkoxy group.

In the formula (C-II), $R_5$ is more preferably an alkyl group having from 2 to 15 carbon atoms and is especially preferably an alkyl group having from 2 to 4 carbon atoms.

In the formula (C-II), $R_6$ is preferably a hydrogen atom or a halogen atom and it is especially preferably a chlorine atom or a fluorine atom. In the formulae (C-I) and (C-II), $Y_1$ and $Y_2$ each are preferably a hydrogen atom, a halogen atom, an alkoxy group, an aryloxy group, an acyloxy group or a sulfonamido group.

In the formula (M-I), $R_7$ and $R_9$ each represent an aryl group; $R_8$ represents a hydrogen atom, an aliphatic or aromatic acyl group, or an aliphatic or aromatic sulfonyl group; and $Y_3$ represents a hydrogen atom or a leaving group. The aryl group represented by $R_7$ and $R_9$ is preferably a phenyl group and may be substituted. The substituents on the aryl group may be the same as those on $R_1$. Where the aryl group has two or more substituents, the plural substituents may be the same or different. $R_8$ is preferably a hydrogen atom, or an aliphatic acyl or aliphatic sulfonyl group, and it is especially preferably a hydrogen atom. $Y_3$ is preferably a group which leaves via any one of a sulfur atom, an oxygen atom and a nitrogen atom, and it is especially preferably a sulfur atom-leaving group, for example, one selected from those described in U.S. Pat. No. 4351,897 and International patent Application Laid-Open No. WO88/04795.

In the formula (Y), $R_{11}$ represents a halogen atom, an alkoxy group, a trifluoromethyl group or an aryl group; $R_{12}$ represents a hydrogen atom, a halogen atom or an alkoxy group; A represents —$NHCOR_{13}$, —$NHSO_2$—$R_{13}$, —$SO_2NHR_{13}$, —$COOR_{13}$, or $$-SO_2\underset{\underset{R_{14}}{|}}{N}-R_{13},$$

in which $R_{13}$ and $R_{14}$ each represents an alkyl group, an aryl group or an acyl group; and $Y_5$ represents a leaving group. $R_{12}$, $R_{13}$ and $R_{14}$ may optionally be substituted, and the substituents may be the same as those on $R_1$. The leaving group $Y_5$ is preferably such that it leaves via any one of an oxygen atom and a nitrogen atom and it is especially preferably a nitrogen atom-leaving group.

Specific examples of couplers of the formulae (C-I), (C-II), (M-I) and (Y) are shown below.

(C-1)

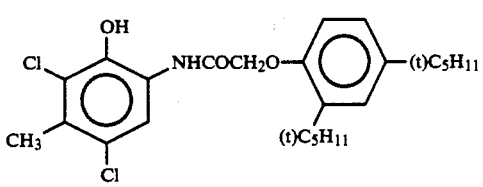

(C-2)

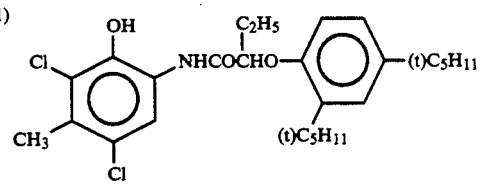

(C-3)

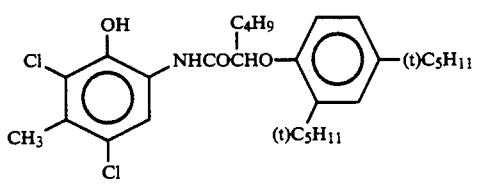

(C-4)

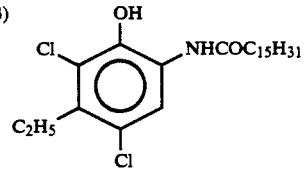

(C-5)

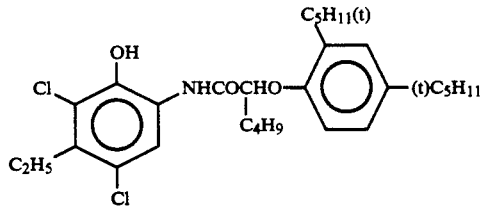

(C-6)

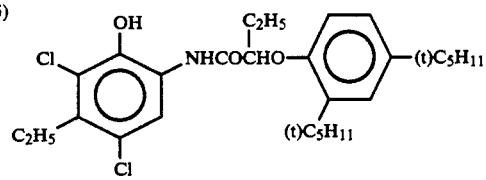

(C-7)

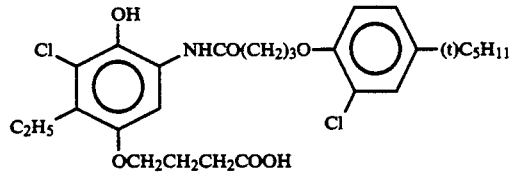

(C-8)

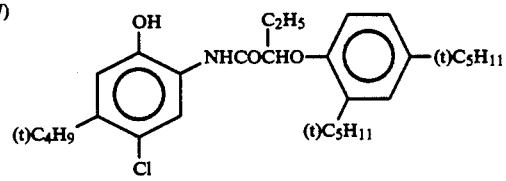

(C-9)

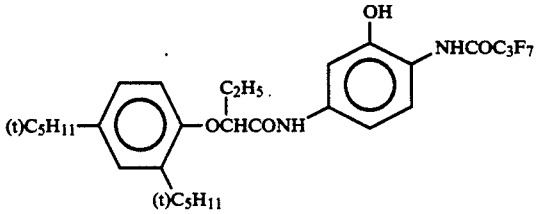

-continued
(C-10)
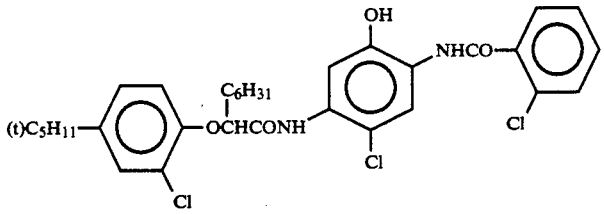
(C-11)
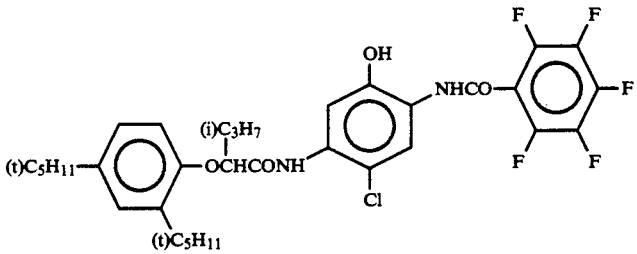
(C-12)
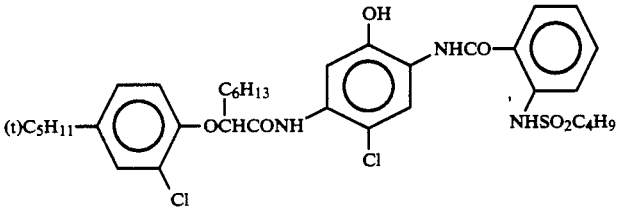
(C-13)
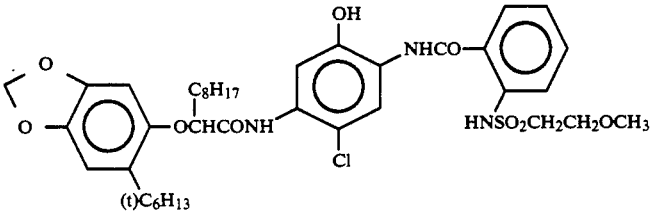
(C-14)
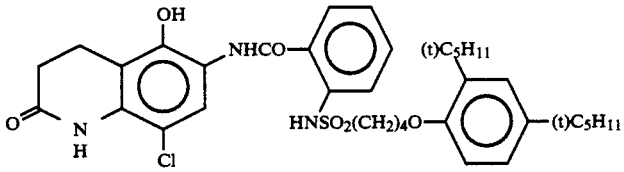
(C-16)
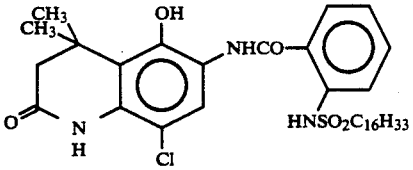
(C-15)
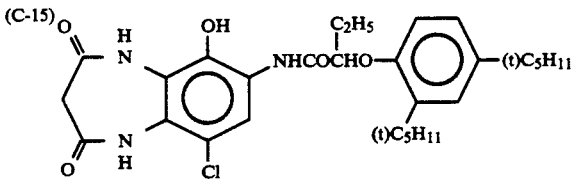
(C-17)
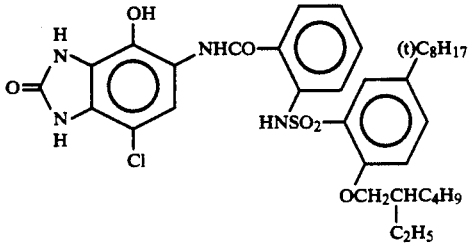

-continued
(C-18)
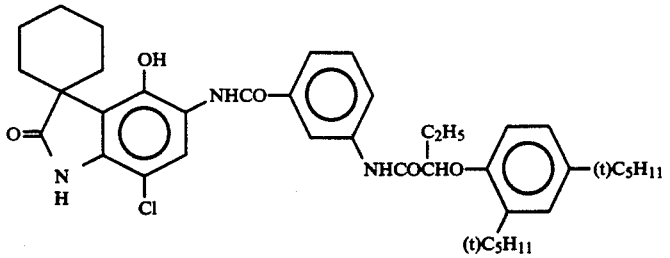
(C-19)
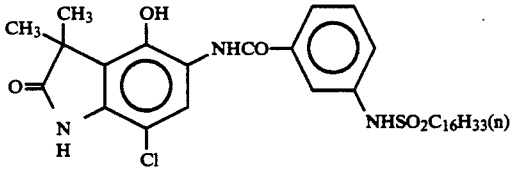
(C-20)
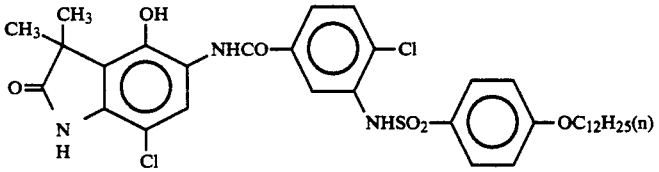
(C-21)
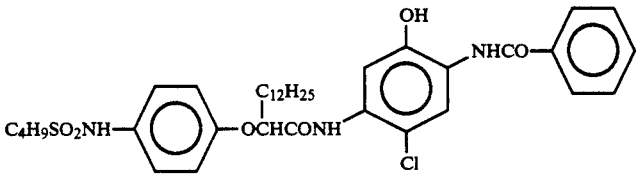
(C-22)
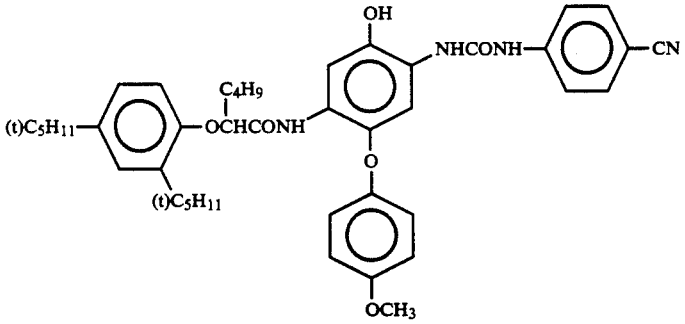
(M-1)
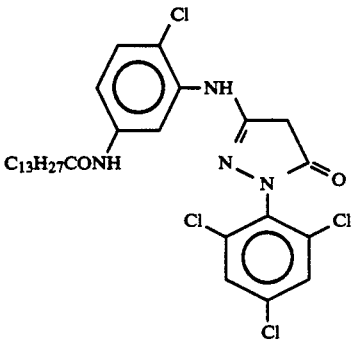
(M-2)
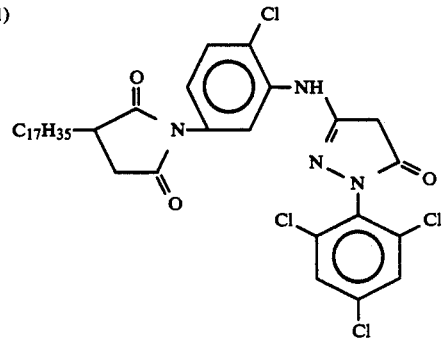

-continued
(M-3)
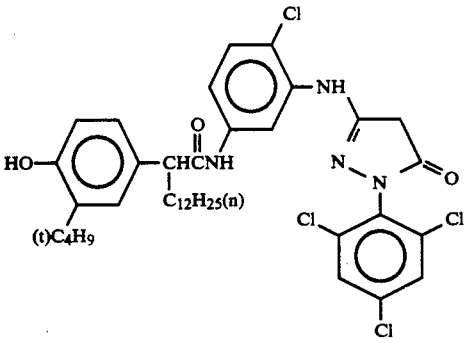
(M-4)
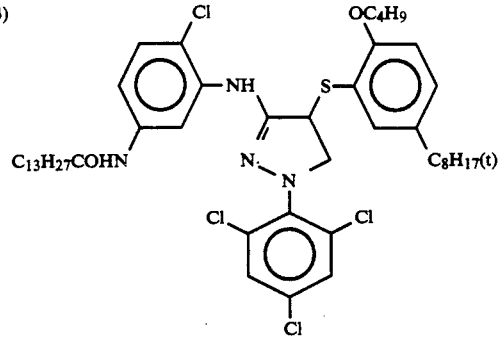
(M-5)
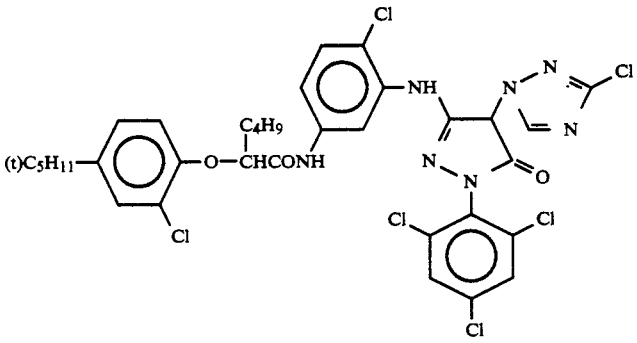
(M-6)
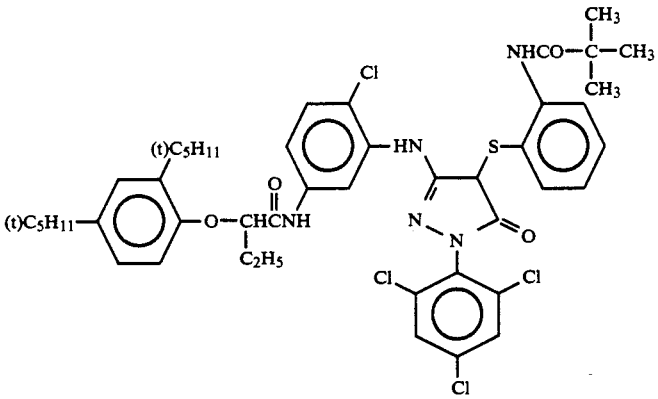
(M-7)
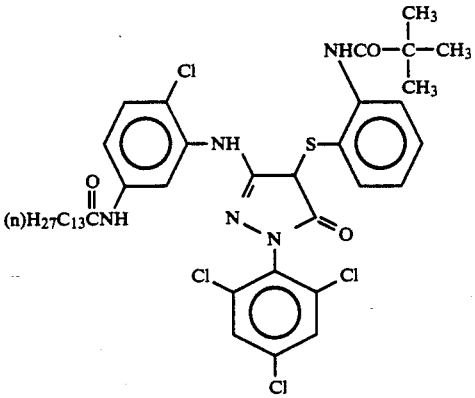

-continued
(M-8)
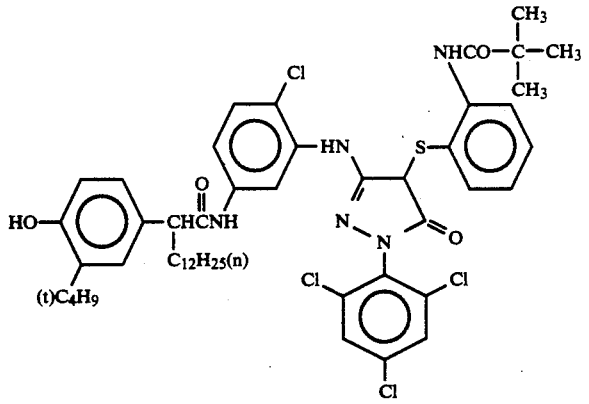
(Y-1)
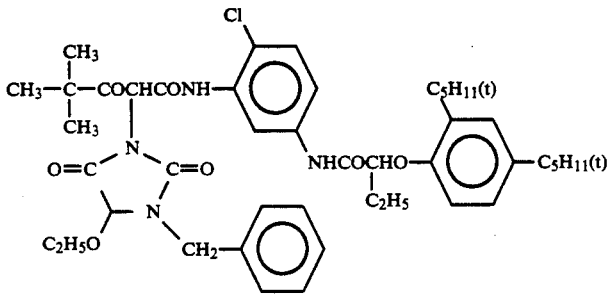
(Y-2)
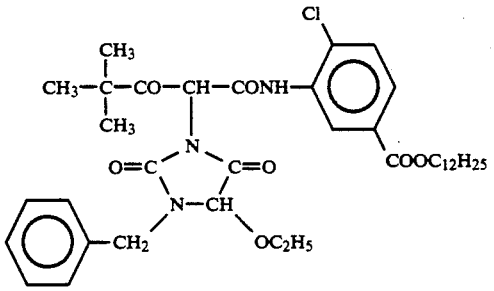
(Y-3)
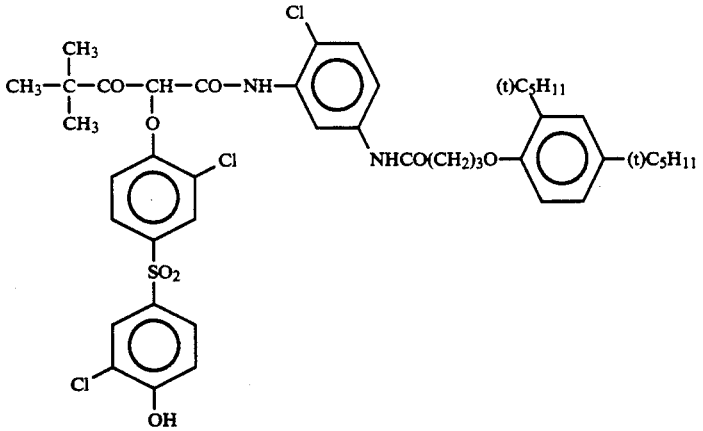
(Y-4)
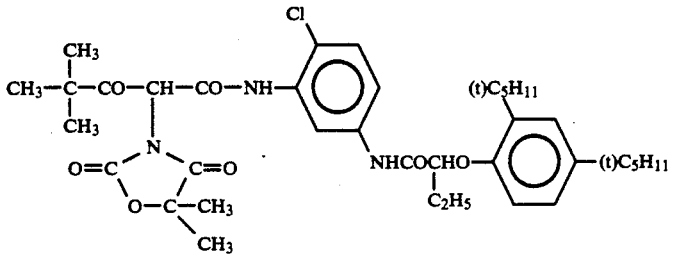

-continued (Y-5)

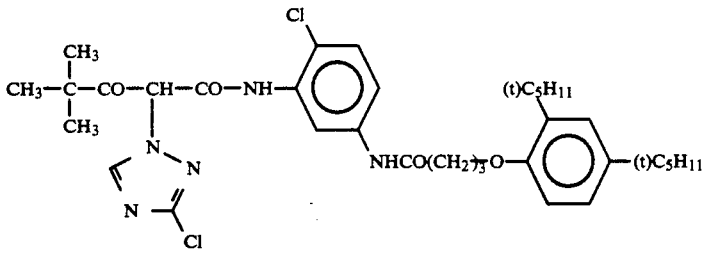

(Y-6)

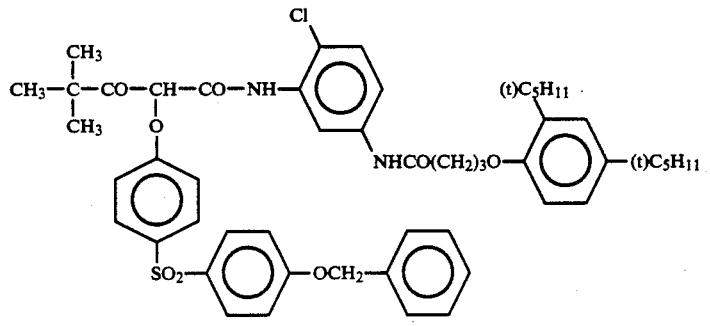

(Y-7)

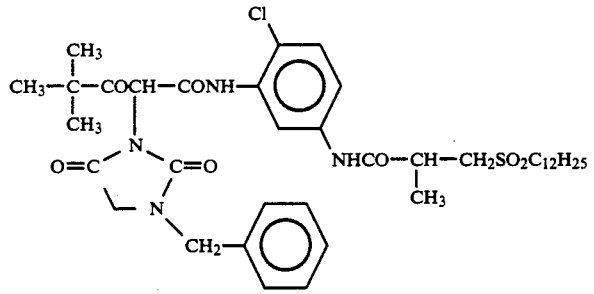

(Y-8)

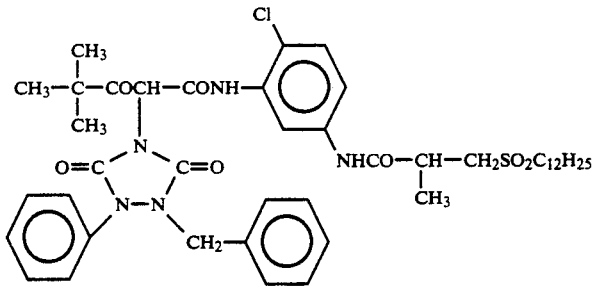

(Y-9)

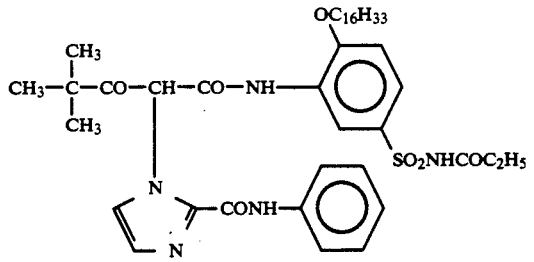

The coupler represented by any one of the above-mentioned formulae (C-I) through (Y) is added to the silver halide emulsion layer which constitutes the light-sensitive layer element of the photographic material of the present invention, generally in an amount of from 0.1 to 1.0 mol, and preferably from 0.1 to 0.5 mol, per mol of the silver halide in the layer.

In accordance with the present invention, various known techniques can be employed for the purpose of adding the above-mentioned couplers and the compounds of the formulae (II) and (III) to the light-sensitive layers. In general, an oil-in-water dispersion method which is known as an oil-protect method is employed for this purpose, wherein the coupler is dissolved in a solvent and the resulting solution is dispersed by emulsification in an aqueous gelatin solution containing a surfactant. Alternatively, water or an aqueous gelatin solution may be added to a coupler solution containing a surfactant to form an oil-in-water dispersion by phase conversion. Alkali-soluble couplers may also be dispersed by the so called Fisher dispersion method. The low boiling point organic solvent, if any, may be removed from the resulting coupler dispersion by distillation, noodle washing or ultrafiltration, and the dispersion may then be blended with the photographic emulsion.

As the dispersion medium for such couplers, a high boiling point organic solvent and/or a water-insoluble high polymer compound having a dielectric constant (at 25° C.) of from 2 to 20 and a refractive index (at 25° C.) of from 1.5 to 1.7 are preferably employed in the present invention.

As the high boiling point organic solvent, those represented by the following general formulae (A) to (E) can be used.

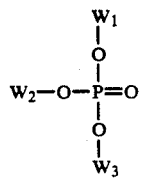
(A)

$W_1-COO-W_2$ (B)

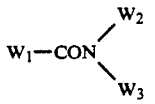
(C)

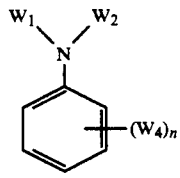
(D)

$W_1-O-W_2$ (E)

In these formulae, $W_1$, $W_2$ and $W_3$ each represents a substituted or unsubstituted alkyl, cycloalkyl, alkenyl, aryl or heterocyclic group, $W_4$ represents $W_1$, $OW_1$ or $SW_1$, n represents an integer of from 1 to 5; and when n is 2 or more, the plural $W_4$'s may be the same or different In the formula (E), $W_1$ and $W_2$ may together form a condensed ring.

In the present invention, any high boiling point organic solvents other than those of the above-mentioned formulae (A) to(E) may also be employed, provided that they are water-immiscible compounds having a melting point of 100° C. or lower and a boiling point of 140° C. or higher and they are good solvents for the couplers of the present invention. The high boiling point organic solvents to be employed in the present invention preferably have a melting point of 80° C. or lower and a boiling point of 160° C. or higher, more preferably 170° C. or higher.

The details of such high boiling point organic solvents are described in JP-A-62-215272, from page 137, right-lower column to page 144, right-upper column.

The couplers of the present invention may also be incorporated into a loadable latex polymer in the presence or absence of the above-mentioned high boiling point organic solvent (for example, as described in U.S. Pat. No. 4,203,716) or dissolved in a water-insoluble and organic solvent-soluble polymer and the resulting latex polymer or polymer may be dispersed by emulsification into the aqueous hydrophilic colloid solution.

Preferably, the homopolymers or copolymers described in International Patent Application Laid-Open No. WO 88/00723, pages 12 to 30 are used for the above-mentioned purpose, and employment of acrylamide polymers is especially preferred in view of stabilization of the images to be formed.

The photographic material of the present invention can contain hydroquinone derivatives, aminophenol derivatives, gallic acid derivatives or ascorbic acid derivatives as a color-fogging inhibitor.

The photographic material of the present invention can contain various anti-fading agents. As typical examples of organic anti-fading agents which can be used for protecting cyan, magenta and/or yellow images, there may be mentioned hindered phenols such as hydroquinones, 6-hydroxychromans, 5-hydroxycoumarans, spirochromans, p-alkoxyphenols or bisphenols, as well as gallic acid derivatives, methylenedioxybenzenes, aminophenols and hindered amines and additionally ether or ester derivatives thereof formed by silylating or alkylating the phenolic hydroxyl group of the compounds. Further, metal complexes such as (bissalicylaldoximato)nickel complexes and (bis-N,N-dialkyldithiocarbamato)nickel complexes can also be used.

Specific examples of the organic anti-fading agents usable in the present invention are described in the following patent specifications.

Precisely, hydroquinones are described in U.S. Pat. Nos. 2,360,290, 2,418,613, 2,700,453, 2,701,197, 2,728,659, 2,732,300, 2,735,765, 3,982,944, 4,430,425, British Patent 1,363,921 and U.S. Pat. Nos. 2,710,801, 2,816,028; 6-hydroxychromans, 5-hydroxycoumarans and spirochromans are described in U.S. Pat. Nos. 3,432,300, 3,573,050, 3,574,627, 3,698,909, 3,764,337 and JP-A-52-152225; spiroindanes are described in U.S. Pat. No. 4,360,589; p-alkoxyphenols are described in U.S. Pat. No. 2,735,765, British Patent 2,066,975, JP A-59-10539 and JP-B-57-19765; hindered phenols are described in U.S. Pat. No. 3,700,455, JP-A-52-72224, U.S. Pat. No. 4,228,235 and JP-B-52-6623; gallic acid derivatives, methylenedioxybenzenes and aminophenols are described in U.S. Pat. Nos. 3,457,079, 4,332,886 and JP-B-56-21144; hindered amines are described in U.S. Pat. Nos. 3,336,135, 4,268,593, British Patents 1,326,889, 1,354,313, 1,410,846, JP-B-51-1420, JP-A-58-114036, JP-A-59-53846 and JP-A-59-78344; and metal complexes are described in U.S. Pat. Nos. 4,050,938, 4,241,155 and British Patent 2,027,731(A). These compounds may be added to the light-sensitive layer in an amount of, generally, from 5 to 100% by weight of the corresponding coupler, by co-emulsifying the compound along with the coupler, whereby the intended object can be attained In order to prevent the cyan color image from being deteriorated by heat and especially by light, it is more effective to add an ultraviolet absorbent to the cyan-coloring layer and both adjacent layers.

As ultraviolet absorbents usable for this purpose, there may be mentioned, for example, aryl group-substituted benzotriazole compounds (for example, those described in U.S. Pat. No. 3,533,794), 4-thiazolidone compounds (for example, those described in U.S. Pat. Nos. 3,314,794 and 3,353,681), benzophenone compounds (for example, those described in JP-A-46-2784), cinnamic acid ester compounds (for example, those described in U.S. Pat. Nos. 3,705,805 and 3,707,395), butadiene compounds (for example, those described in U.S. Pat. No. 4,045,229), and benzoxidol compounds (for example, those described in U.S. Pat. Nos. 3,406,070, 3,677,672 and 4,271,307). Additionally, ultraviolet-absorbing couplers (for example, cyan color-forming alpha-naphthol couplers) or ultraviolet-absorbing polymers may also be employed. Such ultraviolet absorbents may be mordanted in particular layers of the photographic material of the invention.

Above all, the above-mentioned aryl group-substituted benzotriazole compounds are preferred.

The photographic material of the present invention can contain in the hydrophilic colloid layers water-soluble dyes or dyes which may become water-soluble by photographic processing as a filter dye or for the purpose of anti-irradiation or anti-halation or for various other purposes Such dyes include, for example, oxonole dyes, hemioxonole dyes, styryl dyes, merocyanine dyes,,cyanine dyes and azo dyes. Above all, oxonole dyes, hemioxonoles dyes and merocyanine dyes are preferred.

As the binder or protective colloid which can be used in the emulsion layer of the photographic material of the present invention, gelatin is advantageously used. However, any other hydrophilic colloid may also be employed singly or in combination with gelatin.

The gelatin to be used in the present invention may be either lime-processed or acid-processed. The details of the preparation of such gelatins are described in Arther Vais, *The Macromolecular Chemistry of Gelatin* (published by Academic Press in 1964).

As the support for use in the present invention, there are mentioned a transparent film such as cellulose nitrate film or polyethylene terephthalate film and a reflective support which are generally employed in ordinary photographic materials. Employment of the latter reflective support is preferred in the present invention in view of the object thereof.

The reflective support which can be employed in the present invention is preferably one which may improve the reflectivity of the support so that the color image as formed on the silver halide emulsion layer is made sharp. Such reflective support includes a support prepared by coating a hydrophobic resin which contains a dispersion of a light-reflecting substance such as titanium oxide, zinc oxide, calcium carbonate or calcium sulfate on a support base or a support made of a hydrophobic resin which contains a dispersion of the said light-reflecting substance. For instance, there are mentioned a baryta paper, a polyethylene-coated paper, a synthetic polypropylene paper, as well as a transparent support (e.g., glass sheet, polyester films such as polyethylene terephthalate, cellulose triacetate or cellulose nitrate, or polyamide films, polycarbonate films, polystyrene films or vinyl chloride resin films) coated with a reflective layer or containing a reflecting substance.

In addition, supports having a metal surface with mirror reflectivity or secondary diffusion-reflectivity may also be employed as the reflective support in preparing the photographic materials of the present invention. The metal surface is preferably one having a spectral reflectivity of 0.5 or more in the wavelength range of visible light, and it is also preferred to roughen the metal surface or to impart a diffusion reflectivity thereto by the use of a metal powder. Such metal may be selected from aluminium, tin, silver, magnesium and alloys thereof. The surface may be that of a metal sheet, metal foil or thin metal layer prepared by rolling, vacuum evaporation, or plating. Above all, the metal surface is preferably prepared over a substrate of a different material by vacuum evaporation. Provision of a water-resistant resin, especially a thermoplastic resin layer, over the metal surface is preferred. The support having the above-mentioned metal surface, which is used in the present invention, preferably has an antistatic layer on the other surface opposite to the metal surface. The details of such supports are described, for example, in JP-A-61-210346, JP-A-63-24247, JP-A-63-24251 and JP-A-63-24255.

The supports may prpoerly be selected in accordance with the object and intended used thereof.

As the above-mentioned light-reflecting substance, it is preferred that a white pigment be fully kneaded in the presence of a surfactant. Alternatively, pigment grains surface-treated with a 2- or 4-valent alcohol may also preferably be employed.

Where fine grains of a white pigment are incorporated into the support, the occupied area ratio (%) of the grains per unit area typically is obtained by dividing the observed area into the adjacent unit area of 6 $\mu m \times 6$ $\mu m$ and measuring the exclusive area ratio (%) (Ri) of the fine grains as projected on the unit area. The fluctuation coefficient of the occupied area ratio (%) can be obtained as the ratio $s/\overline{R}$ of being the standard deviation (s) of Ri to the mean value ($\overline{R}$) of Ri. The number (n) of the unit areas for the measurement is preferably 6 or more. Accordingly, the fluctuation coefficient $s/\overline{R}$ can be obtained from the following formula:

$$\sqrt{\frac{\sum_{i=1}^{n} (Ri - R)^2}{n-1}} \Big/ \frac{\sum_{i=1}^{n} Ri}{n}$$

In accordance with the present invention, the fluctuation coefficient of the occupied area ratio (%) of the fine pigment grains is preferably 0.15 or less, especially preferably 0.12 or less. If it is 0.08 or less, it can be said that the dispersibility of the grains is substantially "uniform".

The color developer for use in development of the photographic materials of the present invention is preferably an aqueous alkaline solution consisting essentially of an aromatic primary amine developing agent. As the color developing agent for the developer, p-phenylenediamine compounds are preferably used, although aminophenol compounds are useful also. Specific examples of the compounds include 3-methyl-4-amino-N,N-diethylaniline, 3-methyl-4-amino-N-ethyl-N-$\beta$-hydroxyethylaniline, 3-methyl-4-amino-N-ethyl-N-$\beta$-methanesulfonamidoethylaniline, 3-methyl-4-amino-N-ethyl-N-$\beta$-methoxyethylaniline and sulfates, hydrochloride and p-toluenesulfonates thereof. Two or more of these compounds may be used in combination, in accordance with the object thereof The color developer generally contains a pH buffer such as an alkali metal carbonate or phosphate and development inhibitors or antifoggants such as bromides, iodides, benzimidazoles, benzothiazoles or mercapto compounds. In addition, the developer may further contain, if desired, various preservatives such as hydroxylamine, diethylhydroxylamine, sulfites, hydrazines (e.g., N,N-biscarboxymethylhydrazine), phenylsemicarbazides, triethanolamine or catechol-sulfonic acids; an organic solvent such as ethylene glycol or diethylene glycol; a development accelerator such as benzyl alcohol, polyethylene glycol, quaternary ammonium salts or amines; a color-forming coupler; a competing coupler; an auxiliary developing agent such as 1-phenyl-3-pyrazolidone; a tackifier; and various chelating agents such as aminopolycarboxylic acids, aminopolyphosphonic acids, alkylphosphonic acids or phosphonocarboxylic acid.. Specific examples of such chelating agents include ethylenediaminetetraacetic acid, nitrilotriacetic acid, diethylenetriaminepentaacetic acid, cyclohexanediamine-tetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, ethylenediamine-di(o-hydroxyphenylacetic acid) and salts thereof When reversal processing is carried out, the photographic materials are first subjected to black-and-white development, then to reversal processing and thereafter to color development The black-and-white developer used in the black-and-white development may contain known black-and-white developing agents, for example, dihydroxybenzenes such as hydroquinone, 3-pyrazolidones such as 1-phenyl-3-pyrazolidone or aminophenols such as N-methyl-p-aminophenol, singly or in combination thereof.

The color developer and black-and-white developer generally have a pH value of from 9 to 12. The amount of the replenisher relative to the developer is, although depending upon the color photographic materials to be processed, generally 3 liters or less per $m^2$ of the material. By lowering the bromide ion concentration in the replenisher, the amount may be 500 ml or lower. When the amount of the replenisher to be added is lowered, it is desired to prevent evaporation and aerial oxidation of the processing solution by reducing the contact surface area of the processing tank with air. The contact surface area of the processing solution with air in the processing tank is represented by the opening ratio which is defined by the following formula:

$$\text{Opening Ratio} = \frac{\text{Contact Surface Area (cm}^2\text{) of Processing Solution with Air}}{\text{Volume (cm}^3\text{) of Processing Tank}}$$

The above-mentioned opening ratio is preferably 0.1 or less, more preferably from 0.001 to 0.05.

Various means can be employed for the purpose of reducing the opening ratio, which include, for example, provision of a masking substance such as a floating lid on the surface of the processing solution in the processing tank, employment of the mobile lid described in JP-A-1-82033 and employment of the slit-developing method described in JP-A-63-216050.

Reduction of the opening ratio is preferably applied to not only both steps of color development and black-and-white development but also to all subsequent steps such as bleaching, bleach-fixation, fixation, rinsing and stabilization.

In addition, the amount of the replenisher to be added may also be reduced by means of suppressing accumulation of bromide ion in the developer.

The time for the color development is generally within the range of from 2 minutes to 5 minutes, but the processing time may be shortened by elevating the processing temperature, elevating the pH value of the processing solution and elevating the concentration of the color developing solution.

After being color developed, the photographic emulsion layer is generally bleached. Bleaching may be carried out simultaneously with fixation (bleach-fixation) or separately. In order to accelerate the photographic processing, bleaching may be followed by bleach fixation. In addition, bleach-fixation in two continuous processing tanks, fixation prior to bleach-fixation, or bleach-fixation followed by bleaching may also be applied to the photographic materials of the present invention, in accordance with the object thereof. As the bleaching agent there may be used, for example, compounds of polyvalent metals such as iron(III). Specific examples of the bleaching agent usable in the present invention include organic complexes of iron(III), such as complexes with aminopolycarboxylic acids such as ethylenediaminetetraacetic acid, diethylenetriaminepentaacetic acid, cyclohexanediamine-tetraacetic acid, methyliminodiacetic acid, 1,3-diaminopropane-tetraacetic acid or glycol ether-diamine-tetraacetic acid or with organic acids such as citric acid, tartaric acid or malic acid. Among them, aminopolycarboxylic acid-/iron(III) complexes such as the ethylenediaminetetraacetic acid/iron(III) complex are preferred in view of the rapid processability thereof and the prevention of environmental pollution. The aminopolycarboxylic acid/iron(III) complexes are especially useful both in a bleaching solution and in a bleach-fixing solution The bleaching solution or bleach-fixing solution containing such aminopolycarboxylic acid/iron(III) complexes generally has a pH value of from 4.0 to 8.0, but the solution may have a lower pH value for rapid processing.

The bleaching solution, the bleach-fixing solution and the previous bath may contain a bleaching accelerating agent, if desired. Various bleaching accelerating agents are known, and examples of the agents which are advantageously used in the present invention include the mercapto group or disulfide group-containing compounds described in U.S. Pat. No. 3,893,858, West German Patent 1,290,812, JP-A-53-95630 and *Research Disclosure,* Item 17129 (July, 1978); the thiazolidine derivatives described in JP-A-50-140129; the thiourea derivatives described in U.S. Pat. No. 3,706,561; the iodides described in JP-A-58-16235; the polyoxyethylene compounds described in West German Patent 2,748,430; the polyamine compounds described in JP-B-45-8836; and bromide ion. Among them, the mercapto group or disulfide group containing compounds are preferred because of the high accelerating effect thereof, and in particular, the compounds described in U.S. Pat. No. 3,893,858, West German Patent 1,290,812 and JP-A-53-95630 are especially preferred. In addition, the compounds described in U.S. Pat. No. 4,552,834 are also preferred. The bleaching accelerating agents may also be added to the photographic materials. When picture-taking color photographic materials are bleach fixed, the bleaching accelerating agents are especially effective.

As the fixing agent, there may be mentioned thiosulfates, thiocyanates, thioether compounds, thioureas and a large number of iodides. Among them, thiosulfates are generally used, and in particular, ammonium thiosulfate is most widely used. As the preservative for the bleach-fixing solution, sulfites, bisulfites, sulfinic acids such as p-toluenesulfinic acid, and carbonyl-bisulfite adducts are preferred.

The silver halide color photographic materials of the present invention are generally rinsed in water and/or stabilized, after being desilvered. The amount of water to be used in the rinsing step can be set in a broad range, in accordance with the characteristics of the photographic material being processed (for example, depending upon the raw material components, such as the coupler and so on) or the use of the material, as well as the temperature of the rinsing water, the number of rinsing tanks or stages, the type of replenishment system (normal current or countercurrent) and various other conditions. Among these conditions, the relation between the number of rinsing tanks and the amount of rinsing water in a multi-stage countercurrent rinsing system can be obtained by the method described in *Journal of the Society of Motion Picture and Television Engineers,* Vol. 64, pages 248 to 253 (May, 1955).

According to the multi-stage countercurrent system described in the above-mentioned reference, the amount of rinsing water to be used can be reduced noticeably, but because of the prolongation of the residence time of the water in the rinsing tank, bacteria may propagate in the tank so that floating substances generated by the propagation of bacteria would adhere to the surface of the material as it was processed. Accordingly, the above system would often have a problem. In the practice of processing the photographic materials of the present invention, the method of reducing calcium and magnesium ions, which is described in JP-A-62-288838, is very effective for overcoming this problem. In addition, the isothiazolone compounds and thiabendazoles described in JP-A-57-8542; chlorine-containing bactericides such as chlorinated sodium isocyanurates; and benzotriazoles and other bactericides described in H. Horiguchi, *Chemistry of Bactericidal and Fungicidal Agents* (1986), *Bactericidal and Fungicidal Techniques to Microorganisms,* edited by Association of Sanitary Technique, Japan (1982), and *Encyclopedia of Bactericidal and Fungicidal Agents,* edited by Nippon Bactericide and Fungicide Association (1988) can also be used.

The pH value of the rinsing water to be used for processing the photographic materials of the present invention is from 4 to 9, preferably from 5 to 8. The temperature of the rinsing water and the rinsing time can also be set variously in accordance with the characteristics of the photographic material being processed as well as the use thereof, and in general, the temperature is from 15 to 45° C. and the time is from 20 seconds to 10 minutes, and preferably the temperature is from 25 to 40° C. and the time is from 30 seconds to 5 minutes. Alternatively, the photographic materials of the present invention may also be processed directly with a stabilizing solution instead of being rinsed with water. For the stabilization, any known methods, for example, those described in JP A-57-8543, JP-A-58-14834 and JP-A-63-220345, can be employed.

In addition, the material can also be stabilized following the rinsing step. As one example thereof, there may be mentioned a stabilizing bath containing formaldehyde and a surfactant, which is used as a final bath for picture taking color photographic materials. The stabilizing bath may also contain various chelating agents and fungicides.

The overflow from the rinsing and/or stabilizing solutions resulting from the addition of replenishers may be re-used in other steps such as the previous desilvering step.

The silver halide color photographic materials of the present invention can contain a color developing agent for the purpose of simplifying and accelerating processing of the materials. For incorporation of color developing agents into the photographic materials, various precursors of the agents are preferably used. For example, there may be mentioned the indoaniline compounds described in U.S. Pat. No. 3,342,597, the Schiff base compounds described in U.S. Pat. No. 3,342,599 and *Research Disclosure,* Items 14850 and 15159, the aldole compounds described in *Research Disclosure,* Item 13924, the metal complexes described in U.S. Pat. No. 3,719,492, and the urethane compounds described in JP-A-53-135628, as the precursors.

The silver halide color photographic materials of the present invention can contain various kinds of 1-phenyl-3-pyrazolidones, if desired, for the purpose of accelerating the color developability thereof. Specific examples of these compounds are described in JP-A-56-64339, JP-A-57-144547 and JP-A-58-115438.

The processing solutions for the photographic materials of the invention are used at 10° C. to 50° C. In general, a processing temperature of from 33° C. to 38° C. is standard, but higher temperatures may be employed so as to accelerate processing or to shorten processing time, and lower temperatures may be employed so as to improve the quality of the images formed and to improve the stability of the processing solutions. For the purpose of economization of silver in the photographic materials, the cobalt intensification or hydrogen peroxide intensification mothods described in West German Patent 2,226,770 and U.S. Pat. No. 3,674,499 may be employed in processing the photographic materials of the present invention.

The following examples are intended to illustrate the present invention in more detail but not to limit it in any way.

EXAMPLE 1

Plural layers each having the following composition were coated on a polyethylene-laminated paper support to prepare a multi-layer color photographic paper. The coating compositions were prepared as stated below.

Preparation of Coating Composition for First Layer:

27.2 cc of ethyl acetate, 4.1 g of solvent (Solv-3) and 4.1 g of solvent (Solv-6) were added to 19.1 g of yellow coupler (ExY), 4.4 g of color image stabilizer (Cpd-1) and 1.8 g of compound (Cpd-7) to dissolve the latter therein. The resulting solution was dispersed by emulsification in 185 cc of aqueous 10% gelatin solution containing 8 cc of 10% sodium dodecylbenzenesulfonate. Separately, a silver chlorobromide emulsion (prepared by blending an emulsion containing cubic grains with a silver bromide content of 80.0 mol%, a mean grain size of 0.85 micron and a fluctuation coefficient of 0.08 and an emulsion containing cubic grains with a silver bromide content of 80.0%, a mean grain size of 0.62 micron and a fluctuation coefficient of 0.07, in a silver molar ratio of ⅗) was sulfur-sensitized, and a blue-sensitizing dye shown below was added thereto in an amount of $5.0\times10^{-4}$ mol per mol of silver in the emulsion. The previously prepared dispersion and the emulsion were blended to prepare a coating composition for the first layer, which comprised the components mentioned below.

The coating compositions for the second to seventh layers were prepared in a similar manner as above. As a gelatin-hardening agent in each layer, 1-hydroxy-3,5-dichloro-s-triazine sodium salt was used.

The color sensitizing dyes added to the respective layers were as follows:

Blue-Sensitive Emulsion Layer:

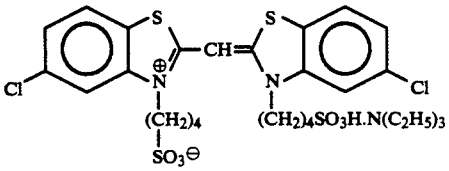

($5.0 \times 10^{-4}$ mol per mol of silver halide)

Green-Sensitive Emulsion Layer:

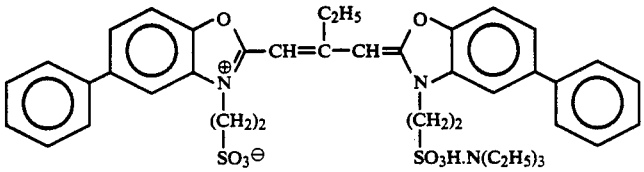

($4.0 \times 10^{-4}$ mol per mol of silver halide)

and

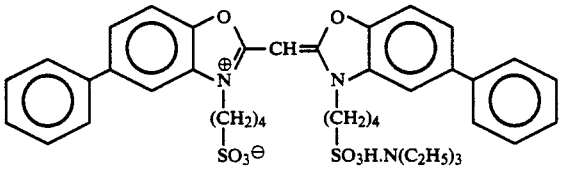

($7.0 \times 10^{-5}$ mol per mol of silver halide)

Red-Sensitive Emulsion Layer:

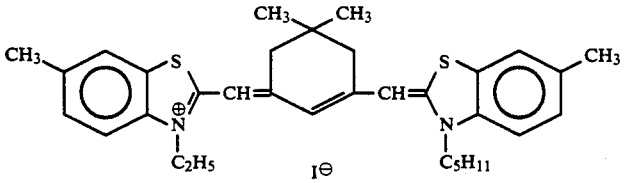

($0.9 \times 10^{-4}$ mol per mol of silver halide)

The following compound was further added to the red-sensitive emulsion layer in an amount of $2.6 \times 10^{-3}$ mol per mol of silver halide.

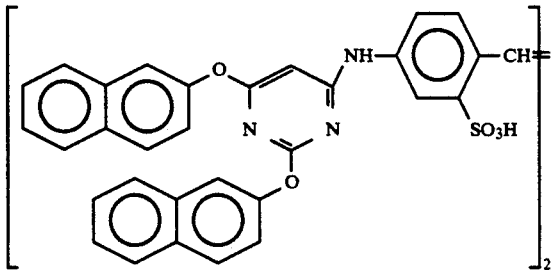

To the blue-sensitive emulsion layer, the green-sensitive emulsion layer and the red-sensitive emulsion layer were added 1-(5-methylureidophenyl)-5-mercaptotetrazole in an amount of $4.0 \times 10^{-6}$ mol, $3.0 \times 10^{-5}$ mol and $1.0 \times 10^{-5}$ mol, respectively, per mol of silver halide, and 2-methyl-5-t-octylhydroquinone in an amount of $8 \times 10^{-3}$ mol, $2 \times 10^{-2}$ mol and $2 \times 10^{-2}$ mol, respectively, per mol of silver halide.

To the blue-sensitive emulsion layer and the green-sensitive emulsion layer was added 4-hydroxy-6-methyl-1,3,3a,7-tetraazaindene in an amount of $1.2 \times 10^{-2}$ mol and $1.1 \times 10^{-2}$ mol, respectively, per mol of silver halide.

To the red-sensitive emulsion layer were added the following mercaptoimidazole in an amount of $2 \times 10^{-4}$ mol per mol of silver halide and the following mercaptothiadiazole in an amount of $4 \times 10^{-4}$ mol per mol of silver halide.

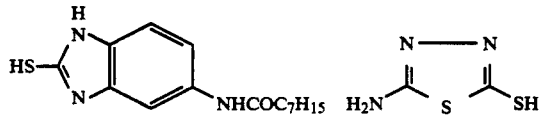

The following dyes were added to the emulsion layers for anti-irradiation.

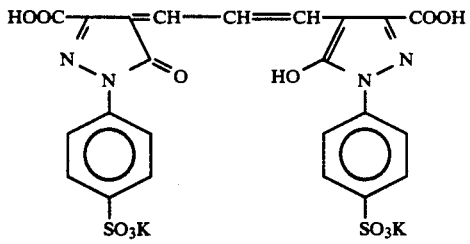

and

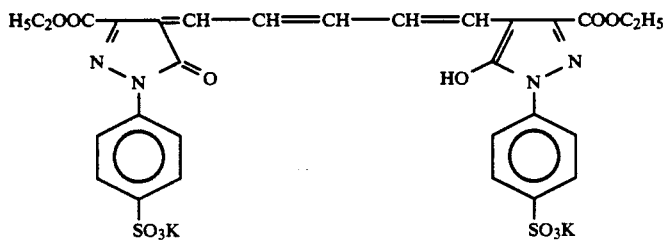

Constitution of Photographic Layers:

Compositions of the respective photographic layers are stated below. The number for each component indicates the amount thereof coated (g/m²). The amount of the silver halide emulsion in each layer coated is represented by the amount of silver therein.

| | |
|---|---|
| Support: | |
| Polyethylene-laminated Paper (containing white pigment ($TiO_2$) and bluish dye (ultramarine) in polyethylene coated on the first layer side) | |
| First Layer: Blue-sensitive Layer | |
| Above-mentioned silver chlorobromide emulsion (AgBr: 80 mol %) | 0.26 |
| Gelatin | 1.83 |
| Yellow coupler (ExY) | 0.83 |
| Color image stabilizer (Cpd-1) | 0.19 |
| Color image stabilizer (Cpd-7) | 0.08 |
| Solvent (Solv-3) | 0.18 |
| Solvent (Solv-6) | 0.18 |
| Second Layer: Color Mixing Preventing Layer | |
| Gelatin | 0.99 |
| Color mixing preventing agent (Cpd-5) | 0.08 |
| Solvent (Solv-1) | 0.16 |
| Solvent (Solv-4) | 0.08 |
| Third Layer: Green-sensitive Layer | |
| Silver chlorobromide emulsion (prepared by blending an emulsion containing cubic grains with AgBr content of 90 mol %, a mean grain size of 0.47 micron and a fluctuation coefficient of 0.12 and an emulsion containing cubic grains with AgBr content of 90 mol %, a mean grain size of 0.36 micron and a fluctuation coefficient of 0.09, in a silver molar ratio of 1/1) | 0.16 |
| Gelatin | 1.79 |
| Magenta coupler (ExM) | 0.32 |
| Color image stabilizer-1 | (50 mol % based on a coupler represented by formula II) |
| Color image stabilizer-2 (Cpd-3) | 0.20 |
| Color image stabilizer-3 (Cpd-4) | 0.01 |
| Color image stabilizer-4 (Cpd-8) | 0.03 |
| Color image stabilizer-5 (Cpd-9) | 0.04 |
| Solvent (Solv-2) | 0.65 |
| Fourth Layer: Ultraviolet Absorbing Layer | |

-continued

| | |
|---|---|
| Gelatin | 1.58 |
| Ultraviolet absorbent (UV-1) | 0.47 |
| Color mixing preventing agent (Cpd-5) | 0.05 |
| Solvent (Solv-5) | 0.24 |
| Fifth Layer: Red-sensitive Layer | |
| Silver chlorobromide emulsion (prepared by blending an emulsion containing cubic grains with AgBr content of 70 mol %, a mean grain size of 0.49 micron and a fluctuation coefficient of 0.08 and an emulsion containing cubic grains with AgBr content of 70 mol %, a mean grain size of 0.34 micron and a fluctuation coefficient of 0.10, in a silver molar ratio of 1/2) | 0.23 |
| Gelatin | 1.34 |
| Cyan coupler (ExC) | 0.30 |
| Color image stabilizer (Cpd-6) | 0.17 |
| Color image stabilizer (Cpd-7) | 0.40 |
| Solvent (Solv-6) | 0.20 |
| Sixth Layer: Ultraviolet Absorbing Layer | |
| Gelatin | 0.53 |
| Ultraviolet absorbing (UV-1) | 0.16 |
| Color mixing preventing agent (Cpd-5) | 0.02 |
| Solvent (Solv-5) | 0.08 |
| Seventh Layer: Protective Layer | |
| Gelatin | 1.33 |
| Acryl-modified copolymer of polyvinyl alcohol (modification degree of 17%) | 0.17 |
| Liquid paraffin | 0.03 |

Compounds used in the above are as follows:

Color Image Stabilizer (Cpd-1):

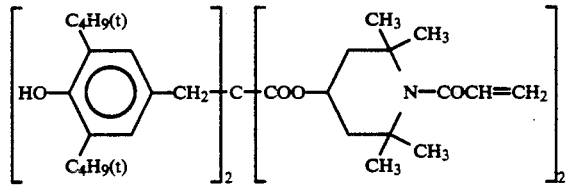

Color Image Stabilizer (Cpd-3)

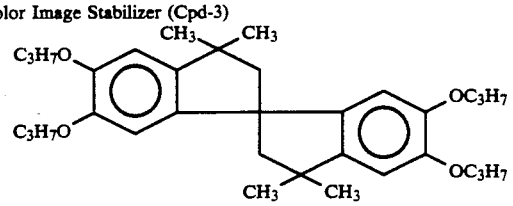

-continued

Color Image Stabilizer (Cpd-4):

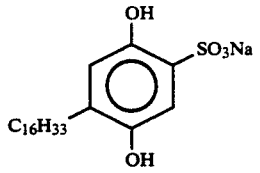

Color Mixing Preventing Agent (Cpd-5):

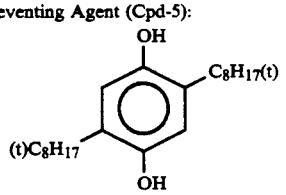

Color Image Stabilizer (Cpd-6):

A 2/4/4 (by weight) mixture of the following compounds:

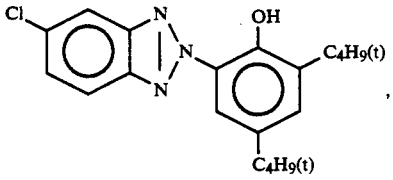

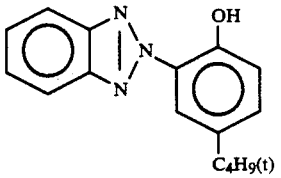

and

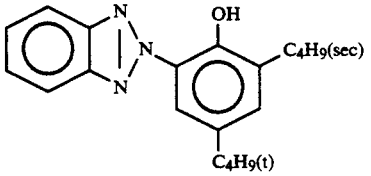

Color Image Stabilizer (Cpd-7):

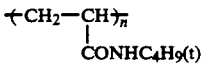

(mean molecular weight: 80,000)

Color Image Stabilizer (Cpd-8):

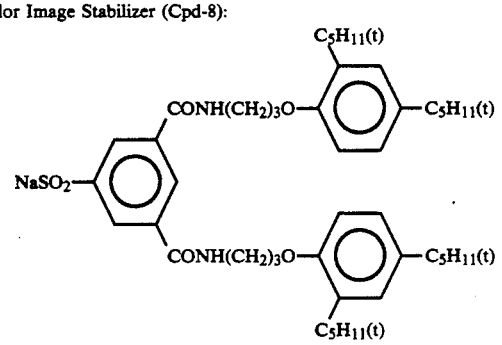

Color Image Stabilizer (Cpd-9):

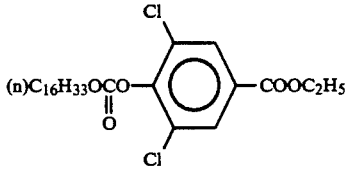

Ultraviolet Absorbent (UV-1):

A 4/2/4 (by weight) mixture of the following compounds:

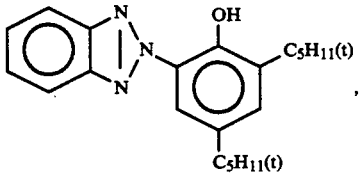

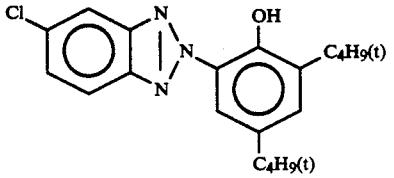

and

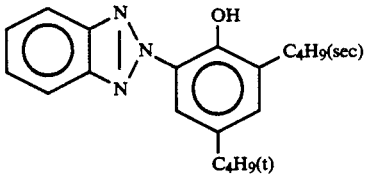

Solvent (Solv-1):

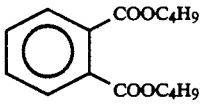

Solvent (Solv-2):

A 2/1 (by weight) mixture of the following compounds:

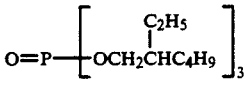

and

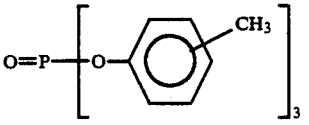

Solvent (Solv-3):

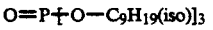

Solvent (Solv-4):

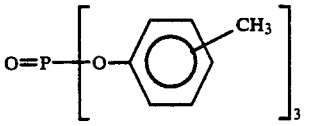

Solvent (Solv-5):

-continued

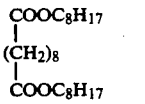

Solvent (Solv-6):

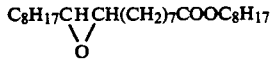

Yellow Coupler (ExY):

A 1/1 (by mol) mixture of the following (A) and (B):

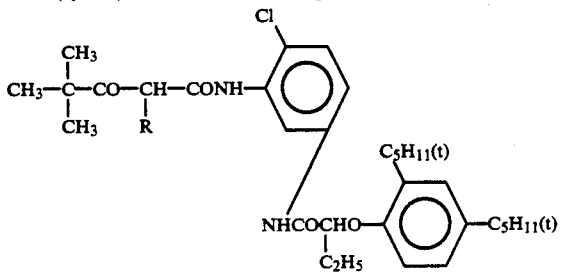

(A): R =

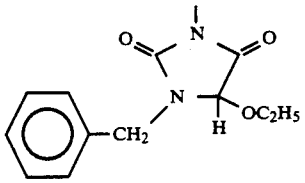

and (B): R =

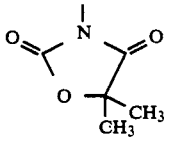

Magenta Coupler (ExM):

A 1/1 (by mol) mixture of the following compounds:

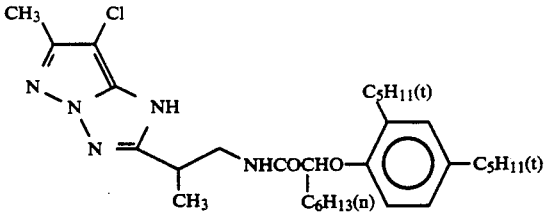

and

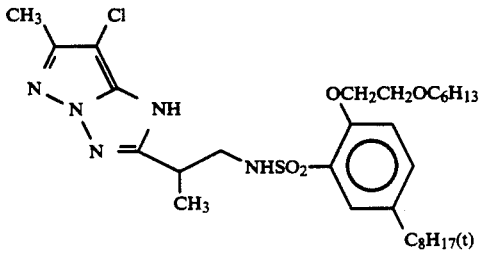

Cyan Coupler (ExC):

A 1/1 (by mol) mixture of the following compounds:

-continued

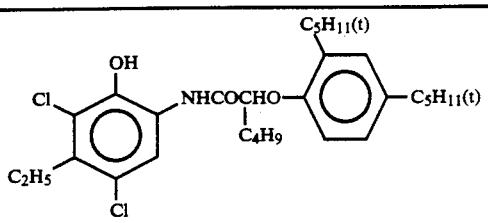

and

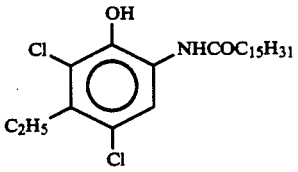

The aobve sample thus prepared was called Sample (1A). Other samples were prepared in the same manner as Sample (1A) except that the third layer contained the magenta coupler, the color image stabilizer-1 (compound of formula (II), in an amount of 50 mol% of the coupler) and the color image stabilizer-2 (compound of formula (III), in an amount of 100 mol% of the coupler) as shown in Table 1 below.

The samples thus prepared were processed as follows:

Precisely, each sample was sensitometrically exposed with a sensitometer (FWH Type, manufactured by Fuji Photo Film Co., Ltd.—the light source has a color temperature of 3200° K.) through a sensitometrical three-color separating filter. The exposure time was 0.1 second and the exposure amount was 250 CMS.

After being exposed, the samples were processed with an automatic developing machine, in accordance with the procedure described below using the processing solutions also described below.

| Processing Steps | Temperature | Time |
|---|---|---|
| Color development | 37° C. | 3 min 30 sec |
| Bleach-fixation | 33° C. | 1 min 30 sec |
| Rinsing | 24 to 34° C. | 3 min |
| Drying | 70 to 80° C. | 1 min |

The compositions of the processing solutions used in the above-mentioned steps were as follows:

| | |
|---|---|
| Color Developer: | |
| Water | 800 ml |
| Diethylenetriaminepentaacetic acid | 1.0 g |
| Nitrilotriacetic acid | 2.0 g |
| Benzyl alcohol | 15 ml |
| Diethylene glycol | 10 ml |
| Sodium sulfite | 2.0 g |
| Potassium bromide | 1.0 g |
| Potassium carbonate | 30 g |
| N-ethyl-N-(β-methanesulfonamidoethyl)-3-methyl-4-aminoaniline sulfate | 4.5 g |
| Hydroxylamine sulfate | 3.0 g |
| Brightening agent (WHITEX 4B, manufactured by Sumitomo Chemical Co.) | 1.0 g |
| Water to make | 1000 ml |
| pH (25° C.) | 10.25 |
| Bleach-fixing Solution: | |
| Water | 400 ml |
| Ammonium thiosulfate (700 g/l) | 150 ml |
| Sodium sulfite | 18 g |
| Ammonium ethylenediamine- | 55 g |

-continued

| | |
|---|---|
| tetraacetato/iron(III) | |
| Disodium ethylenediaminetetraacetate | 5 g |
| Water to make | 1000 ml |
| pH (25° C.) | 6.70 |

Color images were thus formed on the samples, which were then evaluated with respect to photographic characteristics and fastness. Evaluation of photographic characteristics was effected on the magenta density (Dmin) of the non-exposed area. For evaluating fastness, each sample was exposed with a xenon tester (illuminance: 200,000 luxes) for 8 days, the remaining magenta density on the area having an initial magenta density of 1.0 and that on the area having an initial magenta density of 0.5 were measured, and the residual percentage of the magenta density in each area was obtained.

The results obtained are shown in Table 1 below.

Comparative compounds used in the experiment are as follows:

Comparative Compound (a):

$((t)C_8H_{17}-O)_3-P$ (described in JP-A-62-186263)

Comparative Compound (b):

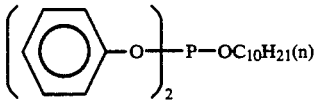

(described in JP-A-62-186263)

Comparative Compound (c):

-continued

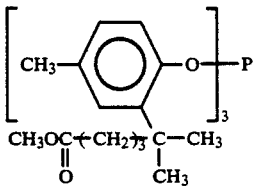

(described in EP-A-309957)

Comparative Compound (d):

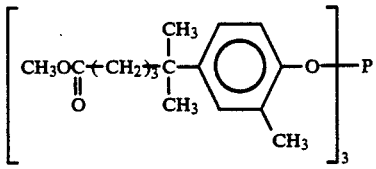

(described in EP-A-309957)

Comparative Compound (e):

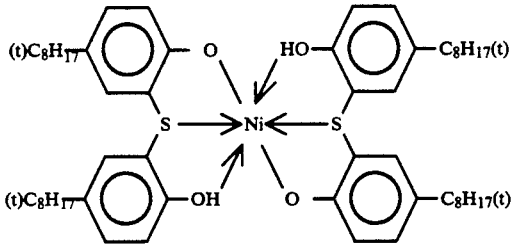

(described in JP-A-62-186263)

As is obvious from the results shown in Table 1 below, the samples of the present invention were hardly fogged and they showed an extremely improved lightfastness. The effect of the samples of the present invention could not be anticipated from the prior art. It is therefore obvious that the silver halide color photographic materials of the present invention have better photographic characteristics than any other conventional photographic materials.

TABLE 1

| Sample Code | Magenta Coupler | Color Image Stabilizer-1 | Color Image Stabilizer-2 | Fog | Residual Percentage of Magenta Density (after exposure to 200,000 lux-Xe, for 8 days) Initial Density (1.0) (%) | Initial Density (0.5) (%) | Remarks |
|---|---|---|---|---|---|---|---|
| 1A | ExM | — | Cpd-3 | 0.07 | 68 | 51 | Comparison |
| 2A | " | — | A-6 | 0.07 | 60 | 46 | " |
| 3A | " | — | A-11 | 0.07 | 58 | 41 | " |
| 4A | " | — | A-12 | 0.07 | 62 | 48 | " |
| 5A | " | — | A-29 | 0.07 | 62 | 47 | " |
| 6A | " | — | A-35 | 0.07 | 61 | 48 | " |
| 7A | " | — | Comparative Compound (e) | 0.09 | 58 | 43 | " |
| 8A | " | Comparative Compound (a) | — | 0.43 | 33 | 20 | " |
| 9A | " | Comparative Compound (a) | Cpd-3 | 0.43 | 69 | 53 | " |
| 10A | " | Comparative Compound (a) | A-12 | 0.43 | 63 | 49 | " |
| 11A | " | Comparative Compound (b) | A-6 | 0.53 | 60 | 47 | " |
| 12A | " | Comparative Compound (b) | A-29 | 0.52 | 63 | 48 | " |
| 13A | " | Comparative | — | 0.08 | 35 | 28 | Comparison |

TABLE 1-continued

| Sample Code | Magenta Coupler | Color Image Stabilizer-1 | Color Image Stabilizer-2 | Fog | Residual Percentage of Magenta Density (after exposure to 200,000 lux-Xe, for 8 days) Initial Density (1.0) (%) | Initial Density (0.5) (%) | Remarks |
|---|---|---|---|---|---|---|---|
| 14A | " | Compound (c) Comparative | A-3 | 0.07 | 69 | 55 | " |
| 15A | " | Compound (c) Comparative | A-35 | 0.07 | 68 | 56 | " |
| 16A | " | Compound (c) Comparative | Cpd-3 | 0.07 | 69 | 57 | " |
| 17A | " | Compound (d) Comparative | A-6 | 0.07 | 65 | 51 | " |
| 18A | " | Compound (d) Comparative | A-11 | 0.07 | 61 | 47 | " |
| 19A | " | Compound (d) Comparative | A-12 | 0.07 | 64 | 50 | " |
| 20A | " | Compound (d) Comparative | A-29 | 0.07 | 65 | 49 | " |
| 21A | " | Compound (d) Comparative | A-35 | 0.07 | 63 | 49 | " |
| 22A | " | Compound (d) Comparative | Comparative | 0.43 | 58 | 44 | " |
| 23A | " | Compound (a) Comparative | Compound (e) Comparative* | 0.43 | 65 | 50 | " |
| 24A | " | Compound (a) P-2 | Compound (e) — | 0.07 | 31 | 23 | " |
| 25A | " | P-14 | — | 0.07 | 33 | 24 | Comparison |
| 26A | " | P-2 | Cpd-3 | 0.07 | 80 | 77 | Invention |
| 27A | " | P-5 | " | 0.07 | 78 | 74 | " |
| 28A | " | P-8 | " | 0.07 | 74 | 68 | " |
| 29A | " | P-14 | " | 0.07 | 81 | 79 | " |
| 30A | " | P-17 | " | 0.07 | 80 | 77 | " |
| 31A | " | P-21 | Cpd-3 | 0.07 | 79 | 76 | " |
| 32A | " | P-23 | " | 0.07 | 80 | 77 | " |
| 33A | " | P-2 | A-3 | 0.07 | 78 | 75 | " |
| 34A | " | " | A-12 | 0.07 | 77 | 76 | " |
| 35A | " | " | A-29 | 0.07 | 78 | 77 | " |
| 36A | " | P-14 | A-6 | 0.07 | 79 | 78 | " |
| 37A | " | " | A-11 | 0.07 | 72 | 66 | " |
| 38A | " | " | A-29 | 0.07 | 79 | 78 | " |
| 39A | " | P-14 | A-35 | 0.07 | 78 | 76 | Invention |
| 40A | M-6 | Comparative | Cpd-3 | 0.07 | 68 | 55 | Comparison |
| 41A | " | Compound (c) Comparative | A-3 | 0.07 | 64 | 52 | " |
| 42A | " | Compound (c) Comparative | A-12 | 0.07 | 65 | 53 | " |
| 43A | " | Compound (c) Comparative | A-29 | 0.07 | 64 | 52 | " |
| 44A | " | Compound (c) Comparative | A-35 | 0.07 | 66 | 51 | " |
| 45A | " | Compound (c) P-2 | A-3 | 0.07 | 79 | 77 | Invention |
| 46A | M-6 | P-2 | A-12 | 0.07 | 76 | 75 | Invention |
| 47A | " | " | A-29 | 0.07 | 79 | 77 | " |
| 48A | " | P-14 | Cpd-3 | 0.07 | 81 | 79 | " |
| 49A | " | " | A-6 | 0.07 | 78 | 76 | " |
| 50A | " | " | A-29 | 0.07 | 78 | 77 | " |
| 51A | M-32 | Comparative | Cpd-3 | 0.07 | 70 | 57 | Comparison |
| 52A | " | Compound (c) Comparative | A-3 | 0.07 | 65 | 50 | " |
| 53A | " | Compound (c) P-5 | Cpd-3 | 0.07 | 80 | 79 | Invention |
| 54A | " | " | A-3 | 0.07 | 78 | 76 | " |
| 55A | " | P-17 | Cpd-3 | 0.07 | 82 | 80 | " |
| 56A | " | " | A-3 | 0.07 | 78 | 78 | " |
| 57A | " | — | Cpd-3 | 0.07 | 70 | 55 | Comparison |

Note(*):
Sample (23A) further contained (A-6) in an amount of 100 mol % of the magenta coupler.

EXAMPLE 2

Samples which corresponded to Samples (26A) through (39A) of Example 1 but which did not contain the color image stabilizer (Cpd-8) and the color image stabilizer (Cpd-9) in the third layer were prepared. These samples were exposed and processed in the same manner as in Example 1 and then subjected to a color-fading test under the condition of 60° C. and 70% RH for 2 weeks. As a result, magenta stains occurred in the non-exposed area in every sample. Accordingly, it is understood that the incorporation of the color image stabilizer (Cpd-8) and the color image stabilizer (Cpd-9) into the third layer of the samples (26A through 39A of Example 1) in accordance with the present invention is effective for improving the image storage stability, especially for inhibiting magenta stain.

EXAMPLE 3

Plural layers each having the following composition were coated on a polyethylene-laminated paper support to prepare a multi-layer color photographic paper. The coating compositions were prepared as stated below.

Preparation of Coating Composition for First Layer 27.2 cc of ethyl acetate and 8.2 g of solvent (Solv-1) were added to 19.1 g of yellow coupler (ExY), 4.4 g of color image stabilizer (Cpd-1) and 0.7 g of color image stabilizer (Cpd-7) to dissolve the latter therein. The resulting solution was dispersed by emulsification in 185 cc of aqueous 10% gelatin solution containing 8 cc of 10% sodium dodecylbenzenesulfonate. Separately, the following blue-sensitizing dyes were added to a silver chlorobromide emulsion (3/7) (by silver molar ratio) mixture of cubic grains having a mean grain size of 0.88 micron to cubic grains having a mean grain size of 0.70 microns—the fluctuation coefficient of the grain size distribution of the former was 0.08 and that of the latter was 0.10; and both had 0.2 mol% of silver bromide locally on the surfaces of the grains), in an amount of $2.0\times10^{-4}$ mol, per mol of silver, of each dye for the large-size grain-containing emulsion and in an amount of $2.5\times10^{-4}$ mol, per mol of silver, of each dye for the small-size grain-containing emulsion. Next, the resulting emulsion was sulfur-sensitized. The previously prepared dispersion and the emulsion were blended to prepare a coating composition of the first layer, which comprised the components mentioned below.

The coating compositions for the second to seventh layers were prepared in the same manner as above. As the gelatin-hardening agent in each layer, 1-hydroxy-3,5-dichloro-s-triazine sodium salt was used.

The color sensitizing dyes added to the respective layers were as follows:

Blue-Sensitive Emulsion Layer:

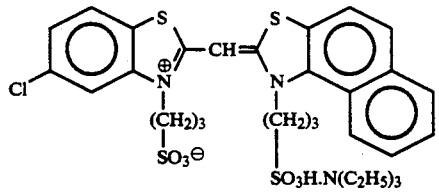

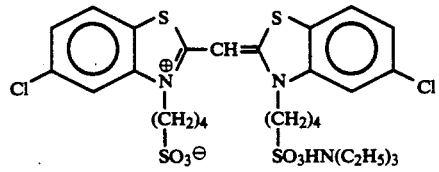

($2.0\times10^{-4}$ mol per mol of silver halide of each dye to the large-size grain-containing emulsion; and $2.5\times10^{-4}$ mol per mol of silver halide of each dye to the small-size grain-containing emulsion)

Green-Sensitive Emulsion Layer:

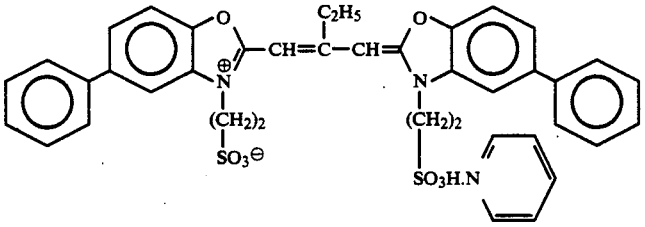

($4.0\times10^{-4}$ mol per mol of silver halide to the large-size grain-containing emulsion, and $5.6\times10^{-4}$ mol per mol of silver halide to the small-size grain-containing emulsion) and

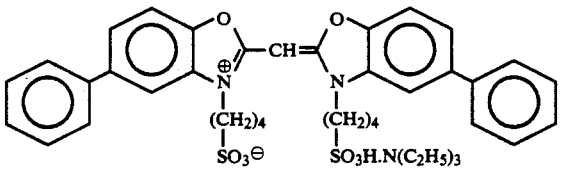

($7.0\times10^{-5}$ mol per mol of silver halide to the large-size grain-containing emulsion, and $1.0\times10^{-5}$ mol per mol of silver halide to the small-size grain-containing emulsion)

Red-Sensitive Emulsion Layer:

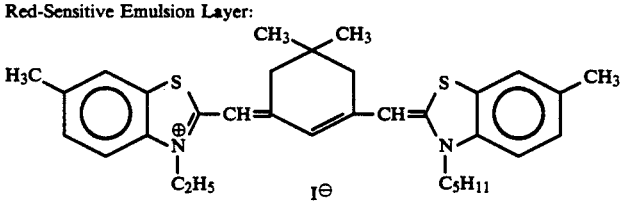

($0.9\times10^{-4}$ mol per mol of silver halide to the large-size grain-containing emulsion, and $1.1\times10^{-4}$ mol per mol of silver halide to the small-size grain-containing emulsion)

The following compound was further added to the red-sensitive emulsion layer in an amount of $2.6\times10^{-3}$ mol per mol of silver halide.

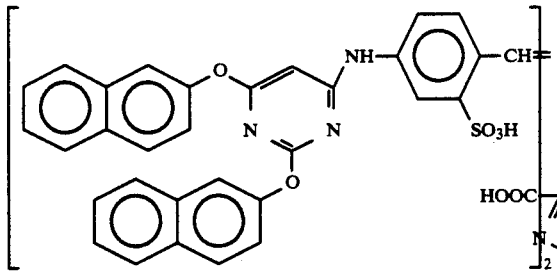

To the blue-sensitive emulsion layer, the green-sensitive emulsion layer and the red-sensitive emulsion layer was added 1-(5-methylureidophenyl)-5-mercaptotetrazole in an amount of $8.5\times10^{-5}$ mol $7.7\times10^{-4}$ mol and $2.5\times10^{-4}$ mol, respectively, per mol of silver halide.

To the blue-sensitive emulsion layer and the green-sensitive emulsion layer was added 4-hydroxy-6-methyl-1,3,3a,7-tetraazaindene in an amount of $3\times10^{-4}$ mol and $2\times10^{-4}$ mol, respectively, per mol of silver halide.

The following dyes were added to the emulsion layers for anti-irradiation.

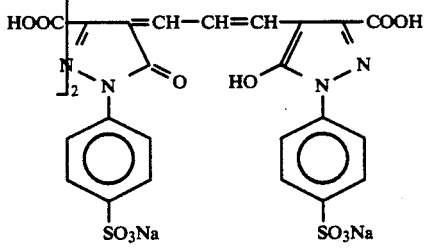

and

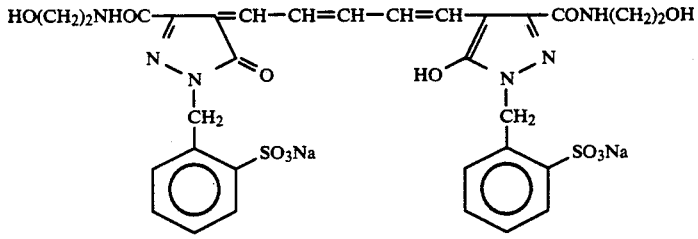

Constitution of Photographic Layers

Compositions of the respective photographic layers are stated below. The number for each component indicates the amount thereof coated (g/m$^2$). The amount of the silver halide emulsion in each layer coated is represented by the amount of silver therein.

| | |
|---|---|
| Support: | |
| Polyethylene-laminated Paper (containing white pigment ($TiO_2$) and bluish dye (ultramarine) in polyethylene coated on the first layer side) | |
| First Layer: Blue-sensitive Layer | |
| Above-described silver chlorobromide emulsion | 0.30 |
| Gelatin | 1.86 |
| Yellow coupler (ExY) | 0.82 |
| Color image stabilizer (Cpd-1) | 0.19 |
| Solvent (Solv-1) | 0.35 |
| Color image stabilizer (Cpd-7) | 0.06 |
| Second Layer: Color Mixing Preventing Layer | |
| Gelatin | 0.99 |
| Color mixing preventing agent (Cpd-5) | 0.08 |
| Solvent (Solv-1) | 0.16 |
| Solvent (Solv-4) | 0.08 |
| Third Layer: Green-sensitive Layer | |
| Silver chlorobromide emulsion (prepared by blending an emulsion containing cubic grains with a surface-localized AgBr content of 0.8 mol %, a mean grain size of 0.55 micron and a fluctuation coefficient of grain size distribution of 0.10 and an emulsion containing cubic grains with a surface-localized AgBr content of 0.8 mol %, a mean grain size of 0.39 micron and a fluctuation coefficient of grain size distribution of 0.08, in a silver molar ratio of 1/3) | 0.12 |
| Gelatin | 1.24 |
| Magenta coupler (ExM) | 0.20 |
| Color image stabilizer-1 | |
| Color image stabilizer-2 (Cpd-3) | 0.15 |
| Color image stabilizer-3 (Cpd-4) | 0.02 |
| Color image stabilizer-5 (Cpd-9) | 0.03 |

-continued

| | |
|---|---|
| Solvent (Solv-2) | 0.40 |
| Fourth Layer: Ultraviolet Absorbing Layer | |
| Gelatin | 1.58 |
| Ultraviolet absorbent (UV-1) | 0.47 |
| Color mixing preventing agent (Cpd-5) | 0.05 |
| Solvent (Solv-5) | 0.24 |
| Fifth Layer: Red-sensitive Layer | |
| Silver chlorobromide emulsion (prepared by blending an emulsion containing cubic grains with a surface-localized AgBr content of 0.6 mol %, a mean grain size of 0.58 micron and a fluctuation coefficient of grain size distribution of 0.09 and an emulsion containing cubic grains with a surface-localized AgBr content of 0.6 mol %, a mean grain size of 0.45 micron and a fluctuation coefficient of grain size distribution of 0.11, in a silver molar ratio of 1/4) | 0.23 |
| Gelatin | 1.34 |
| Cyan coupler (ExC) | 0.32 |
| Color image stabilizer (Cpd-6) | 0.17 |
| Color image stabilizer (Cpd-7) | 0.40 |
| Color image stabilizer (Cpd-8) | 0.04 |
| Solvent (Solv-6) | 0.15 |
| Sixth Layer: Ultraviolet Absorbing Layer | |
| Gelatin | 0.53 |
| Ultraviolet absorbent (UV-1) | 0.16 |
| Color mixing preventing agent (Cpd-5) | 0.02 |
| Solvent (Solv-5) | 0.08 |
| Seventh Layer: Protective Layer | |
| Gelatin | 1.33 |
| Acryl-modified copolymer of polyvinyl alcohol (modification degree of 17%) | 0.17 |
| Liquid paraffin | 0.03 |

Compounds used in the above are as follows:

Yellow Coupler (ExY):

A 1/1 (by mol) mixture of the following (A) and (B):

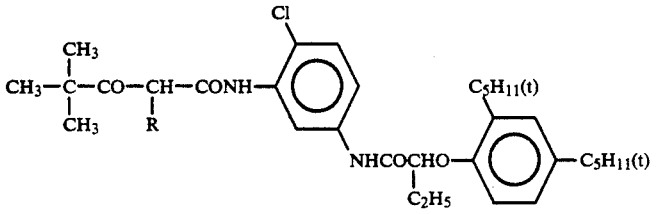

(A): R = 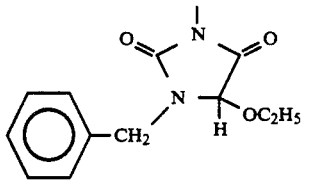 and (B): R = 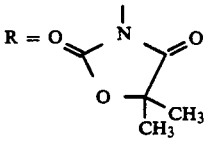

Magenta Coupler (ExM):

A 1/1 (by mol) mixture of the following compounds:

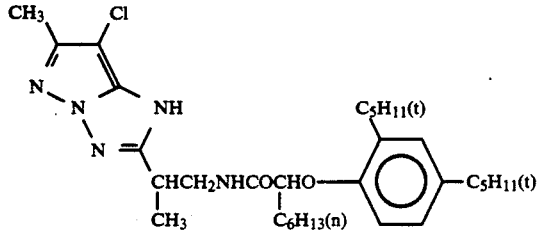

and

-continued
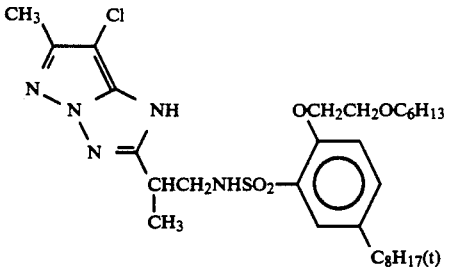
Cyan Coupler (ExC):
A 2/4/4 (by weight) mixture of the following (A), (B), (C):
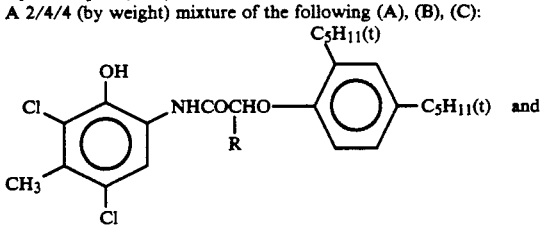
(A): R = $C_2H_5$;
(B): R = $C_4H_9$; and
(C):
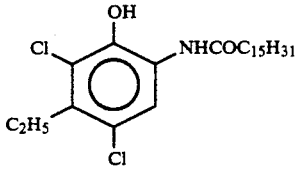
Color Image Stabilizer (Cpd-1):
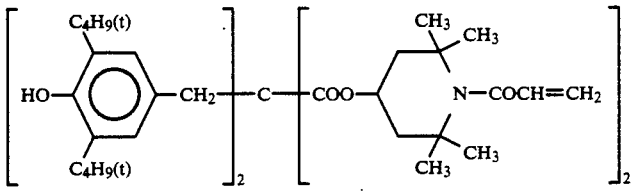
Color Image Stabilizer (Cpd-3)
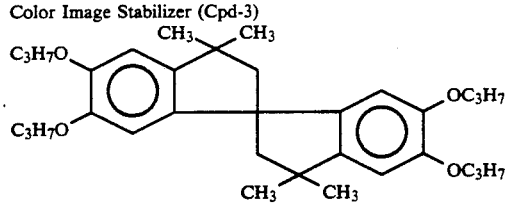
Color Image Stabilizer (Cpd-4):
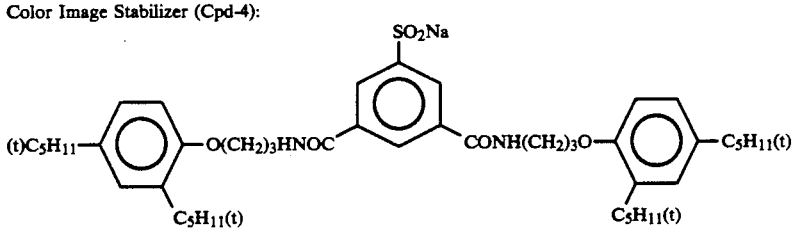
Color Mixing Preventing Agent (Cpd-5):
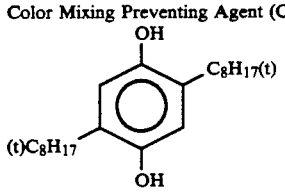

-continued
Color Image Stabilizer (Cpd-6):
A 2/4/4 (by weight) mixture of the following compounds:
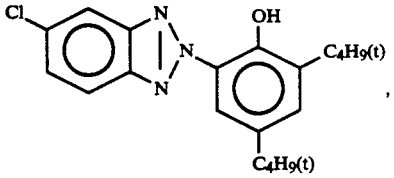
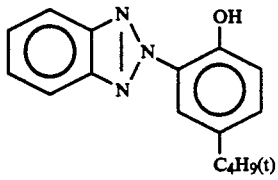
and
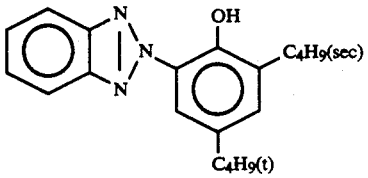
Color Image Stabilizer (Cpd-7):
(mean molecular weight: 60,000)
Color Image Stabilizer (Cpd-8):
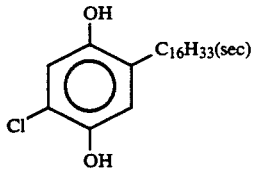
Color Image Stabilizer (Cpd-9):
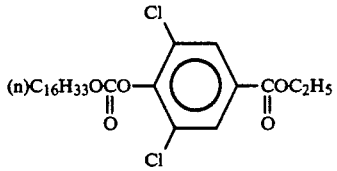
Ultraviolet Absorbent (UV-1):
A 4/2/4 (by weight) mixture of the following compounds:
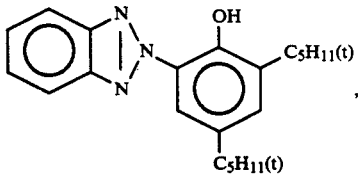
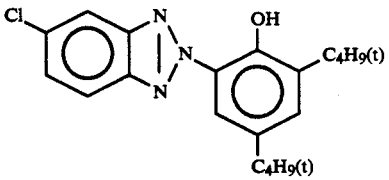
and
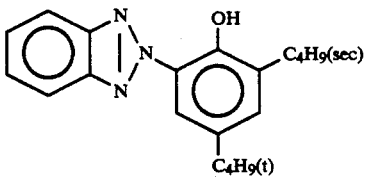
Solvent (Solv-1):
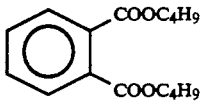
Solvent (Solv-2):
A 2/1 (by volume) mixture of the following compounds:

-continued

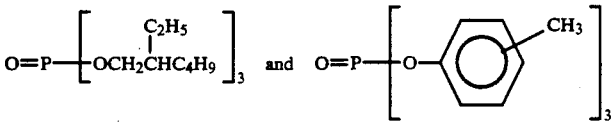

Solvent (Solv-4):

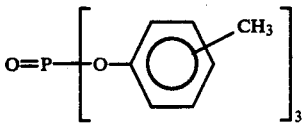

Solvent (Solv-5):

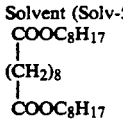

(Solv-6) Solvent

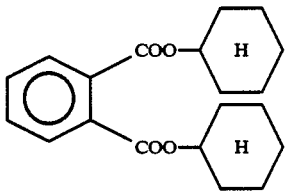

The above sample thus prepared was called Sample (IC). Other samples were prepared in the same manner as Sample (IA) except for that the third layer contained the magenta coupler, the color image stabilizer-1 (compound of formula (II), in an amount of 50 mol% of the coupler) and the color image stabilizer-2 (compound of formula (III), in an amount of 100 mol% of the coupler) as shown in Table 2 below.

Each sample thus prepared was exposed in the same manner as in Example 1. Next, the exposed sample was processed with a paper processing machine for a running test where the sample was processed in accordance with the procedure mentioned below until the amount of replenisher added to the color developer tank became two times the volume of the tank.

| Processing Steps | Temp. | Time | Amount of Replenisher* | Volume of Tank |
|---|---|---|---|---|
| Color Development | 35° C. | 45 sec | 161 ml | 17 l |
| Bleach-fixation | 30 to 35° C. | 45 sec | 215 ml | 17 l |
| Rinsing (1) | 30 to 35° C. | 20 sec | — | 10 l |
| Rinsing (2) | 30 to 35° C. | 20 sec | — | 10 l |
| Rinsing (3) | 30 to 35° C. | 20 sec | 350 ml | 10 l |
| Drying | 70 to 80° C. | 60 sec | | |

*Amount of replenisher is per $m^2$ of sample being processed. Rinsing (3) to (1) was effected by a three-tank countercurrent system from tank (3) to tank (1).

The compositions of the processing solutions used in the above-mentioned procedure were as follows:

| | Tank Solution | Replenisher |
|---|---|---|
| Color Developer: | | |
| Water | 800 ml | 800 ml |
| Ethylenediamine-N,N,N,N-tetramethylene phosphonic acid | 1.5 g | 2.0 g |
| Potassium bromide | 0.015 g | — |
| Triethanolamine | 8.0 g | 12.0 g |
| Sodium chloride | 1.4 g | — |

-continued

| | Tank Solution | Replenisher |
|---|---|---|
| Potassium carbonate | 25 g | 25 g |
| N-ethyl-N-(β-methanesulfonamidoethyl)-3-methyl-4-aminoaniline sulfate | 5.0 g | 7.0 g |
| N,N-bis(carboxymethyl)hydrazine | 5.5 g | 7.0 g |
| Brightening agent (WHITEX 4B, manufactured by Sumitomo Chemical) | 1.0 g | 2.0 g |
| Water to make | 1000 ml | 1000 ml |
| pH (25° C.) | 10.05 | 10.45 |
| Bleach-fixing solution: Tank solution and replenisher were same. | | |
| Water | 400 ml | |
| Ammonium thiosulfate (700 g/l) | 100 ml | |
| Sodium sulfite | 17 g | |
| Ammonium ethylenediaminetetraacetato/iron(III) | 55 g | |
| Disodium ethylenediaminetetraacetate | 5 g | |
| Ammonium bromide | 40 g | |
| Water to make | 1000 ml | |
| pH (25° C.) | 6.0 | |
| Rinsing Solution: Tank solution and replenisher were the same. | | |

Ion-exchanged Water (Calcium content and magnesium content each were 3 ppm or less.)

In every case, the last-processed sample was evaluated with respect to photographic characteristics and fastness. Evaluation of the photographic characteristics was effected on the magenta density (fog) in the non-exposed area. For evaluating fastness, each of the processed samples was exposed with a fluorescent tester (illuminance: 200,000 luxes) for b 6 weeks, the remaining magenta density on the area having an initial magenta density of 1.0 and that on the area having an initial magenta density of 0.5 were measured, and the residual percentage of the magenta density in each area was obtained. The results obtained are shown in Table 2 below.

Comparative compounds (a), (d) and (e) used above were same as those used in Example 1.

Comparative compound (f) used above is one having the following structure.

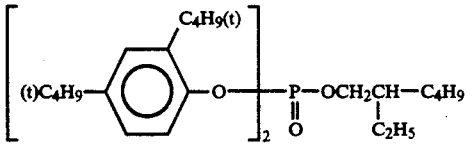

(described in JP-A-56-81836)

As is obvious from the results in the above-mentioned examples, the color photographic materials of the present invention, which contain one or more couplers with an excellent color-reproducibility, have an excellent image fastness. In particular, the materials have an greatly improved and excellent light-fastness of the magenta image in the low density area.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material having

TABLE 2

| Sample Code | Magenta Coupler | Color Image Stabilizer-1 | Color Image Stabilizer-2 | Fog | Residual Percentage of Magenta Density (after exposure to 200,000 lux-Xe, for 8 days) Initial Density (1.0) (%) | Initial Density (0.5) (%) | Remarks |
|---|---|---|---|---|---|---|---|
| 1C | ExM | — | Cpd-3 | 0.07 | 67 | 53 | Comparison |
| 2C | " | — | A-3 | 0.07 | 64 | 52 | " |
| 3C | " | — | A-12 | 0.07 | 65 | 50 | " |
| 4C | " | — | A-29 | 0.07 | 64 | 52 | " |
| 5C | " | — | Comparative Compound (e) | 0.09 | 60 | 48 | " |
| 6C | " | — | Comparative Compound (e) | 0.09 | 64 | 53 | " |
| 7C | " | Comparative Compound (a) | Comparative Compound (e) | 0.40 | 60 | 50 | " |
| 8C | " | Comparative Compound (a) | Comparative Compound (e) | 0.40 | 64 | 54 | " |
| 9C | " | Comparative Compound (a) | Cpd-3 | 0.39 | 67 | 54 | " |
| 10C | " | Comparative Compound (d) | " | 0.07 | 69 | 60 | " |
| 11C | " | Comparative Compound (d) | A-3 | 0.07 | 67 | 59 | " |
| 12C | " | Comparative Compound (d) | A-12 | 0.07 | 68 | 59 | " |
| 13C | ExM | Comparative Compound (d) | A-29 | 0.07 | 68 | 59 | Comparison |
| 14C | " | Comparative Compound (f) | Cpd-3 | 0.07 | 68 | 50 | " |
| 15C | " | P-14 | — | 0.07 | 32 | 22 | " |
| 16C | " | " | Cpd-3 | 0.07 | 82 | 80 | Invention |
| 17C | " | " | A-6 | 0.07 | 80 | 77 | " |
| 18C | " | " | A-12 | 0.07 | 79 | 77 | " |
| 19C | " | " | A-29 | 0.07 | 80 | 79 | " |
| 20C | M-14 | " | Cpd-3 | 0.07 | 80 | 78 | " |
| 21C | " | P-5 | " | 0.07 | 79 | 76 | " |
| 22C | " | — | " | 0.07 | 68 | 54 | Comparision |
| 23C | " | — | A-3 | 0.07 | 66 | 51 | " |
| 24C | " | P-5 | " | 0.07 | 80 | 76 | Invention |
| 25C | " | P-14 | " | 0.07 | 80 | 79 | " |

As is obvious from the results shown in Table 2 above, the samples of the present invention were hardly fogged and they showed excellent light-fastness. In particular, they have excellent light-fastness in the low magenta density area. It is therefore noted that the silver halide color photographic materials of the present invention are a significant improvement over known materials.

EXAMPLE 4

Samples which corresponded to Samples (17C) through (22C) of Example 3 but which contained coupler (M-3), (M-5), (M-29), (M-32), (M-34) or (M-37) were prepared. These were exposed, processed and subjected to the color-fading test in the same manner as in Example 3. As a result, the samples of the present invention were found to be hardly fogged and to have excellent light-fastness.

at least one coupler of the following formula (I), at least one compound of the following formula (II) and at least one compound of the following formula (III) in the same layer:

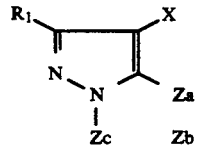

(I)

where $R_1$ represents a hydrogen atom or a substituent; X represents a hydrogen atom or a group which may be released by a coupling reaction with an oxidation product of an aromatic primary amine developing agent; Za, Zb and Zc each represents a methine group, a substituted methine group, =N— or —NH—; either the Za-Zb or the Zb-Zc bond is a double bond and the other is a single bond; when the Zb-Zc bond is a carbon-carbon double bond, it may form part of an aromatic ring; the coupler may form a dimer or a higher polymer at the position of $R_1$ or X; and when Za, Zb or Zc is a substituted methine group, the coupler may also form a dimer or a higher polymer at the position of the substituted methine group;

(II)

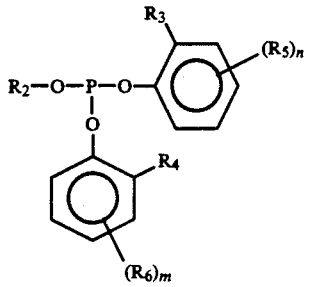

where $R_2$ represents an alkyl group, an alkenyl group, a cycloalkyl group or

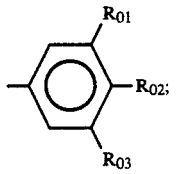

$R_3$ and $R_4$ each represents an alkyl group or $R_3$ and $R_4$ form a link which is a direct bond, an oxygen atom, a sulfur atom, an alkylene group or an alkylidene group; $R_{01}$, $R_{02}$ and $R_{03}$ each represents a hydrogen atom or a substituent; $R_5$ and $R_6$ each represents a substituent; and n and m represent an integer of from 0 to 4;

(III)

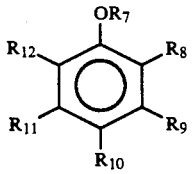

wherein $R_7$ represents an alkyl group, an alkenyl group, an aryl group, a heterocyclic group or

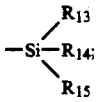

$R_{13}$, $R_{14}$ and $R_{15}$ may be the same or different and each represents an alkyl group, an alkenyl group, an aryl group, an alkoxy group, an alkenoxy group or an aryloxy group; $R_8$, $R_9$, $R_{10}$, $R_{11}$, and $R_{12}$ may be the same or different and each represents a hydrogen atom, an alkyl group, an alkenyl group, an aryl group, a substituted amino group, an alkylthio group, an arylthio group, a halogen atom

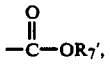

or —O—$R_7'$; $R_7'$ has the same meaning as $R_7$; $R_7$ and $R_8$ may be bonded to each other to form a 5-membered or 6-membered ring or a spiro ring; and $R_8$ and $R_9$, or $R_9$ and $R_{10}$ may be bonded to each other to form a 5-membered or 6-membered ring or a spiro ring.

2. The silver halide color photographic material as in claim 1, in which n and in the formula (II) each represents 1 or 2.

3. The silver halide color photographic material as in claim 1, in which $R_5$, $R_6$, $R_{01}$, $R_{02}$ and $R_{03}$ each represents a halogen atom, an alkyl group, an alkenyl group, an aryl group, an alkoxycarbonyl group, an aryloxycarbonyl group, a carbamoyl group, an alkoxy group, an aryloxy group, a sulfonyl group, a sulfonamido group, a sulfamoyl group or an acylamino group.

4. The silver halide color photographic material as in claim 3, in which $R_5$ and $R_6$ of the formula (II) each is an alkyl group or an alkoxycarbonyl group.

5. The silver halide color photographic material as in claim 4, in which $R_5$ and $R_6$ of the formula (II) each is an alkyl group.

6. The silver halide color photographic material as in claim 1, in which $R_2$ in the formula (II) is a substituted alkyl group or a branched alkyl group.

7. The silver halide color photographic material as in claim 1, in which $R_3$ and $R_4$ in the formula (II) each represents a tertiary alkyl group or $R_3$ and $R_4$ form a link which is a direct bond, an oxygen atom, a sulfur atom, an alkylene group or an alkylidene group.

8. The silver halide color photographic material as in claim 1, in which the coupler of the formula (I) is selected from pyrazoloazole magenta couplers of formulae (I-1) through (I-7):

(I-1)

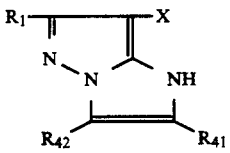

(I-2)

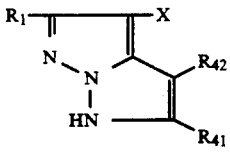

(I-3)

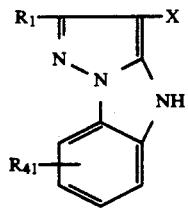

(I-4)

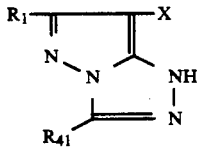

-continued

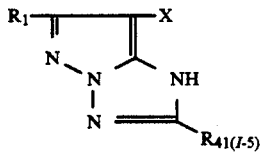

(I-5)

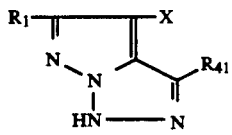

(I-6)

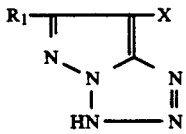

(I-7)

where $R_1$, $R_{41}$ and $R_{42}$ may be same or different and each represents a hydrogen atom, a halogen atom, an alkyl group, an aryl group, a heterocyclic group, a cyano group, an alkoxy group, an aryloxy group, a heterocyclic-oxy group, an acyloxy group, a carbamoyloxy group, a silyloxy group, a sulfonyloxy group, an acylamino group, an anilino group, an ureido group, an imido group, a sulfamoylamino group, a carbamoylamino group, an alkylthio group, an arylthio group, a heterocyclic-thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group or an aryloxycarbonyl group;

X represents a hydrogen atom, a halogen atom, a carboxyl group, or a group which is bonded to the carbon atom of the coupling position via an oxygen atom, a nitrogen atom or a sulfur atom and which is released from the coupler by coupling; and the coupler may form a dimer or a higher polymer at the position of $R_1$, $R_{41}$, $R_{42}$ or X.

9. The silver halide color photographic material as in claim 8, in which the coupler of the formula (I) is selected from pyrazoloazole magenta couplers of the formulae (I-1), (I-4) and (I-5).

10. The silver halide color photographic material as in claim 8, in which the coupler of the formula (I) is selected from pyrazoloazole magenta couplers of the formulae, (I-4) and (I-5).

11. The silver halide color photographic material as in anyone of claims 8, in which the coupler of the formula (I) is in the form of a polymer coupler.

12. The silver halide color photographic material as in claim 11, in which the polymer coupler is in the form of a polymer coupler latex.

13. The silver halide color photographic material as in claim 1, in which the compound of formula (III) is selected from compounds of formulae (III-1) through (III-8):

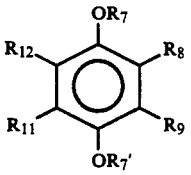

(III-1)

-continued

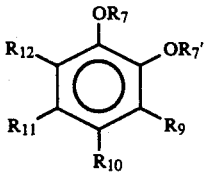

(III-2)

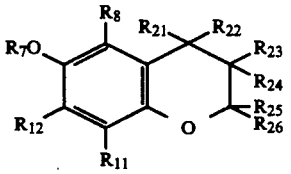

(III-3)

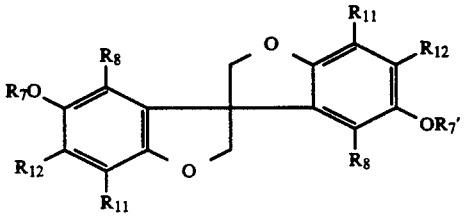

(III-4)

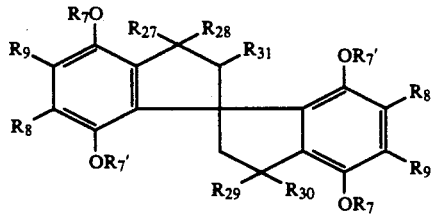

(III-5)

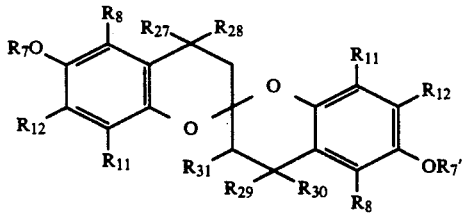

(III-6)

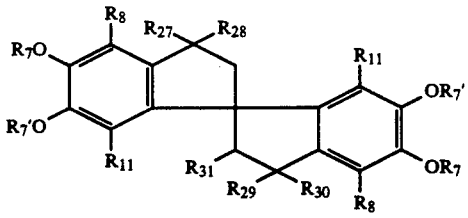

(III-7)

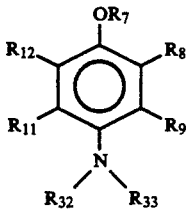

(III-8)

where $R_7$, $R_7'$, $R_8$, $R_9$, $R_{10}$, $R_{11}$ and $R_{12}$ have the same meanings as in the formula (III);

$R_{21}$ through $R_{32}$ may be the same or different and each represents a hydrogen atom, an alkyl group or an aryl group; $R_{32}$ and $R_{33}$ may be the same or different and each represents a hydrogen atom, an alkyl group, an aryl group, an acryl group, an oxycarbonyl group, or a sulfonyl group, provided that both $R_{32}$ and $R_{33}$ must not be hydrogen atoms at the same time; and $R_{32}$ and $R_{33}$ may be bonded to each other to form a 5-membered to 7-membered ring.

14. The silver halide color photographic material as in claim 13, in which $R_7$ and $R_7'$ in the formulae (III-1) through (III-8) each represents an alkyl group.

15. The silver halide color photographic material as in claim 1, in which the coupler of formula (I) is used in an amount of from $1\times10^{-3}$ to 1 mol per mol of the silver halide.

16. The silver halide color photographic material as in claim 1, in which the compound of formula (II) is used in an amount of from 5 to 300 mol% of the coupler of the formula (I).

17. The silver halide color photographic material as in claim 1, in which the compound of the formula (III) is used in an amount of from 10 to 400 mol% of the coupler.

* * * * *